US005310630A

United States Patent [19]

Inagaki

[11] Patent Number: 5,310,630

[45] Date of Patent: May 10, 1994

[54] SILVER HALIDE COLOR PHOTOSENSITIVE MATERIALS

[75] Inventor: Yoshio Inagaki, Kanagawa, Japan

[73] Assignee: Fuji Photo Film Co., Ltd., Ashigara, Japan

[21] Appl. No.: 879,730

[22] Filed: May 6, 1992

Related U.S. Application Data

[63] Continuation of Ser. No. 514,555, Apr. 26, 1990, abandoned.

[30] Foreign Application Priority Data

Apr. 27, 1989 [JP] Japan ..... 1-108217

[51] Int. Cl.[5] ..... G03C 7/30; G03C 7/00

[52] U.S. Cl. ..... 430/434; 430/363; 430/383; 430/391; 430/505; 430/508; 430/510; 430/522; 430/577; 430/578; 430/583; 430/585; 430/600; 430/944

[58] Field of Search ..... 430/363, 944, 510, 522, 430/505, 508, 511, 383, 391, 467, 434, 578, 583, 585, 600

[56] References Cited

U.S. PATENT DOCUMENTS

| | | | |
|---|---|---|---|
| 4,619,892 | 10/1986 | Simpson et al. | 430/508 |
| 4,801,525 | 1/1989 | Mihara et al. | 430/944 |
| 4,839,265 | 1/1989 | Ohuo et al. | 430/522 |
| 4,873,170 | 10/1989 | Nishinoiri et al. | 430/204 |
| 5,002,862 | 3/1991 | Yagihara | 430/434 |
| 5,057,405 | 10/1991 | Shiba et al. | 430/505 |

*Primary Examiner*—Thorl Chea
*Attorney, Agent, or Firm*—Burns, Doane, Swecker & Mathis

[57] ABSTRACT

A silver halide color photographic photosensitive material which has been spectrally sensitized to light of wavelengths greater than of about 670 nm in which are highly sensitive to light of wavelength greater than about 670 nm and sufficiently insensitive to visible light having a shorter wavelength. The photosensitive materials comprises a silver halide photosensitive layer containing the yellow coupler, a silver halide photosensitive layer containing a magenta coupler, a silver halide photosensitive layer containing a cyan coupler and at least one non-photosensitive hydrophilic layer. Each of the photosensitive layers are spectrally sensitized such that they have different peak spectral sensitivities at light wavelengths greater than about 670 nm. The photosensitive material also comprises at least one first dye which has an absorption peak wavelength in the wavelength region longer than 400 nm but at least 20 nm shorter than the shortest of the wavelengths which form the peak values of the spectral sensitivities of the photosensitive layers. This first dye can be included in a photosensitive layer and/or a non-photosensitive hydrophilic colloid layer. The photosensitive material can also contain at least one second dye which has an absorption peak wavelength at a wavelength region of 670 nm to 1000 nm.

18 Claims, No Drawings

SILVER HALIDE COLOR PHOTOSENSITIVE MATERIALS

This application is a continuation of application Ser. No. 07/514,555, filed Apr. 26, 1990, now abandoned.

BACKGROUND OF THE INVENTION

This invention relates to silver halide color photosensitive materials used in forming full color images by exposure to near infrared light and color development processing.

The color photosensitive materials which have been widely used in the past are photosensitive to visible light and so they must be shielded from visible light during handling, for example, while being developed and processed in a dark room. This is very inconvenient in that it has been essentially impossible to visually observe the processing situation.

On the other hand, photographic materials comprising a support having thereon at least three layers (i.e., silver halide photosensitive layers) which contain silver halide emulsions which have been spectrally sensitized so as to be photosensitive to the near infrared light which is emitted from semiconductor lasers or light emitting diodes, and color couplers for colored image forming purposes, as well as methods for forming colored images by color development processing after subjecting these materials to a scanning exposure using three types of light beam with different wavelengths, have been disclosed in recent years. Examples of these materials and methods have been disclosed in JP-A-63-197947, JP-A-62-295048, JP-A-61-137149, JP-A-55-13505, U.S. Pat. No. 4,619,892 and European Patent 0,183,528A2. (The term "JP-A" as used herein signifies an "unexamined published Japanese patent application".)

Even though each of the photosensitive layers employed in these photosensitive materials have been spectrally sensitized to the infrared region, the spectral sensitivity in the visible region is still quite high. This is a general phenomenon which cannot be avoid and which is based upon the fact that the absorption bands of spectrally sensitizing dyes are wide with the edges of the absorption band extending over a wide range on the short wavelength side of the peak wavelength of the spectral absorption. Hence, photosensitive materials which have been spectrally sensitized to three different wavelengths in the infrared region must still be handled under very dim safe-lighting and they also must be processed in a state of darkness for safety. These requirements make the use of these materials disadvantageous particularly in the area of operability. Hence, an improvement that allowed these materials to be handled under bright safe-lighting in what is called a light room would be desirable from the operability viewpoint. However, the handling of photosensitive materials which have peak spectrally sensitized wavelengths of more than 670 nm under safe-lighting of the light room type is very difficult for the reasons outlined above. Accordingly a choice has to be made between using those materials which can be handled in bright safe-lighting but which are of low sensitivity and require very bright exposures of long duration, and those materials which must be handled under dark safe-lighting but which have a high sensitivity and can be used with short exposure times. However, the material must have a high sensitivity in those cases where a scanning exposure of a large image must be carried out in a very short period of time using i.e., semiconductor lasers or light emitting diodes as light sources. Hence, there is a need for sensitive materials which have an adequately high photographic speed with respect to near infrared light sources but which have a photographic speed with respect to visible light so low that it can be effectively disregarded.

SUMMARY OF THE INVENTION

The present invention relates to silver halide color photosensitive materials which have been spectrally sensitized to light of wavelengths greater than about 670 nm and which are highly sensitive to light having a wavelength greater than about 670 nm and sufficiently insensitive to visible light of shorter wavelengths. Furthermore, the silver halide color photosensitive materials of the present invention can be developed rapidly and with which there is little residual coloration after development processing.

In particular, the present invention relates to a silver halide photosensitive material comprising at least three silver halide photosensitive layers comprising a silver halide photosensitive layer comprising a silver halide emulsion containing a yellow coupler, a silver halide photosensitive layer comprising a silver halide emulsion containing a magenta coupler, a silver halide photosensitive layer comprising a silver halide emulsion containing a cyan coupler and at least one non-photosensitive hydrophilic layer. Each of the photosensitive layers are spectrally sensitized such that they have different peak spectral sensitivities at wavelengths greater than about 670 nm. The photosensitive material also contains at least one first dye in an amount of 50 mg/m$^2$ or more, which has an absorption peak wavelength in the wavelength region longer than 400 nm but at least 20 nm shorter than the shortest of the wavelengths which form the peak values of the spectral sensitivities of the photosensitive layer.

This first dye can be included in a photosensitive and/or a non-photosensitive hydrophilic colloid layer.

DETAILED DESCRIPTION OF THE PREFERRED EMBODIMENTS OF THE INVENTION

The dyes which have an absorption peak wavelength at least 20 nm shorter than the shortest spectrally sensitized peak wavelength and which can be used as the first dye in the present invention can be employed in a silver halide emulsion layer, in a layer which is closer to the light source than the silver halide photosensitive layers, or in a layer which is farther from the light source than the silver halide photosensitive layers. Furthermore, these dyes may be distributed continuously in each of the silver halide photosensitive layers and the non-photosensitive hydrophilic colloid layers adjacent thereto in the photosensitive material, or they may be localized in a specified layer. In those cases where the dyes are localized in a specified layer, ballast groups may be introduced into the dyes, or they may be coupled to a binding agent, e.g., gelatin so as to be rendered immobile, or the dyes may be added together with a polymer ordant, or they can be dispersed in the form of fine solid particles. Details therefor are disclosed, for example, in EP-A-15601, U.S. Pat. Nos. 4,803,150 and 4,855,221, WO-A-88-04794, etc. (The term "EP-A-" and "WO-A-" as used herein signifies an "unexamined published European patent application" and "unexamined published International patent application", respectively.) Dyes are preferably used in an amount of from 90 to 500 mg/m$^2$.

Some of the dyes which can be employed as the first dye in the present invention include oxonol dyes, hemioxonol dyes, merocyanine dyes, aniline dyes, azo dyes, azomethine dyes or styryl dyes. Moreover, dyes in which the chromogen structure is destroyed during a processing operation, such as development or fixing to be colorless, as well as dyes which can be washed out in a processing bath are preferred.

Specific examples of dyes which can be used in this present invention include the pyrazolone oxonol dyes disclosed in U.S. Pat. No. 2,274,782, the diarylazo dyes disclosed in U.S. Pat. No. 2,956,879, the styryl dyes and butadienyl dyes disclosed in U.S. Pat. Nos. 3,423,207 and 3,384,487, the merocyanine dyes disclosed in U.S. Pat. No. 2,527,583, the merocyanine dyes and oxonol dyes disclosed in U.S. Pat. Nos. 3,486,897, 3,652,284 and 3,718,472, the enamino hemi-oxonol dyes disclosed in U.S. Pat. No. 3,976,661, as well as the dyes disclosed in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704, 3,653,905, 4,042,397 and 4,756,995, JP-A-62-106455, JP-A-62-133453, JP-A-62-185755, JP-A-62-273527, JP-A-63-2045, JP-A-63-40143, JP-A-63-77054, JP-A-63-110444, JP-A-63-139949, JP-A-63-200146, JP-A-63-145281, JP-A-63-280246, JP-A-63-301888, JP-A-63-316853, JP-A-63-197943, European Patents 126,324B1, 226,541A, 274,723A1, 297,873A2 and 299,435A2, JP-B-62-41264, JP-B-62-41265, JP-B-62-41262 (JP-A-55-161233)and JP-B-62-41263 (JP-A-55-161232). (The term "JP-B" as used herein signifies an "examined Japanese patent publication".)

The absorption peak wavelength of the dyes employed as the first dye in the present invention is preferably in the visible region from 650 nm to 410 nm. Here, the absorption peak wavelength of the dye signifies the value observed in the photosensitive material.

Preferred first dyes which absorb visible light can be represented by the general formulae (a) to (g) illustrated below. Of them, dyes represented by the general formula (a) and (b) are most preferred, because an incorporation of a large amount of the dye into the photosensitive material hardly occurs stain, due to an excellent decolorization property of the dye when processed with a processing solution.

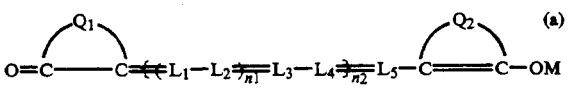

(a)

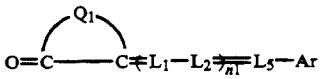

(b)

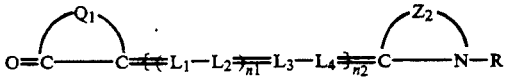

(c)

-continued

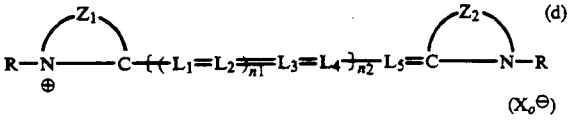

(d)

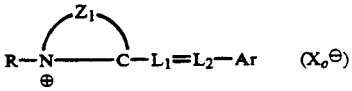

(e)

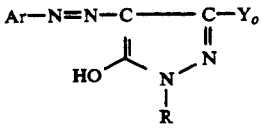

(f)

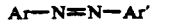

(g)

In the above formulae, $Q_1$ and $Q_2$ each represent a group of atoms which are necessary to form a pyrazolone, barbituric acid, thiobarbituric acid, iso-oxazolone, 3-oxythionaphthene, 1,3-indandione, 3,5-pyrazolidindione, pyridone, pyridine or dioxopyrazolo-[3,4-b]pyridine ring structure.

$Z_1$ and $Z_2$ each represent a group of atoms which are necessary to form a thiazole, oxazole, imidazole or indolenine ring structure, which may or may not be condensed with an aromatic ring.

Ar and Ar' each represent phenyl group or naphthyl group, which may or may not be substituted.

M represents hydrogen atom, an alkali metal atom, an ammonium ion which may or may not be substituted, or a phosphonium ion which may or may not be substituted.

R represents an alkyl group, benzyl group or phenyl group, which may or may not be substituted.

$L_1$ to $L_5$ represent methine groups which may or may not be substituted.

Moreover, $n_1$ and $n_2$ individually represent 0 or 1, and $X_o\ominus$ may be bonded to $Z_1$, $Z_2$, R, $L_1$ to $L_5$ or Ar to form an internal salt.

$Y_0$ represents an alkyl group, phenyl group, cyano group, an alkoxy group, a carboxyl group, an alkoxycarbonyl group, carbamoyl group or a carboxamido group, and these may or may not have substituent groups.

The use of the above dyes which contain one or more sulfonic acid group or carboxyl group as substituent group for $Y_0$, $L_1$ to $L_5$, R, Ar or Ar' is especially desirable in view of their excellent decolorizing properties.

The rings completed by $Q_1$ or $Q_2$ are preferably pyrazolone rings, pyrrolidone rings or dioxo[3,4-b]pyrazolopyridine rings, and most desirably pyrazolone rings which have a phenyl, benzyl or alkyl group which has a sulfonic acid group as a substituent group in the 1-position.

The rings completed by $Z_1$ and $Z_2$, are preferably benzoxazole, benzothiazole, benzimidazole, quinoline or indolenine rings, which may have substituent groups.

Specific examples of these dyes are illustrated below, but the invention is not to be limited to these particular dyes.

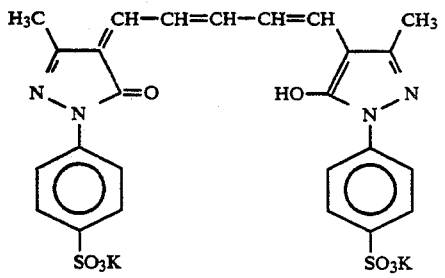
D-1
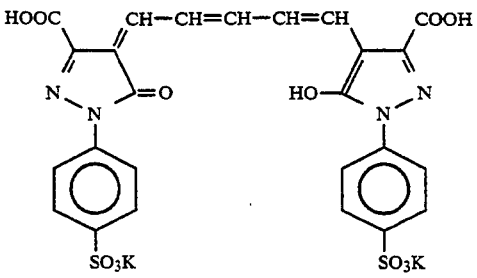
D-2
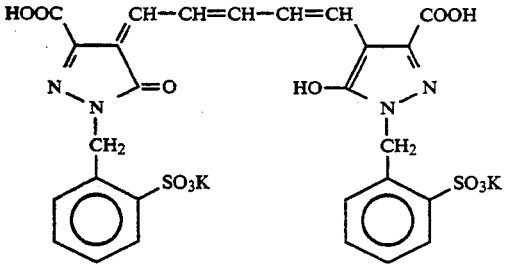
D-3
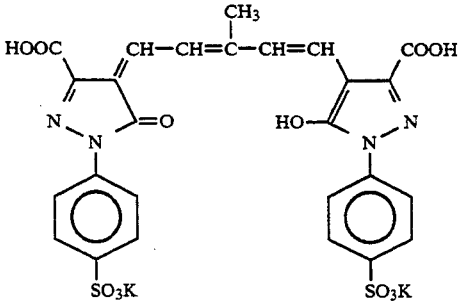
D-4
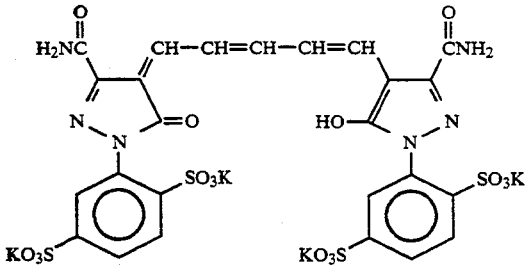
D-5
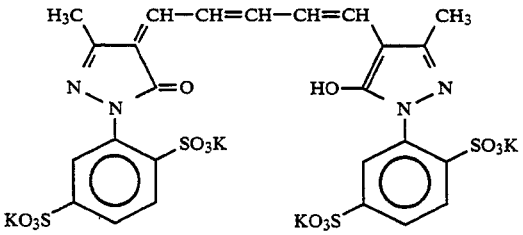
D-6
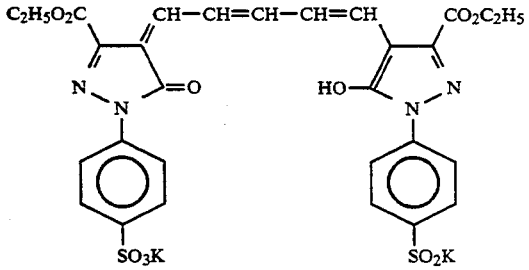
D-7
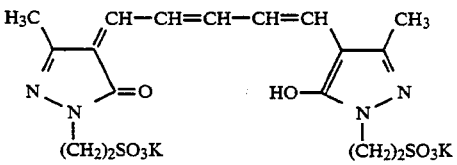
D-8
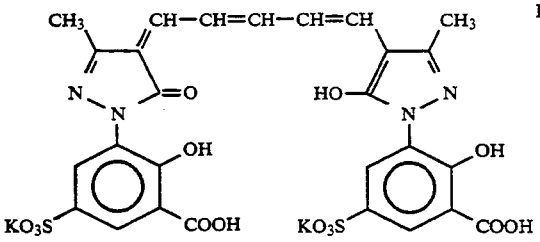
D-9
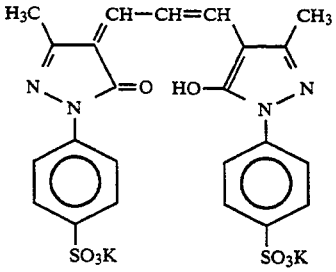
D-10

-continued
D-11
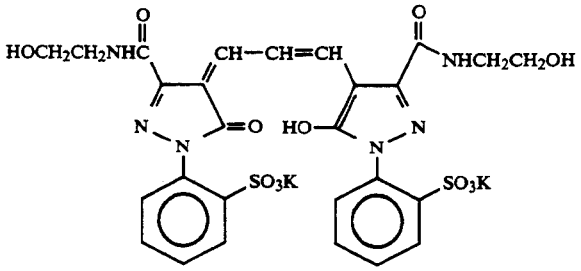
D-12
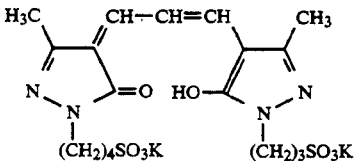
D-13
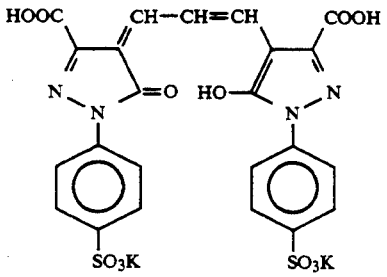
D-14
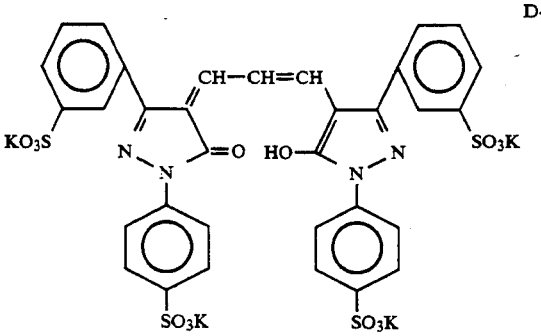
D-15
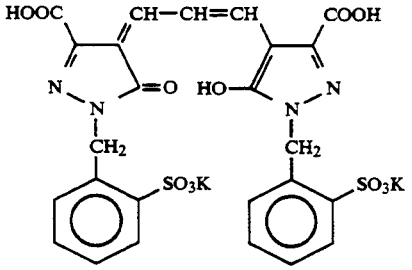
D-16
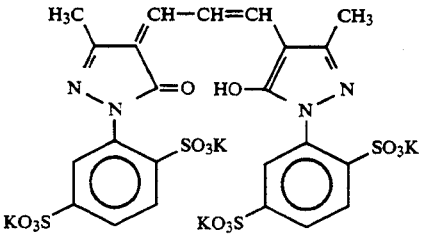
D-17
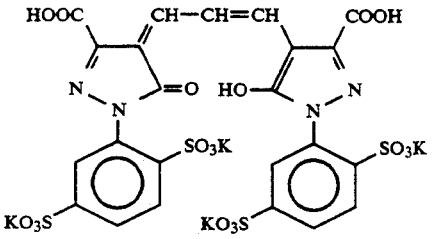
D-18
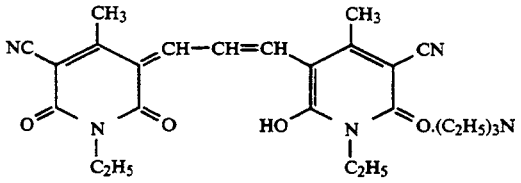
D-19
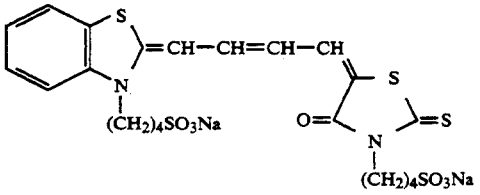

-continued
D-20
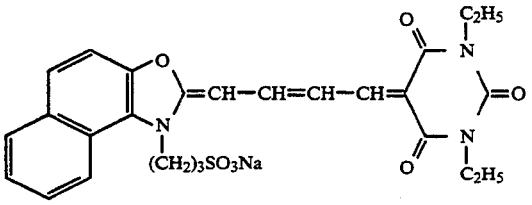
D-21
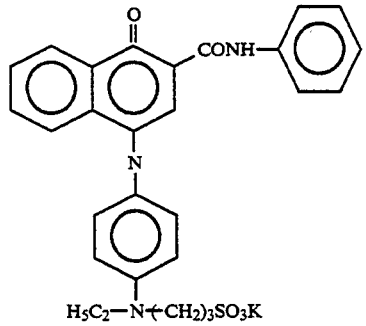
D-22
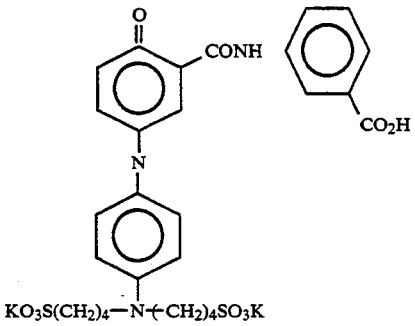
D-23
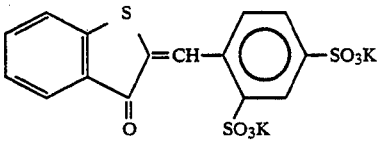
D-25
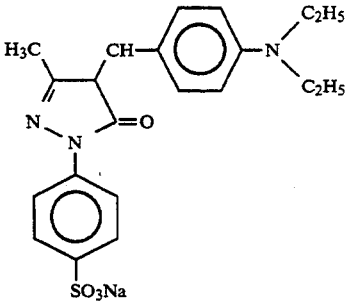
D-26
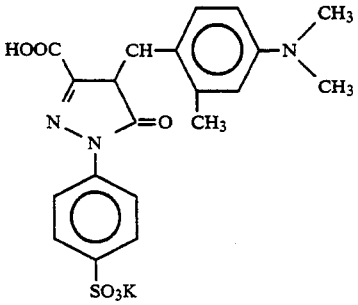
D-27
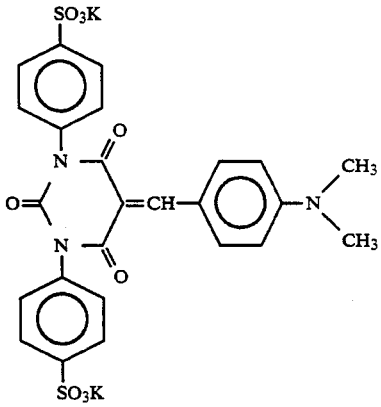
D-28
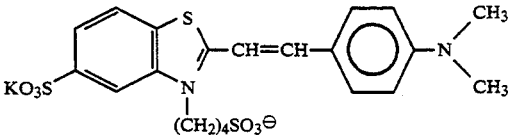

-continued
D-29
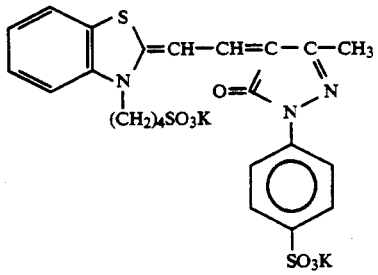
D-30
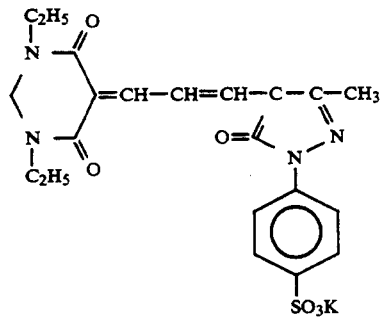
D-31
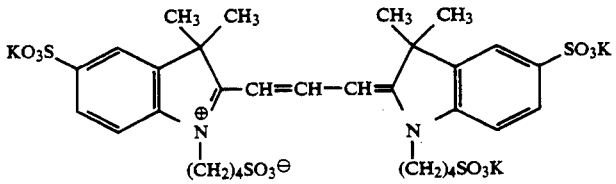
D-32
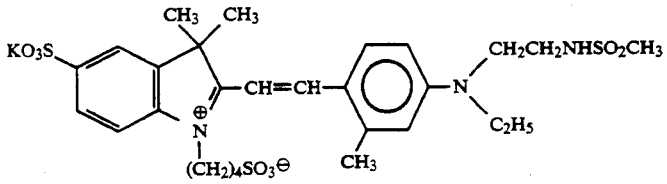
D-33
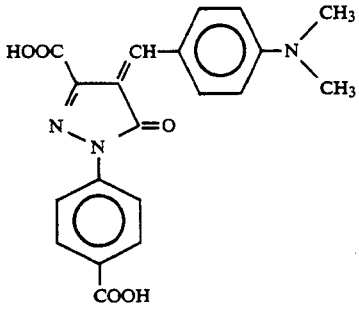
D-34
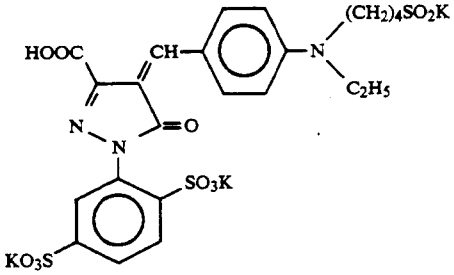
D-35
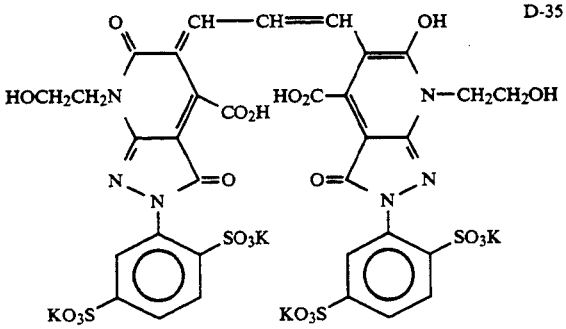
D-36
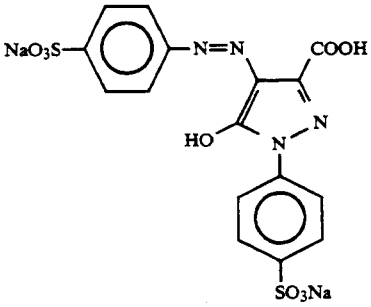
D-37
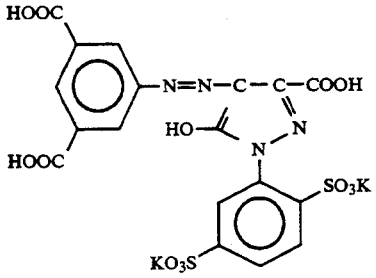
D-38
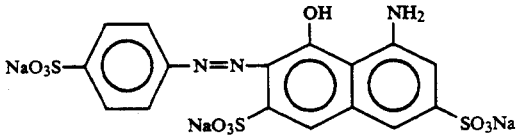

-continued

D-39

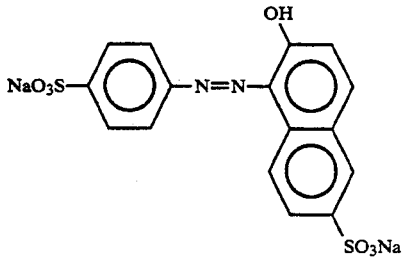

D-40

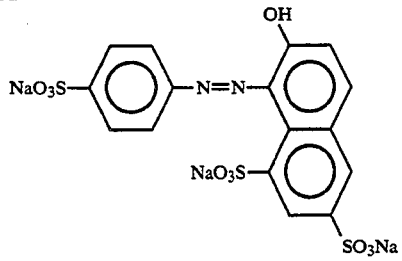

D-41

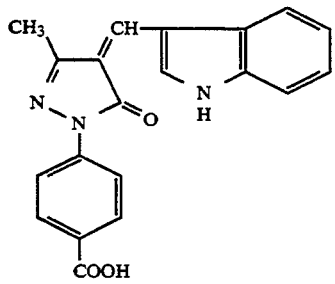

D-42

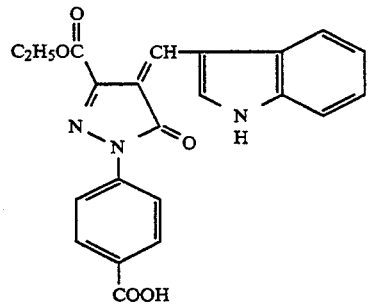

In the present invention, at least one second dye which has an absorption peak wavelength in the region from 670 nm to 1000 nm may be included as a filter dye, or for the prevention of irradiation or halation, in addition to the first dyes. The preferred dyes which can be employed as the second dye have acidic groups, such as sulfonic acid groups or carboxylic acid groups, and the dyes encompassed in the disclosures in JP-A-62-123454 and European Patents 0,251,282 and 0,288,076 are particularly preferred. These are, for example, dyes which can be represented by the general formula (A) illustrated below.

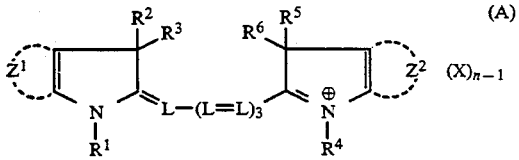

(A)

In general formula (A), $R^1$, $R^2$, $R^3$, $R^4$, $R^5$ and $R^6$ may be the same or different, each representing a substituted or unsubstituted alkyl group, and $Z^1$ and $Z^2$ represent groups of non-metal atoms which are necessary to form substituted or unsubstituted benzo-condensed rings or substituted or unsubstituted naphtho-condensed rings. However, at least three, and preferably from four to six, of the groups represented by $R^1$, $R^2$, $R^3$, $R^4$, $R^5$, $R^6$, $Z^1$ and $Z^2$ have acid substituent groups (for example, sulfonic acid groups or carboxylic acid groups) and these groups more preferably represent groups which allow the dye molecule to have from four to six sulfonic acid groups. In the present invention, a sulfonic acid group signifies a sulfo group or a salt thereof, and a carboxylic acid group signifies a carboxyl group or a salt thereof. Examples of salts include alkali metals such as Na and K salts, ammonium salts, and organic ammonium salts of, such as, triethylamine, tributylamine and pyridine.

L represents a substituted or unsubstituted methine group, and X represents an anion. Specific examples of anions which can be represented by X include halogen ions (Cl, Br), p-toluenesulfonate ions and ethylsulfate ions.

Moreover, n represents 1 or 2, and it is 1 when the dye forms an internal salt.

The alkyl groups represented by $R^1$, $R^2$, $R^3$, $R^4$, $R^5$, $R^6$ are preferably lower alkyl groups which have from 1 to 5 carbon atoms (for example, methyl, ethyl, n-propyl, n-butyl, isopropyl, n-pentyl), and they may have substituent groups (for example, sulfonic acid groups, carboxylic acid groups, hydroxyl groups). More preferably, $R^1$ and $R^4$ represent lower alkyl groups which have from 1 to 5 carbon atoms which have a sulfonic acid group as a substituent group (for example, 2-sulfoethyl, 3-sulfopropyl, 4-sulfobutyl).

The substituent groups on the benzo-condensed rings and naphtho-condensed rings formed by the groups of non-metal atoms represented by $Z^1$ and $Z^2$ are preferably sulfonic acid groups, carboxylic acid groups, hydroxyl groups, halogen atoms (for example, F, Cl, Br), cyano groups, substituted amino groups (for example, dimethylamino, diethylamino, ethyl-4-sulfobutylamino, di(3-sulfopropyl)amino), or substituted or unsubstituted alkyl groups which have from 1 to 5 carbon atoms which are bonded directly, or via a divalent linking group, to the ring {for example, methyl, ethyl, propyl, butyl (preferably with sulfonic acid groups, carboxylic acid groups or hydroxyl groups as substituent groups)}, and the preferred divalent linking groups are, for example, —O—, —NHCO—, —$NHSO_2$—, —NHCOO—, —NHCONH—, —COO—, —CO— and —$SO_2$—.

The preferred substituent groups for the methine groups represented by L include substituted and unsubstituted lower alkyl groups which have from 1 to 5 carbon atoms (for example, methyl, ethyl, 3-hydroxypropyl, benzyl, 2-sulfoethyl), halogen atoms (for example, F, Cl, Br), substituted or unsubstituted aryl groups (for example, phenyl, 4-chlorophenyl) and lower alkoxy groups (for example, methoxy, ethoxy). Furthermore, the substituent groups of the methine groups represented by L can be joined together to form six membered rings which contain three methine groups (for example, a 4,4'-dimethylcyclohexene ring).

Specific examples of second dye compounds represented by the aforementioned general formula (A) which can be used in this present invention are illustrated below, but the scope of the invention is not to be limited by these examples.
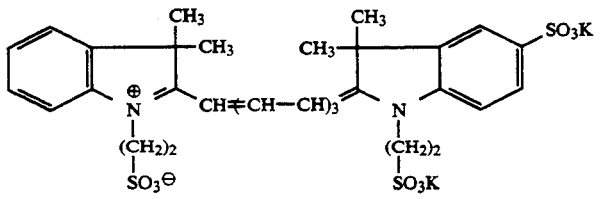
(A-1)
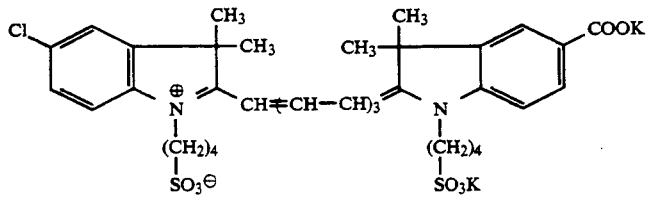
(A-2)
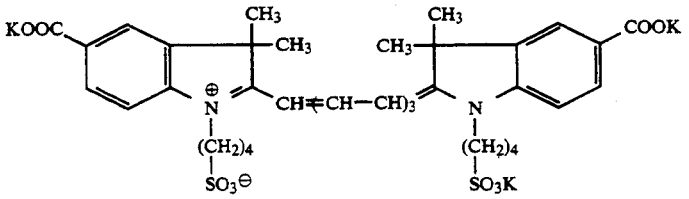
(A-3)
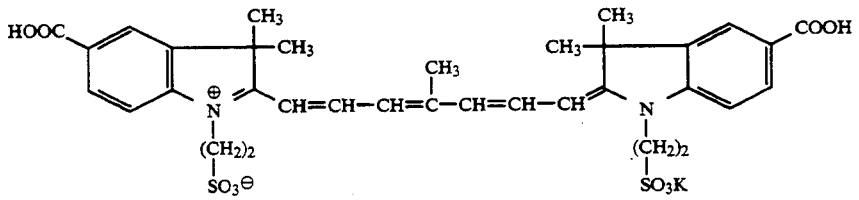
(A-4)
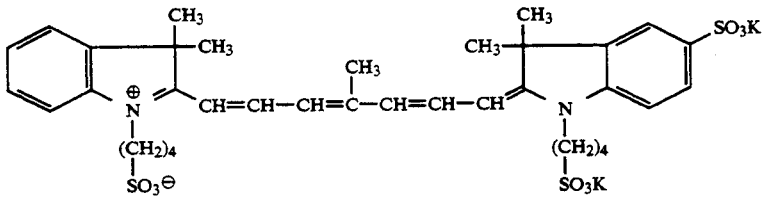
(A-5)
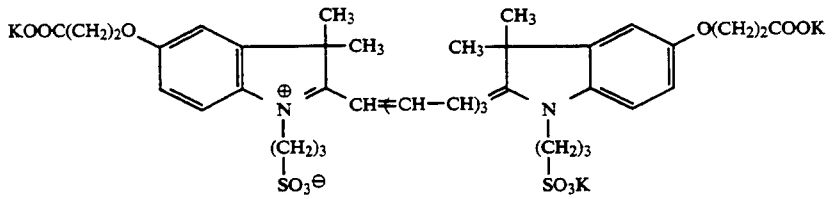
(A-6)
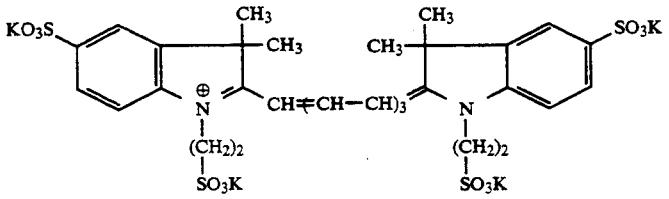
(A-7)

-continued
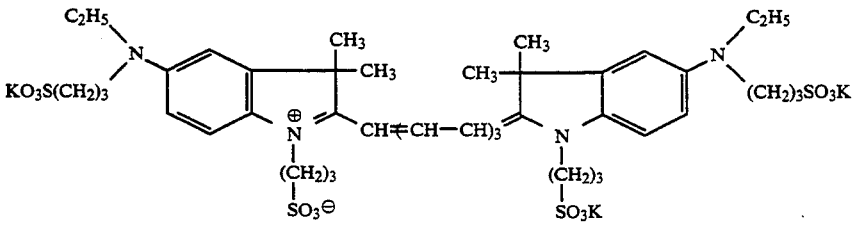
(A-8)
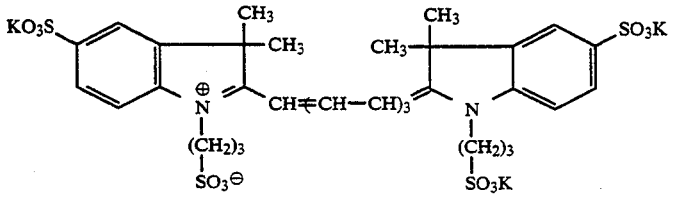
(A-9)
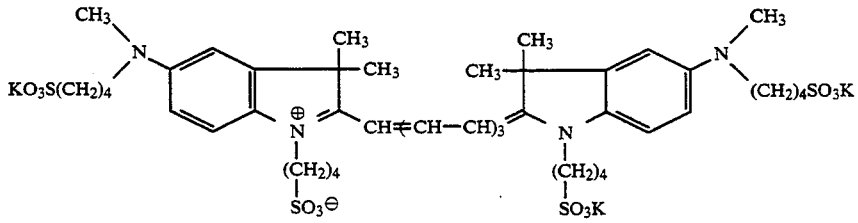
(A-10)
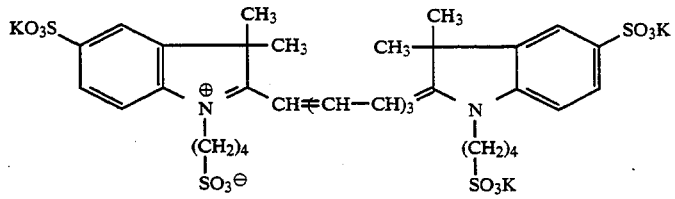
(A-11)
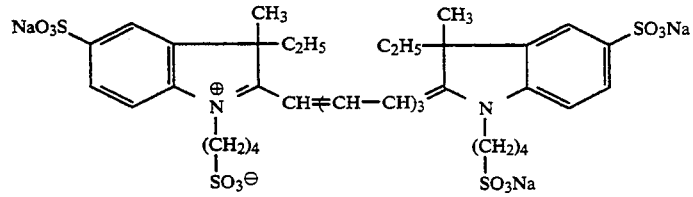
(A-12)
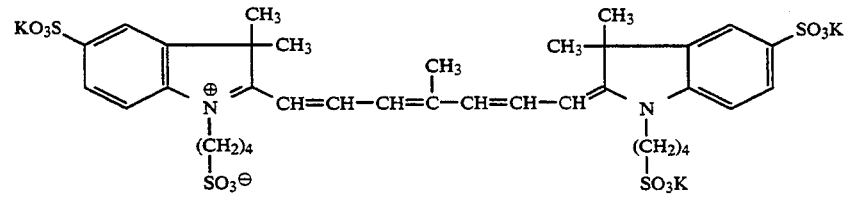
(A-13)
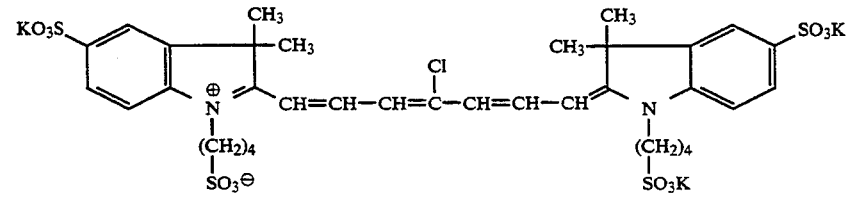
(A-14)

-continued
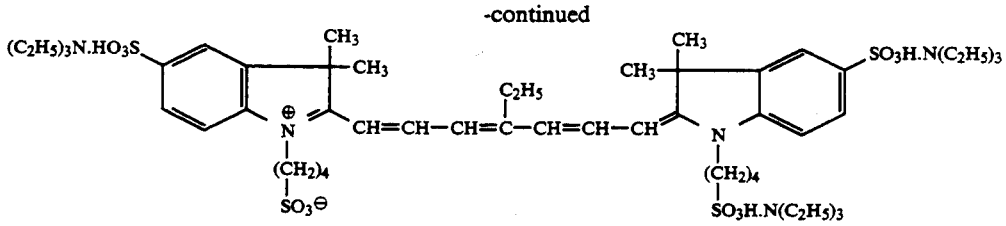
(A-15)
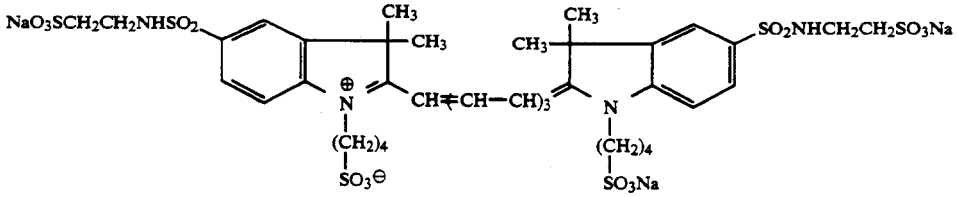
(A-19)
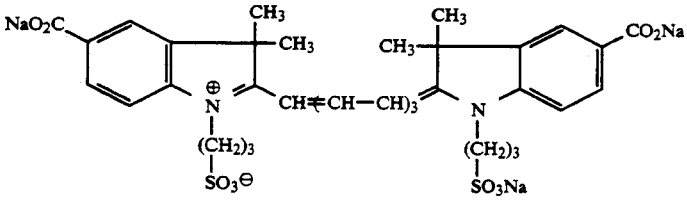
(A-20)
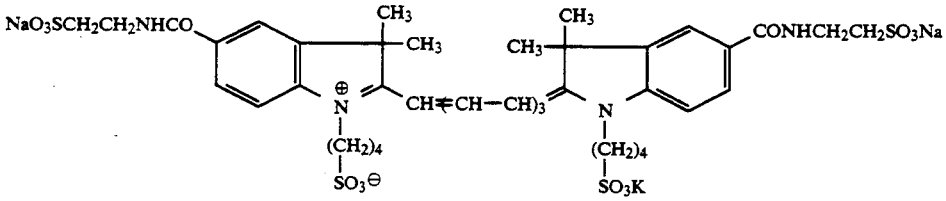
(A-21)
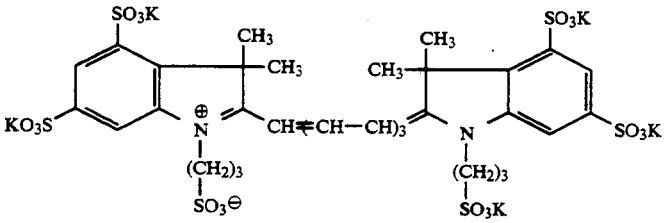
(A-16)
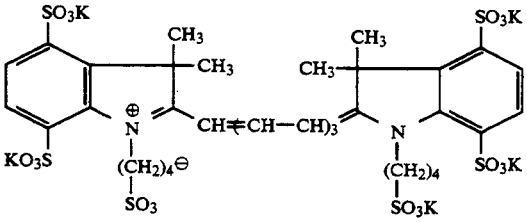
(A-17)
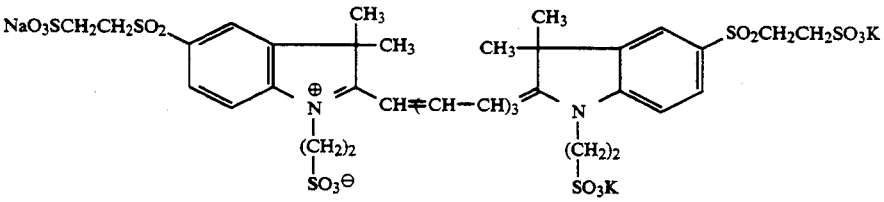
(A-18)
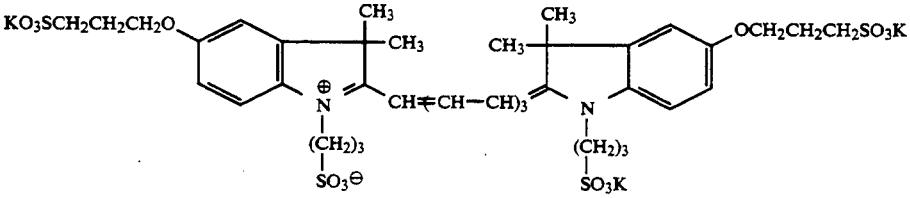
(A-22)

-continued
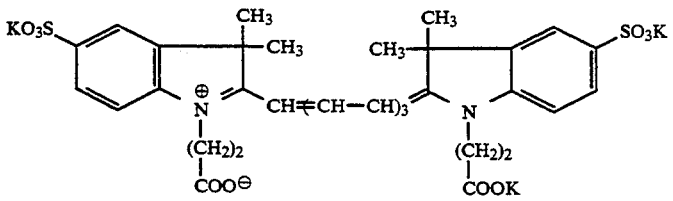
(A-23)
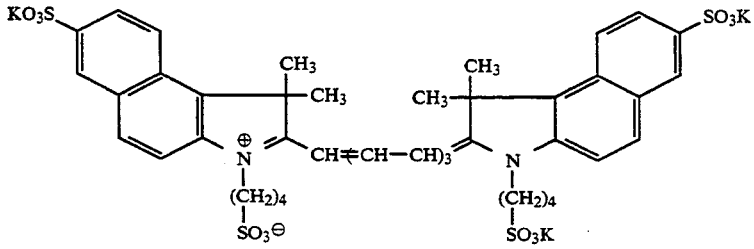
(A-24)
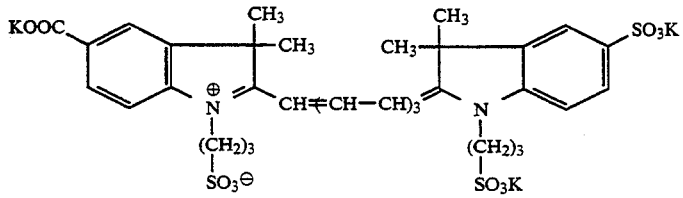
(A-25)
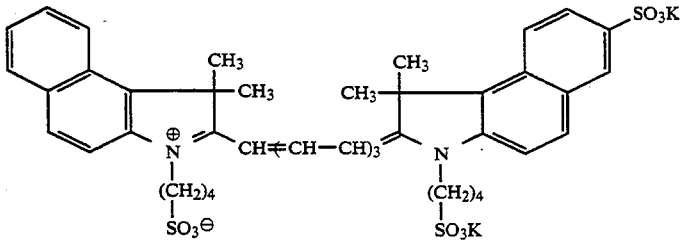
(A-26)
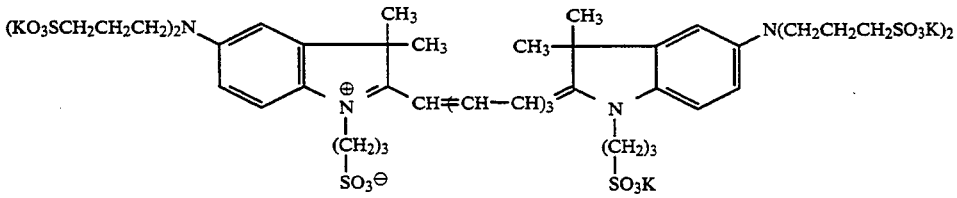
(A-27)
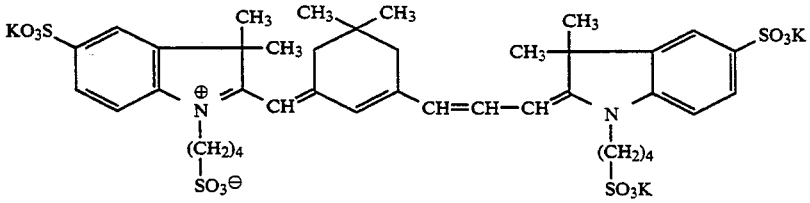
(A-28)
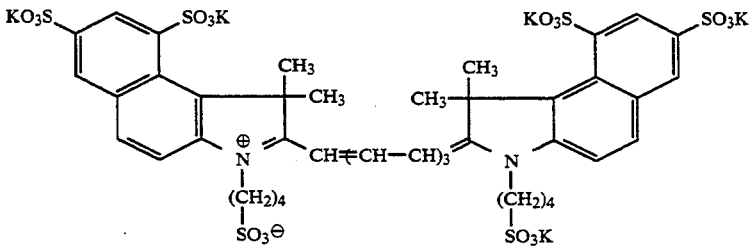
(A-29)

-continued
(A-30)
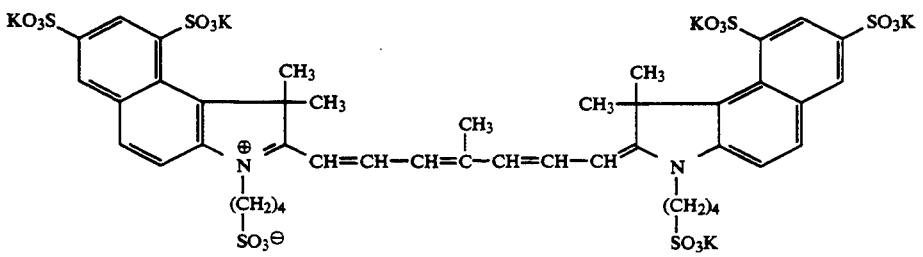
(A-31)
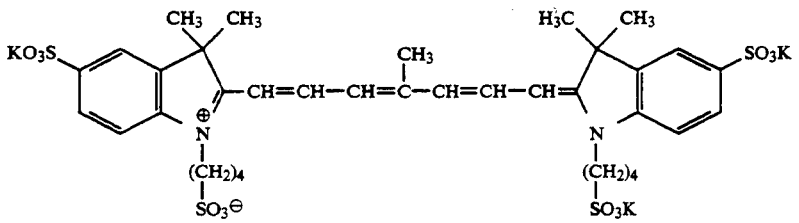
(A-32)
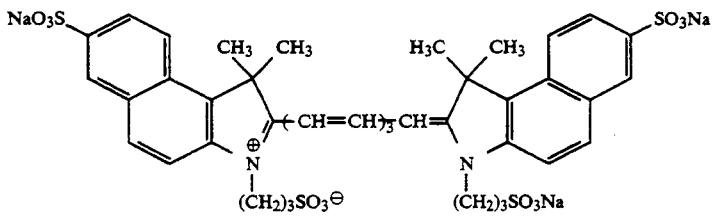
(A-33)
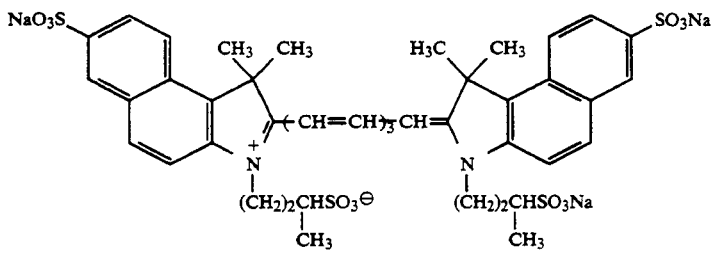
(A-34)
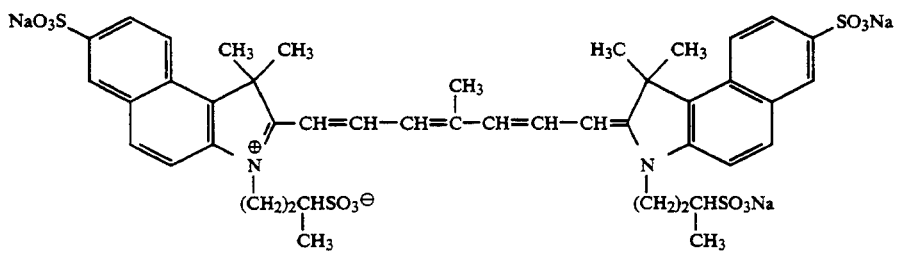
(A-35)
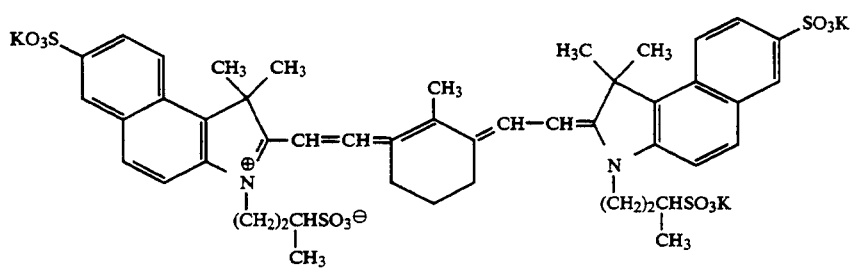

-continued (A-36)

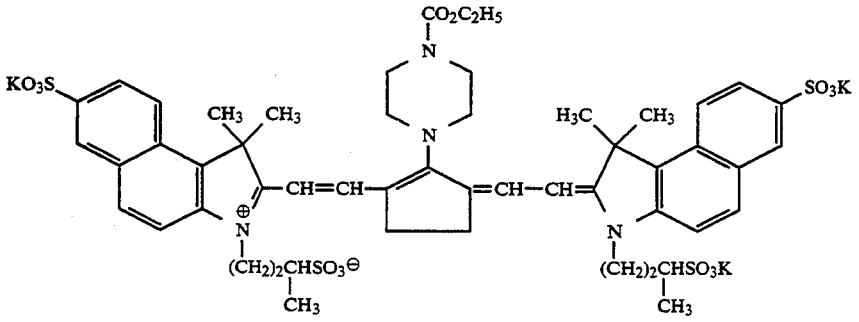

(A-37)

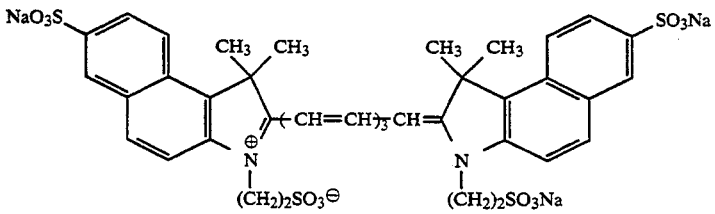

(A-38)

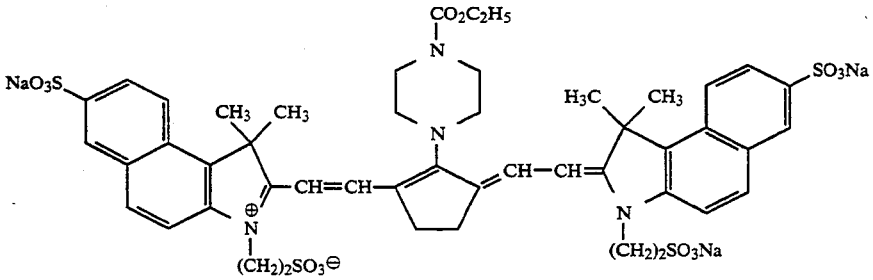

(A-39)

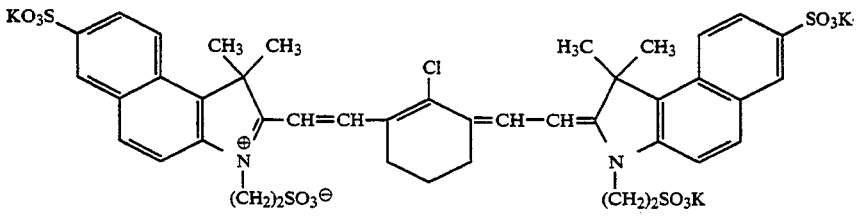

(A-40)

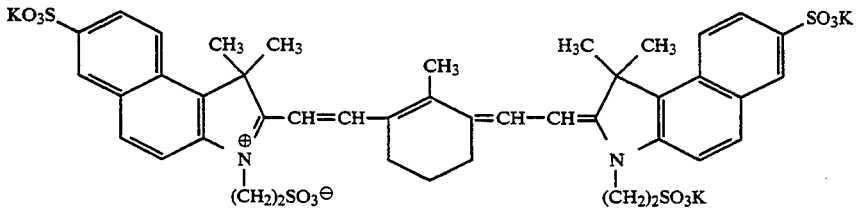

Dyes represented by general formula (A) have a peak absorption wavelength within the range from 730 to 850 nm and can be prepared with reference to J. Chem. Soc., 189 (1933), and the synthesis examples described in U.S. Pat. No. 2,895,955 and JP-A-62-123454.

The first dyes and/or the second dyes are dissolved in a suitable solvent, for example, an alcohol such as methanol or ethanol, methyl-cellosolve, or mixture thereof, for addition to a photosensitive or non-photosensitive hydrophilic colloid layer coating liquid, or they may be added in the form of an aqueous dispersion. Combinations of two or more types of these dyes can also be used.

The amount of the aforementioned second dye employed is generally from about 1 mg/m$^2$ to 100 mg/m$^2$.

The photographic dyes represented by the aforementioned general formula (A) are especially effective for preventing the occurrence of irradiation, and when they are used for this purpose they are, primarily, added to an emulsion layer.

The photographic dyes of general formula (A) are also particularly effective as dyes for preventing the occurrence of halation, and in this case they are added to a layer on the reverse side of the support or to a layer located between the support and the emulsion layers.

The photographic dyes of general formula (A) can also be used conveniently as filter dyes.

The silver halide emulsions used in this present invention may have any halogen composition, but the use of essentially silver iodide free silver chloride or silver chlorobromide where at least 90 mol % of the average halogen composition of the silver halide grains is silver chloride, is preferred from the viewpoint of rapid development processing. These high silver chloride emulsions are preferably included in at least one photosensitive layer, and the inclusion of the high silver chloride emulsions in all of the photosensitive layers is most desirable.

The term "essentially silver iodide free" as used herein signifies that the silver iodide content is not more than 1.0 mol %, and preferably not more than 0.2 mol %. In those cases where the average silver chloride content is lower than the range or the silver iodide content is above this specified level, the rate of development is retarded and rapid processing cannot be used. Hence, a high silver chloride content is also preferred. That is to say, a silver chloride content of at least 95 mol % is preferred. Furthermore, increasing the silver chloride content of the silver halide emulsion is also desirable with a view to reducing the replenishment rate of the development processing bath. In such cases, the use of substantially pure silver chloride emulsions in which the silver chloride content is from 98 mol % to 99.9 mol % is particularly desirable. However, a high photographic speed cannot be obtained in some cases when completely pure silver chloride emulsions are used, and there is a further disadvantage in that the formation of fog which is produced when pressure is applied to the photosensitive material cannot be avoided.

In the silver halide grains preferably used in the present invention, most of the remaining composition apart from the silver chloride is comprised of silver bromide. In such a case, the silver bromide may be included uniformly throughout the silver halide grains (i.e., forming grains of a uniform solid solution of so-called silver chlorobromide), or it may be included in a form in phases which have different silver bromide contents are formed. In the latter case, the grains may be so-called laminated type grains in which the halogen compositions of the core inside the grains and the one or more shell layers surrounding the core are different, or they may be grains in which a local phase which has a different silver bromide content (and preferably a high silver bromide content) is formed discontinuously on the surface and/or within the grains. A local phase which has a high silver bromide content can be formed inside the grains, or at the edges or corners of the grain surfaces, or on the surface of the grains. In one example of a preferred embodiment a local phase which has a high silver bromide content is joined epitaxially to the corners of the grains.

The average size (i.e., the average diameter of the corresponding spheres calculated on a volume basis) of the grains in the silver halide emulsions used in the present invention which is preferably not more than about 2μ but at least about 0.1μ. More preferably, the average grain size is not more than about 1.4μ but at least about 0.15μ.

A narrow grain size distribution is preferred and mono-disperse emulsions are most desirable. Mono-disperse emulsions in which the grains have a regular form are especially preferred in the present invention. Thus emulsions in which at least 85%, and most preferably at least 90%, of all the grains either in terms of the number of grains or in terms of weight are of a size within ±20% of the average grain size are preferred.

Grains of the aforementioned type which are preferably used in this invention can be prepared in general using a simultaneous mixing method.

Mono-disperse silver halide emulsions which have a regular crystalline form and a narrow grain size distribution are obtained when physical ripening is carried out in the presence of a known silver halide solvent. These solvents include, for example, ammonia, potassium thiocyanate or the thioether compounds and thione compounds disclosed, for example, in U.S. Pat. No. 3,271,157, JP-A-51-12360, JP-A-53-82408, JP-A-53-144319, JP-A-54-100717 and JP-A-54-155828.

The silver halide emulsions used in the present invention can be chemically sensitized by means of sulfur sensitization or selenium sensitization, reduction sensitization, or precious metal sensitization, either independently or in combination. That is to say, sulfur sensitization methods in which active gelatin or compounds which contain sulfur and which can react with silver ions (for example, thiosulfate, thiourea compounds, mercapto compounds and rhodanine compounds) are used, reduction sensitization methods in which reducing substances (for example, stannous salts, amines, hydrazine derivatives, formamidinesulfinic acid and silane derivatives) are used, and precious metal sensitization methods in which metal compounds (for example, gold complex salts, and complex salts of the metals of group VIII of the periodic table, such as Pt, Ir, Pd, Rh and Fe) are used, can be used either independently or in combinations. Furthermore, complex salts of metals of groups VIII of the periodic table, for example Ir, Rh, Fe, can be used separately or generally in the substrate and local phases. The use of sulfur sensitization or selenium sensitization is especially desirable with the mono-disperse silver halide emulsions which can be used in the present invention. The presence of hydroxyazaindene compounds during the sensitization is also desirable.

Spectrally sensitizing dyes are also employed in the present invention. Cyanine dyes, merocyanine dyes, and complex merocyanine dyes, for example, can be used as the spectrally sensitizing dyes which are employed in the present invention. Complex cyanine dyes, holopolar cyanine dyes, hemi-cyanine dyes, styryl dyes and hemioxonol dyes can also be used. Simple cyanine dyes, carbocyanine dyes, dicarbocyanine dyes, tricarbocyanine dyes and tetracarbocyanine dyes can be used as cyanine dyes.

Sensitizing dyes can be selected from among those represented by the general formulae (I), (II) and (III) indicated below and used for providing red to infrared sensitivity. These sensitizing dyes are distinguished by being comparatively stable in chemical terms, by being quite strongly adsorbed on the surface of silver halide grains and by being strong with respect to desorption by the dispersions of couplers, for example, which are also present.

At least two of the at least three photosensitive silver halide layers of the present invention preferably contain at least one type of sensitizing dye selected from among the compounds which can be represented by the general formulae (I), (II) and (III), and are preferably spectrally sensitized selectively to match one of the wavelength regions 660 to 690 nm, 740 to 790 nm, 800 to 850 nm and 850 to 900 nm.

In the present invention, the expression "spectrally sensitized selectively to match one of the wavelength regions 660 to 690 nm, 740 to 790 nm, 800 to 850 nm and 850 to 900 nm" signifies spectral sensitization such that, when the principal wavelength of a single light source lies within any one of the above mentioned wavelength regions, the photosensitivity of the photosensitive layers other than the principal photosensitive layer is at least 0.8 (log representation) lower than the photosensitivity (at the principal wavelength of the light source) of the principal photosensitive layer, which has been spectrally sensitized to match the principal wavelength of this light source. For this purpose, it is desirable that the principal sensitized wavelengths of photosensitive layers should be separated by at least 30 nm corresponding to the principal wavelength of the light source which is used. The sensitizing dyes which are used are dyes which provide high photographic speed at the principal wavelength and which provide a sharp spectral sensitivity distribution.

The sensitizing dyes which can be represented by the general formulae (I), (II) and (III) are described below.

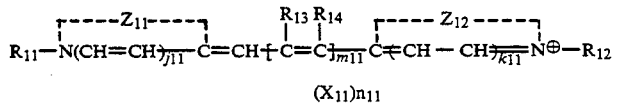

(I)

In this formula, $Z_{11}$ and $Z_{12}$ each represent a group of atoms which form a heterocyclic ring.

The heterocyclic rings are preferably five or six membered rings which optionally contain sulfur atoms, oxygen atoms, selenium atoms or tellurium atoms as well as the nitrogen atom as hetero-atoms. Moreover, these rings may be bonded to condensed rings and they may be also substituted with substituent groups.

Specific examples of the aforementioned heterocyclic nuclei include the thiazole nucleus, the benzothiazole nucleus, the naphthothiazole nucleus, the selenazole nucleus, the benzoselenazole nucleus, the naphthoselenazole nucleus, the oxazole nucleus, the benzoxazole nucleus, the naphthoxazole nucleus, the imidazole nucleus, the benzimidazole nucleus, the naphthoimidazole nucleus, the 4-quinoline nucleus, the pyrroline nucleus, the pyridine nucleus, the tetrazole nucleus, the indolenine nucleus, the benzindolenine nucleus, the indole nucleus, the tellurazole nucleus, the benzotellurazole nucleus and the naphthotellurazole nucleus.

$R_{11}$ and $R_{12}$ each represent an alkyl group, an alkenyl group, an alkynyl group or an aralkyl group. These groups and the groups described hereinafter also include groups which have substituent groups. For example, "alkyl groups" include both unsubstituted and substituted alkyl groups, and these groups may be linear chain, branched or cyclic groups. An alkyl group preferably has from 1 to 8 carbon atoms.

Furthermore, specific examples of substituent groups for substituted alkyl groups include halogen atoms (for example, chlorine, bromine, fluorine), cyano groups, alkoxy groups, substituted and unsubstituted amino groups, carboxylic acid groups, sulfonic acid groups and hydroxyl groups, and the alkyl groups may be substituted with one, or with a plurality, of these groups.

The vinylmethyl group is a specific example of an alkenyl group.

Benzyl and phenethyl is a specific examples of aralkyl groups.

Moreover, $m_{11}$ represents an integer of value 2 or 3.

$R_{13}$ represents a hydrogen atom, and $R_{14}$ represents a hydrogen atom, a lower alkyl group or an aralkyl group, or it may be joined with $R_{12}$ to form a five or six membered ring. Furthermore, in those cases where $R_{14}$ represents a hydrogen atom, $R_{13}$ may be joined with another $R_{13}$ group to form a hydrocarbyl or heterocyclic ring. These rings are preferably five or six membered rings. Moreover, $j_{11}$ and $k_{11}$ represent 0 or 1, $X_{11}$ represents an acid anion, and $n_{11}$ represents 0 or 1.

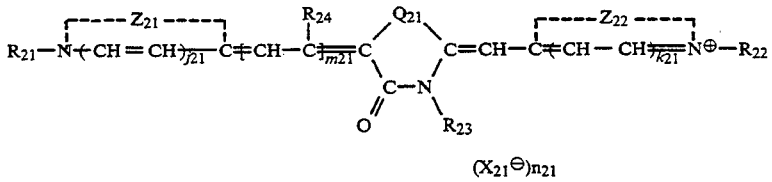

(II)

In this formula, $Z_{21}$ and $Z_{22}$ represent the same groups as $Z_{11}$ and $Z_{12}$ described above. $R_{21}$ and $R_{22}$ represent the same groups as $R_{11}$ and $R_{12}$, and $R_{23}$ represents an alkyl group, an alkenyl group, an alkynyl group or an aryl group (for example, substituted or unsubstituted phenyl group). Moreover, $m_{21}$ represents 2 or 3. $R_{24}$ represents a hydrogen atom, a lower alkyl group or an aryl group, and when $m_{21}$ is 2 then $R_{24}$ may be joined with another $R_{24}$ group to form a hydrocarbyl ring or a heterocyclic ring. These rings are preferably five or six membered rings.

$Q_{21}$ represents a sulfur atom, an oxygen atom, a selenium atom or $>N—R_{25}$, and $R_{25}$ represents the same groups as $R_{23}$. Moreover, $j_{21}$, $k_{21}$, $X_{21}^{\ominus}$ and $n_{21}$ represents the same significance as $j_{11}$, $k_{11}$, $X_{11}^{\ominus}$ and $n_{11}$.

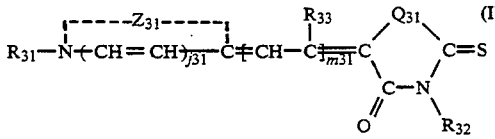

(III)

In this formula, $Z_{31}$ represents a group of atoms which is required to form a heterocyclic ring. Specific examples of this ring include, in addition to those described in connection with $Z_{11}$ and $Z_{12}$, thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline and naphthoimidazoline nuclei.

$Q_{31}$ represents the same groups as $Q_{21}$. $R_{31}$ represents the same groups as $R_{11}$ or $R_{12}$, and $R_{32}$ represents the same groups as $R_{23}$. Moreover, $m_{31}$ represents 2 or 3. $R_{33}$ represents the same groups as $R_{24}$, or it may be joined with another $R_{33}$ group to form a hydrocarbyl ring or a heterocyclic ring. Moreover, $j_{31}$ represents the same as $j_{11}$.

Sensitizing dyes in which the heterocyclic nucleus formed by $Z_{11}$ and/or $Z_{12}$ in general formula (I) is a naphthothiazole nucleus, a naphthoselenazole nucleus, a naphthoxazole nucleus, a naphthimidazole nucleus, or a 4-quinoline nucleus are preferred.

The same is true of $Z_{21}$ and/or $Z_{22}$ in general formula (II), and also of formula (III). Furthermore, the sensitizing dyes in which the methine chain forms a hydrocarbyl ring or a heterocyclic ring are preferred.

Sensitization with the M-band of the sensitizing dye is used for infrared sensitization and so the spectral sensitivity distribution is generally broader than with sensitization with the J-band. Consequently, a colored layer comprising a dye which is included in a colloid layer is established on the photosensitive surface side of the prescribed photosensitive layer to correct the spectral sensitivity distribution.

Compounds which have a reduction potential of −1.00 (V vs SCE) or below are preferred for the sensitizing dyes for red to infrared sensitization purposes and, of these compounds, those which have a reduction potential of −1.10 or below are preferred. Sensitizing dyes which have these characteristics are effective for providing high sensitivity and especially for stabilizing photographic speed and for stabilizing the latent image.

The measurement of reduction potentials can be carried out using phase discrimination type second harmonic alternating current polarography. This can be carried out using a dropping mercury electrode for the active electrode, a saturated calomel electrode for the reference electrode and platinum for the counter electrode.

Furthermore, the measurement of reduction potentials with phase discrimination type second harmonic alternating current polarography using platinum for the active electrode has been described in *Journal of Imaging Science*, Vol. 30, pages 27 to 45 (1986).

Specific examples of sensitizing dyes of general formulae (I), (II) and (III) are indicated below.

(I-1)

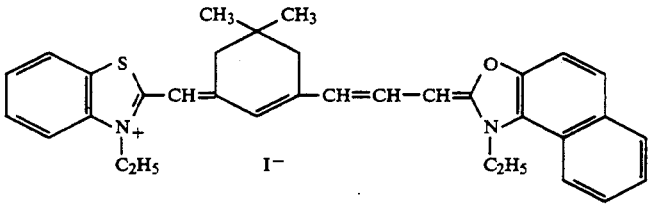

(I-2)

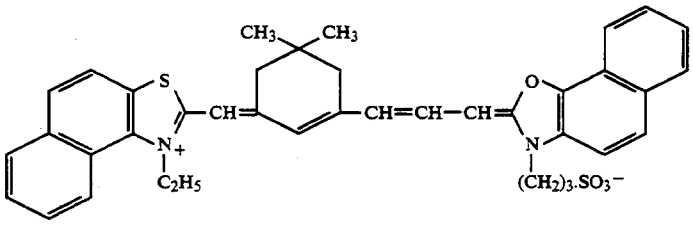

(I-3)

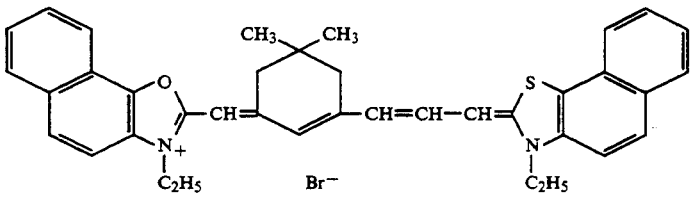

(I-4)

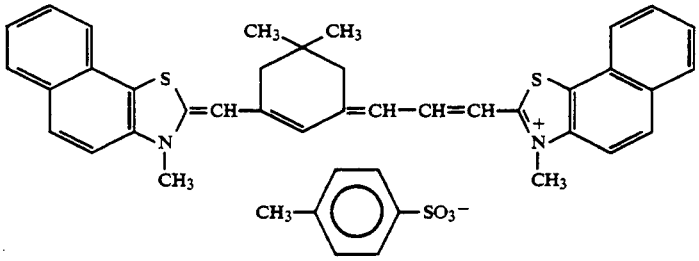

-continued
(I-5)
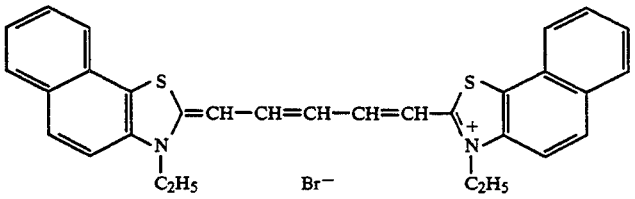
(I-6)
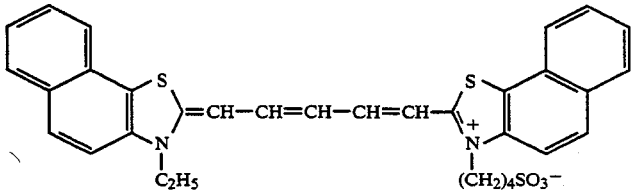
(I-7)
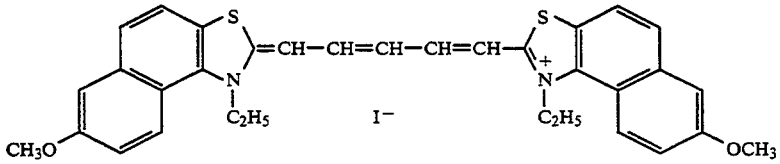
(I-8)
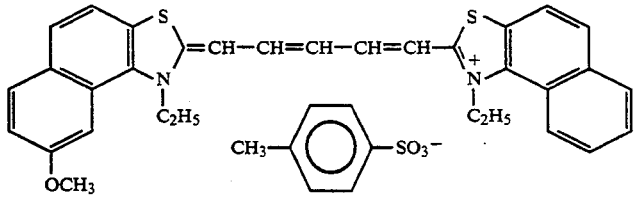
(I-9)
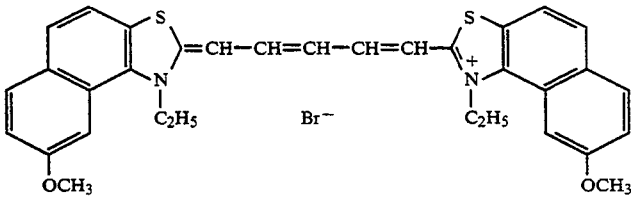
(I-10)
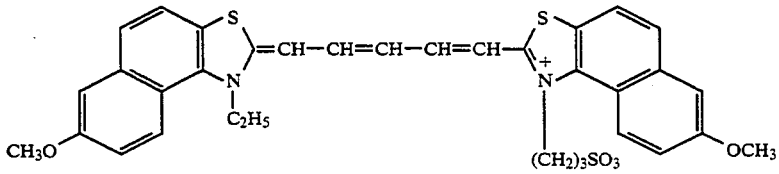
(I-11)
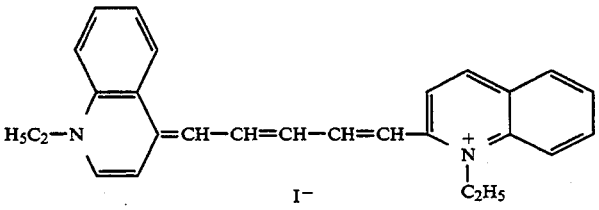

-continued
(I-12)
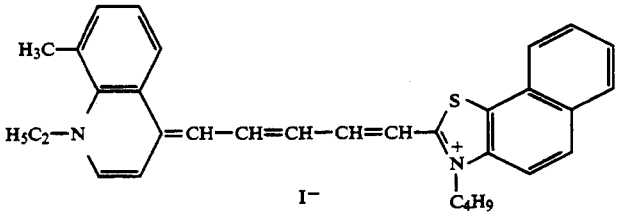
(I-13)
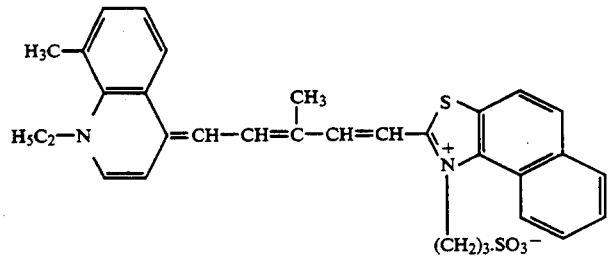
(I-14)
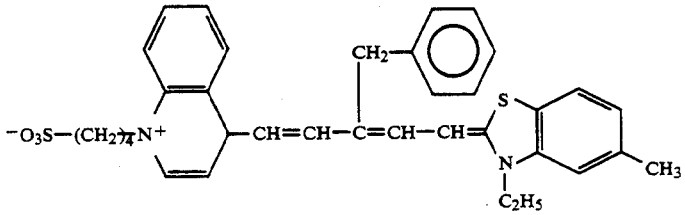
(I-15)
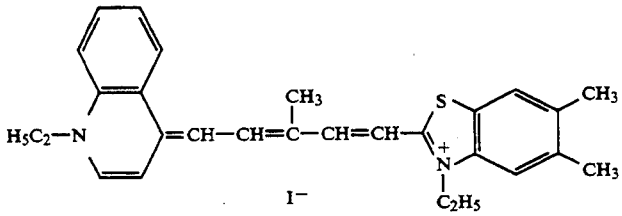
(I-16)
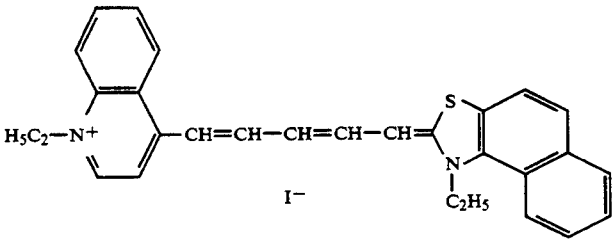
(I-17)
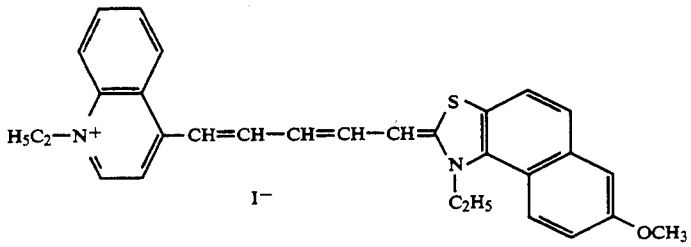

-continued
(I-18)
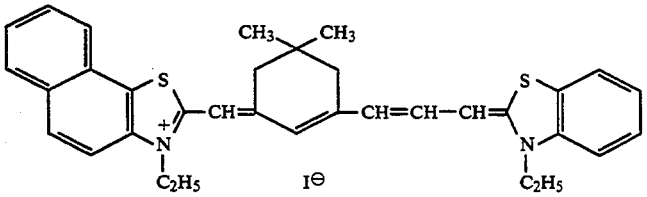
(I-19)
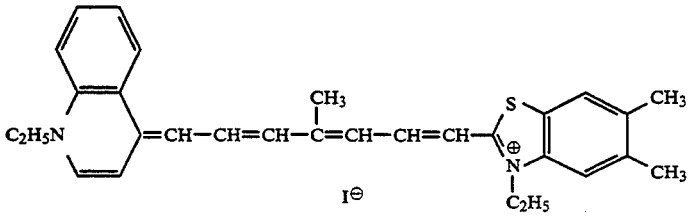
(II-1)
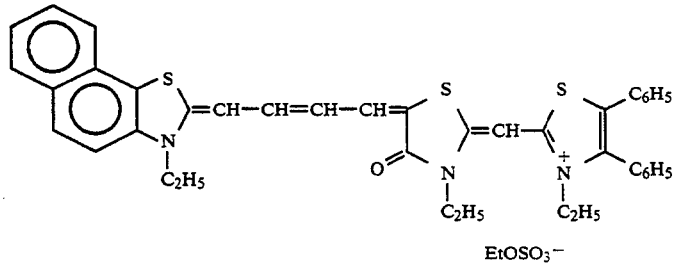
(II-2)
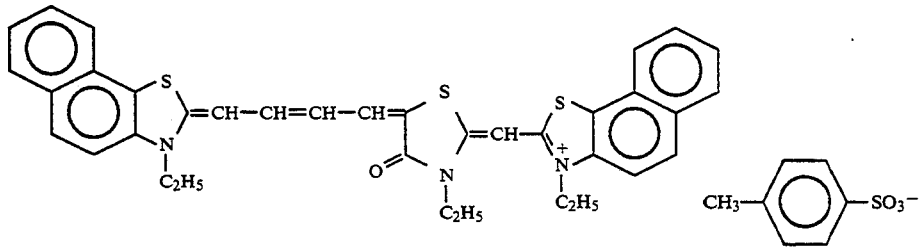
(II-3)
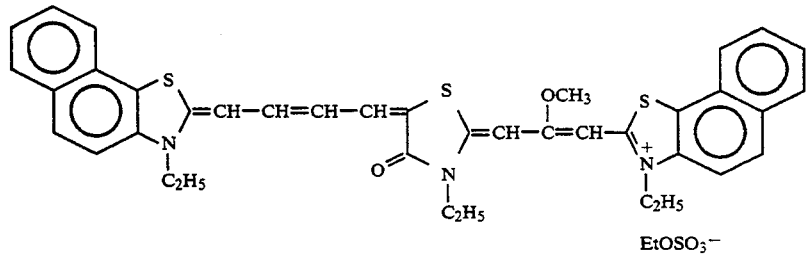
(II-4)
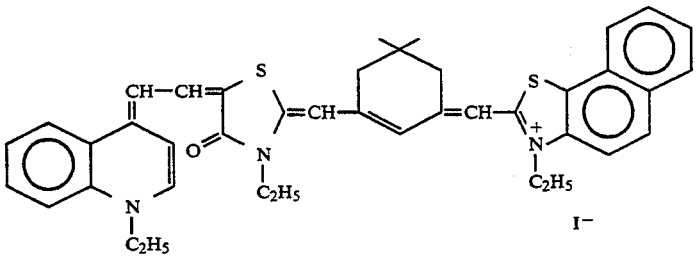

-continued (II-5)

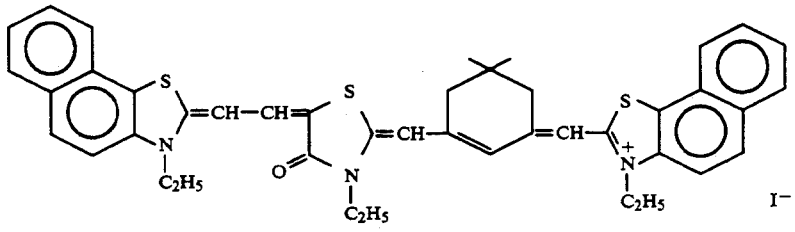

(II-6)

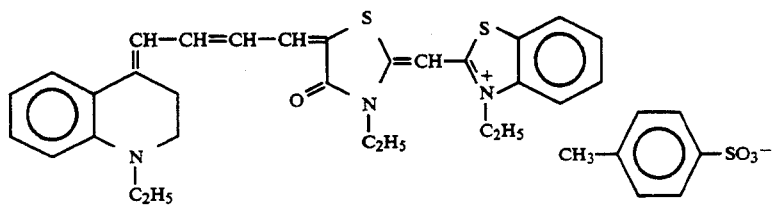

(III-1)

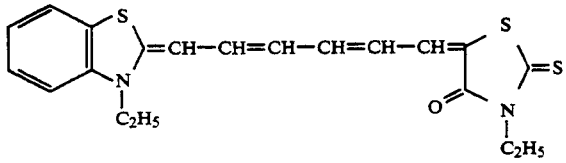

(III-2)

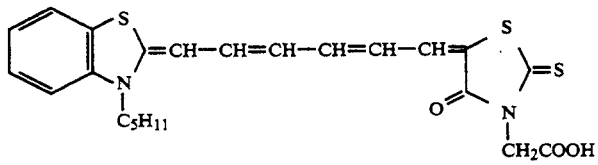

(III-3)

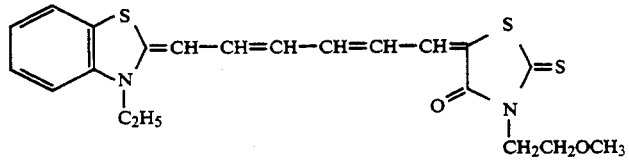

(III-4)

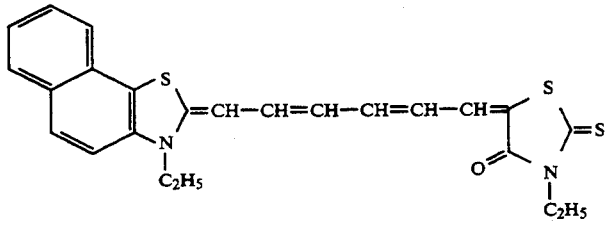

The sensitizing dyes used in this present invention are included in the silver halide photographic emulsion in an amount of from about $5\times10^{-7}$ to $5\times10^{-3}$ mol, preferably in an amount of from about $1\times10^{-6}$ to $1\times10^{-3}$ mol, and most desirably in an amount of from about $2\times10^{-6}$ to $5\times10^{-4}$ mol, per mol of silver halide.

The sensitizing dyes used in the present invention can be dispersed directly in the emulsion. Furthermore, they can be dissolved in a suitable solvent, such as methyl alcohol, ethyl alcohol, methyl-cellosolve, acetone, water, pyridine, or mixtures thereof and added to the emulsion in the form of a solution. . Furthermore, ultrasonics can be used for dissolution purposes. In addition, the infrared sensitizing dyes can be added using a method in which the dye is dissolved in a volatile organic solvent, the solution is then dispersed in a hydrophilic colloid and the dispersion so obtained is then added to the emulsion, as disclosed, for example, in U.S. Pat. No. 3,469,987. In another method, a water insoluble dye is dispersed in a water soluble solvent in which it is insoluble and the dispersion is added to the emulsion, as disclosed, for example, in JP-B-46-24185. Other methods include dissolving the dye in a surfactant and the solution so obtained is added to the emulsion, as disclosed in U.S. Pat. No. 3,822,135; providing solution containing a compound which causes a red shift and then adding the solution to the emulsion, as disclosed in JP-A-51-74624; or dissolving the dye in an essentially water free acid and adding the solution to the emulsion, as disclosed in JP-A-50-80826. The methods disclosed, for example, in U.S. Pat. Nos. 2,912,343, 3,342,605, 2,996,287 and 3,429,835 can also be used for making the addition to an emulsion. Furthermore, the above mentioned infrared sensitizing dyes can be uniformly dispersed in the silver halide emulsion prior to coating on a suitable support. The addition can be made prior to chemical sensitization or during the latter half of silver halide grain formation.

Super-sensitization with compounds which can be represented by the general formulae (IV), (V), (VI), (VII), (VIIIa), (VIIIb) and (VIIIc) which are indicated below is especially useful with the red-infrared M-band type sensitization in the present invention.

The super-sensitizing effect can be amplified by using super-sensitizing agents represented by general formula (IV) conjointly with super-sensitizing agents represented by the general formulae (V), (VIIIa), (VIIIb) and (VIIIc).

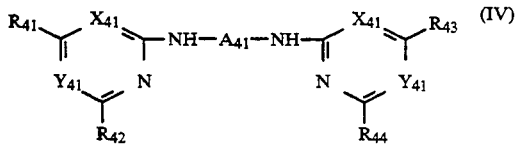

In this formula, $A_{41}$ represents a divalent aromatic residual group. $R_{41}$, $R_{42}$, $R_{43}$ and $R_{44}$ each represent a hydrogen atom, a hydroxyl group, an alkyl group, an alkoxy group, an aryloxy group, a halogen atom, a heterocyclic nucleus, a heterocyclylthio group, an arylthio group, an amino group, an alkylamino group, an arylamino group, an aralkylamino group, an aryl group or a mercapto group, and these groups may be substituted.

However, at least one of the groups represented by $A_{41}$, $R_{41}$, $R_{42}$, $R_{43}$ and $R_{44}$ has a sulfo group. $X_{41}$ and $Y_{41}$ each represent —CH= or —N=, but at least one of $X_{41}$ and $Y_{41}$ represents —N=.

More precisely, in general formula (IV), $—A_{41}—$ represents a divalent aromatic residual group, and these groups may contain $—SO_3M$ groups where M represents a hydrogen atom or a cation (for example, sodium, potassium) which provides water solubility.

The $—A_{41}—$ groups are usefully selected from among those indicated, for example, under $—A_{42}—$ and $—A_{43}—$ below. However, $—A_{41}—$ is selected from among the $—A_{42}—$ groups when there is no $—SO_3M$ group in $R_{41}$, $R_{42}$, $R_{43}$ or $R_{44}$.

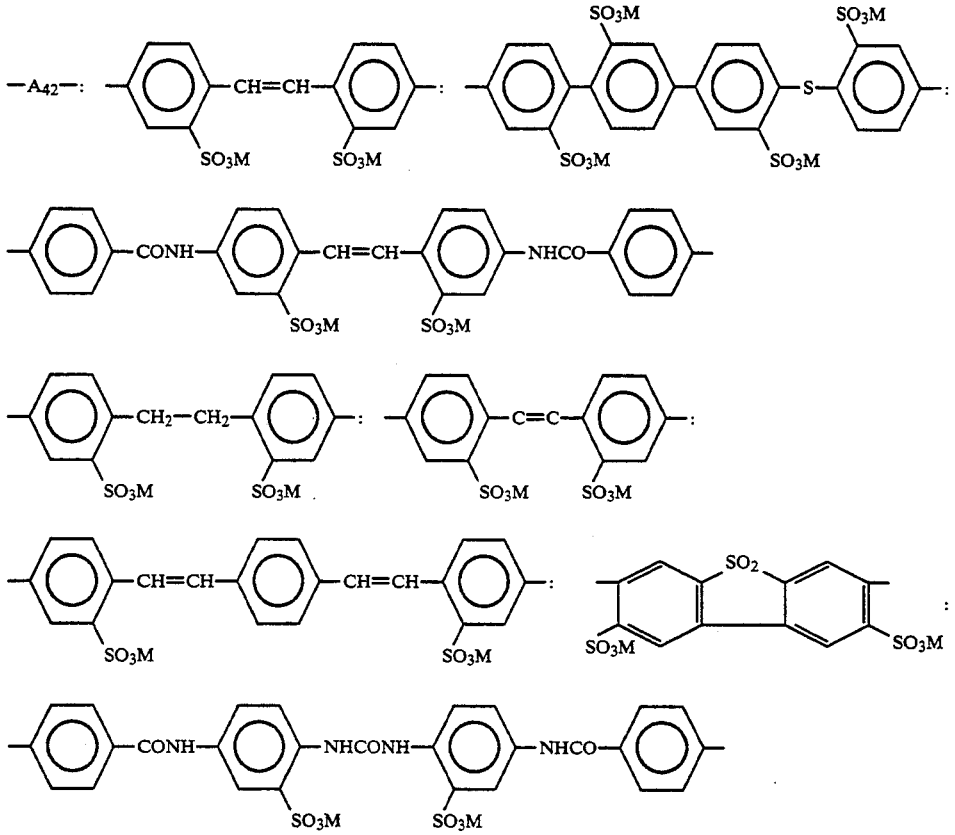

M is these formulae represents a hydrogen atom or a cation which provides water solubility.

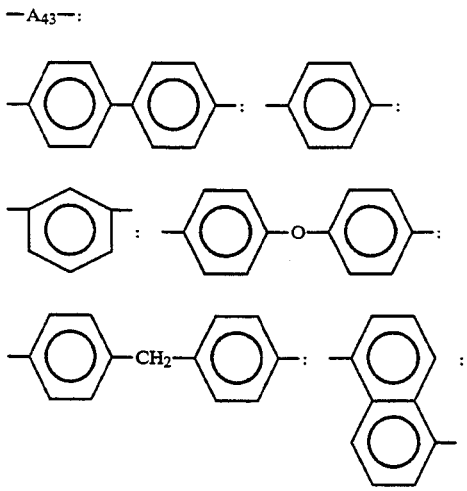

-continued

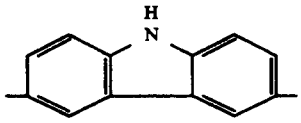

etc.

$R_{41}$, $R_{42}$, $R_{43}$ and $R_{44}$ each represent a hydrogen atom, a hydroxyl group, an alkyl group (which preferably has from 1 to 8 carbon atoms, for example, methyl, ethyl, n-propyl, n-butyl), an alkoxy group (which preferably has from 1 to 8 carbon atoms, for example, methoxy, ethoxy, propoxy, butoxy), an aryloxy group (for example, phenoxy, naphthoxy, o-tolyloxy, p-sulfophenoxy), a halogen atom (for example, chlorine, bromine), a heterocyclic nucleus (for example, morpholinyl, piperidyl), an alkylthio group (for example, methylthio, ethylthio), a heterocyclylthio group (for example, benzothiazolylthio, benzimidazolylthio, phenyltetrazolylthio), an arylthio group (for example, phenylthio, tolylthio), an amino group, an alkylamino group or substituted alkylamino group (for example, methylamino, ethylamino, propylamino, dimethylamino, diethylamino, dodecylamino, cyclohexylamino, β-hydroxyethylamino, di-(β-hydroxyethyl)amino, β-sulfoethylamino), an arylamino group or a substituted arylamino group (for example, anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclylamino group (for example, 2-benzothiazolylamino, 2-pyridylamino), a substituted or unsubstituted aralkylamino group (for example, benzylamino, o-anisylamino, m-anisylamino, p-anisylamino), an aryl group (for example, phenyl), or a mercapto group.

$R_{41}$, $R_{42}$, $R_{43}$ and $R_{44}$ may be the same or different. In those cases where —$A_{41}$— is selected from among the —$A_{43}$— groups, at least one of the groups $R_{41}$, $R_{42}$, $R_{43}$ and $R_{44}$ must have one or more sulfo groups which may be free sulfo groups or in the form of a salt. $X_{41}$ and $Y_{41}$ represent —CH= or —N=, and $X_{41}$ is preferably —CH= and $Y_{41}$ is preferably —N=.

Specific examples of compounds included in general formula (IV) which can be used in the invention are illustrated below, but the invention is not to be limited to these particular compounds.

(IV-1) 4,4'-Bis[2,6-di(2-naphthoxy)pyrimidin-4-ylamino]stilbene-2,2'-disulfonic acid, di-sodium salt (IV-2) 4,4'-Bis[2,6-di(2-naphthylamino)pyrimidin-4-ylamino]stilbene-2,2'-disulfonic acid, di-sodium salt (IV-3) 4,4'-Bis(2,6-anilinopyrimidin-4-ylamino) stilbene-2,2'-disulfonic acid, di-sodium salt (IV-4) 4,4'-Bis[2-(2-naphthylamino)-6-anilinopyrimidin-4-yl-amino]stilbene-2,2'-disulfonic acid, di-sodium salt (IV-5) 4,4'-Bis(2,6-diphenoxypyrimidin-4-ylamino) stilbene-2,2'-disulfonic acid, triethylammonium salt (IV-6) 4,4'-Bis[2,6-di(benzimidazolyl-2-thio) pyrimidin-4-ylamino]stilbene-2,2'-disulfonic acid, di-sodium salt (IV-7) 4,4'-Bis[4,6-di(benzothiazolyl-2-thio) pyrimidin-2-ylamino]stilbene-2,2'-disulfonic acid, di-sodium salt (IV-8) 4,4'-Bis[4,6-di(benzothiazolyl-2-amino) pyrimidin-2-ylamino]stilbene-2,2'-disulfonic acid, di-sodium salt (IV-9) 4,4'-Bis[4,6-di(naphthyl-2-oxy)pyrimidin-2-ylamino]stilbene-2,2'-disulfonic acid, di-sodium salt (IV-10) 4,4'-Bis(4,6-diphenoxypyrimidin-2-ylamino) stilbene-2,2'-sulfonic acid, di-sodium salt (IV-11) 4,4'-Bis(4,6-diphenylthiopyrimidin-2-ylamino) stilbene-2,2'-disulfonic acid, di-sodium salt (IV-12) 4,4'-Bis(4,6-dimercaptopyrimidin-2-ylamino)-biphenyl-2,2'-disulfonic acid, di-sodium salt (IV-13) 4,4'-Bis(4,6-dianilinotriazin-2-ylamino) stilbene-2,2'-disulfonic acid, di-sodium salt (IV-14) 4,4'-Bis(4-anilino-6-hydroxytriazin-2-ylamino) stilbene-2,2'-disulfonic acid, di-sodium salt (IV-15) 4,4'-Bis[4,6-di(naphthyl-2-oxy)pyrimidin-2-ylamino]bibenzyl-2,2'-disulfonic acid, di-sodium salt (IV-16) 4,4'-Bis(4,6-dianilinopyrimidin-2-ylamino) stilbene-2,2'-disulfonic acid, di-sodium salt (IV-17) 4,4'-Bis[4-chloro-6-(2-naphthyloxy)pyrimidin-2-ylamino)biphenyl-2,2'-disulfonic acid, di-sodium salt (IV-18) 4,4'-Bis[4,6-di(1-phenyltetrazolyl-5-thio) pyrimidin-2-ylamino]stilbene-2,2'-disulfonic acid, di-sodium salt (IV-19) 4,4'-Bis[4,6-di(benzimidazolyl-2-thio) pyrimidin-2-ylamino]stilbene-2,2'-disulfonic acid, di-sodium salt (IV-20) 4,4'-Bis(4-naphthylamino-6-anilinotriazin-2-ylamino)stilbene-2,2'-disulfonic acid, di-sodium salt From among these examples, (IV-1) to (IV-6) are preferred, and (IV-1), (IV-2), (IV-4), (IV-5), (IV-9), (IV-15) and (IV-20) are particularly preferred.

The compounds represented by general formula (IV) are useful when used in amounts of from 0.01 to 5 grams per mol of silver halide, and when used in an amount within the range from 1/1 to 1/100, and preferably within the range from ½ to 1/50, by weight, with respect to the sensitizing dye. The combined use of compounds which can be represented by the general formula (V) with these compounds is also desirable.

Compounds which can be represented by general formula (V) are described in detail below.

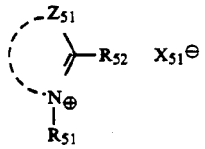

(V)

In this formula, $Z_{51}$ represents a group of non-metal atoms which completes a five or six membered nitrogen containing heterocyclic ring. This ring may be condensed with, e.g., a benzene ring or a naphthalene ring. Examples of such a ring include thiazoliums (for example, thiazolium, 4-methylthiazolium, benzothiazolium, 5-methylbenzohiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), oxazoliums (for example, oxazolium, 4-methyloxazolium, benzoxazolium, 5-chlorobenzoxazolium, 5-phenylbenzoxazolium, 5-methylbenzoxazolium, naphtho[1,2-d]oxazolium), imidazoliums (for example, 1-methylbenzimidazolium, 1-propyl-5-chlorobenzimidazolium, 1-ethyl-5,6-dichlorobenzimidazolium, 1-allyl-5-trifluoromethyl-6-chlorobenzimidazolium), and selenazoliums (for example, benzoselenazolium, 5-chlorobenzoselenazolium, 5-methylbenzoselenazolium, 5-methoxybenzoselenazolium, naphtho[1,2-d]selenazolium). $R_{51}$ represents a hydrogen atom, an alkyl group (which preferably has not more than 8 carbon atoms, for example, methyl, ethyl, propyl, butyl, pentyl) or an alkenyl group (for example, allyl). $R_{52}$ represents a hydrogen atom or a lower alkyl group (for example, methyl, ethyl). $R_{51}$ and $R_{52}$ may be substituted alkyl groups. $X^{\ominus}_{51}$ represents an acid anion (for example, $Cl^-$, $Br^-$, $I^-$, $ClO_4^-$). From among these $Z_{51}$, a thiazolium is preferred, and substituted or unsubstituted benzothiazolium or naphthothiazolium are especially desirable. Moreover, even where it is not explicitly stated, these groups may have substituent groups.

Specific examples of compounds which can be represented by general formula (V) are indicated below, but the invention is not to be limited to these compounds.

(V-1)

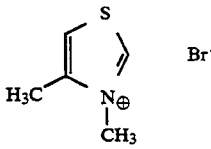

(V-2)

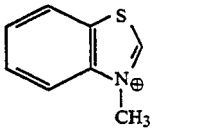

(V-3)

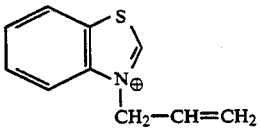

(V-4)

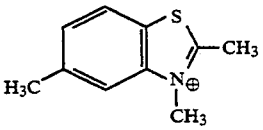

(V-5)

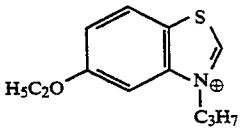

(V-6)

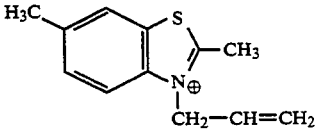

(V-7)

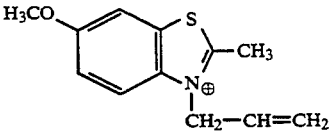

(V-8)

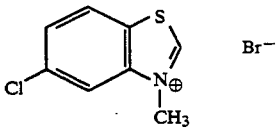

-continued (V-9)

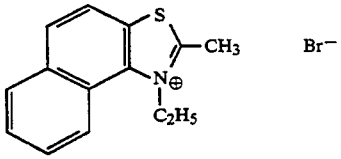

(V-10)

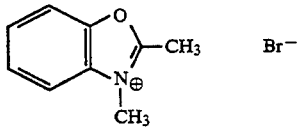

(V-11)

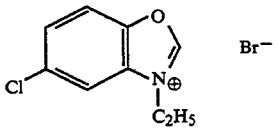

(V-12)

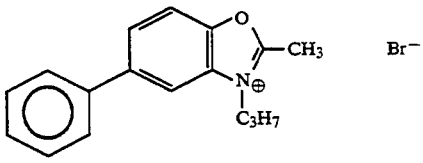

(V-13)

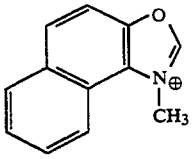

(V-14)

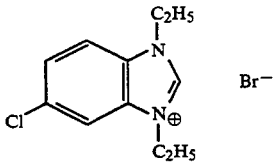

(V-15)

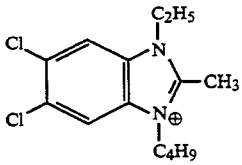

(V-16)

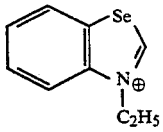

(V-17)

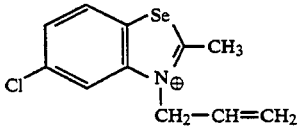

-continued (V-18)

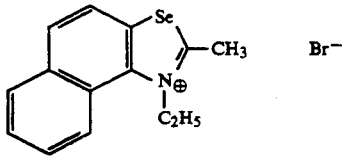

The compounds represented by general formula (V) which are used in the present invention are preferably employed in an amouont of from 0.01 gram to 5 grams per mol of silver halide in the emulsion.

The infrared sensitizing dye represented by the general formulae (I) to (III)/compound represented by general formula (V) ratio (by weight) is within the range from 1/1 to 1/300, and preferably within the range from ½ to 1/50.

The compounds represented by general formula (V) which can be used in the invention can be dispersed directly in the emulsion, or they can be dissolved in an appropriate solvent (for example water, methyl alcohol, ethyl alcohol, propanol, methylcellosolve or acetone), or in a mixture of these solvents, and added to the emulsion. Furthermore, they can be added to the emulsion in the form of a solution or dispersion in a colloid in accordance with the methods used for the addition of the other sensitizing dyes.

The compounds represented by general formula (V) may be added to the emulsion before the addition of the sensitizing dyes represented by general formulae (I) to (III), or they may be added after the sensitizing dyes have been added. Furthermore, the compounds of general formula (V) and the sensitizing dyes represented by general formulae (I) to (III) may be dissolved separately and the separate solutions can be added to the emulsion separately at the same time, or they may be added to the emulsion after mixing.

A marked improvement in latent image stability and in the processing dependence of the linearity of gradation, as well as high speed and fog suppression, are realized when heterocyclic mercapto compounds are used together with the super-sensitizing agents represented by the general formula (IV) or (V) in the infrared sensitized high silver chloride emulsions of this invention.

For example, heterocyclic compounds which contain a thiazole ring, an oxazole ring, an oxazine ring, a thiazole ring, a thiazoline ring, a selenazole ring, an imidazole ring, an indoline ring, a pyrrolidine ring, a tetrazole ring, a thiadiazole ring, a quinoline ring or an oxadiazole ring, and which are substituted with a mercapto group, can be used for this purpose. Compounds which also contain carboxyl groups, sulfo groups, carbamoyl group, sulfamoyl groups and hydroxyl groups are especially desirable. The use of mercaptoheterocyclic compounds with super-sensitizing agents has been disclosed in JP-B-43-22883. Remarkable anti-fogging effects and super-sensitizing effects can be realized in this invention by using these in combination with compounds which can be represented by general formula (V). Those mercapto compounds which can be represented by general formulae (VI) and (VII) described below are especially desirable.

(VI)

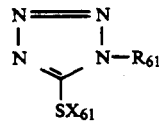

In this formula, $R_{61}$ represents an alkyl group, an alkenyl group or an aryl group $X_{61}$ represents a hydrogen atom, an alkali metal atom, an ammonium group, or a precursor. The alkali metal atom is, for example, sodium or potassium, and the ammonium group is, for example, a tetramethylammonium group or a trimethylbenzyl-ammonium group. Furthermore, a precursor is a group such that $X_{61}$ becomes H or an alkali metal under alkaline conditions, for example, an acetyl group, a cyanoethyl group or a methanesulfonylethyl.

The alkyl groups and alkenyl groups represented by $R_{61}$ as described above include unsubstituted and substituted groups, and they also include alicyclic groups. The substituent groups of the substituted alkyl groups may be, for example, halogen atoms, nitro groups, cyano groups, hydroxyl groups, alkoxy groups, aryl groups, acylamino groups, alkoxycarbonylamino groups, ureido groups, amino groups, heterocyclic groups, acyl groups, sulfamoyl groups, sulfonamido groups, thioureido groups, carbamoyl groups, alkylthio groups, arylthio groups, heterocyclylthio groups, or carboxylic acid and sulfonic acid groups and salts thereof. The above mentioned ureido groups, thioureido groups, sulfamoyl groups, carbamoyl groups and amino groups include unsubstituted groups, N-alkyl substituted groups, and N-aryl substituted groups. The phenyl group and substituted phenyl groups are examples of aryl groups, and these groups may be substituted with alkyl groups and the substituent groups for alkyl groups described above.

(VII)

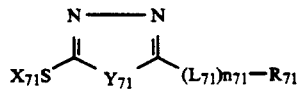

In this formula, $Y_{71}$ represents an oxygen atom, a sulfur atom, =NH or $=N-(L_{71})_{n72}-R_{72}$, $L_{71}$ represents a divalent linking group, and $R_{71}$ represents a hydrogen atom, an alkyl group, an alkenyl group or an aryl group. The alkyl groups and alkenyl groups of $R_{71}$ or $R_{72}$, and $X_{71}$, have the same significance as those of general formula (VI).

Specific examples of the divalent linking groups represented by $L_{71}$ above include

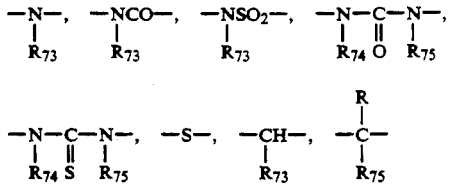

and combinations thereof.

Moreover, $n_{71}$ and $n_{72}$ represent 0 or 1, and $R_{73}$, $R_{74}$ and $R_{75}$ each represent a hydrogen atom, an alkyl group or an aralkyl group.

These compounds may be included in any layer, which is to say any photosensitive and/or non-photosensitive hydrophilic colloid layer, in the silver halide color photographic material.

The amount of the compounds represented by general formula (VI) or (VII) added is from $1\times10^{-5}$ to $5\times10^{-2}$ mol, and preferably from $1\times10^{-4}$ to $1\times10^{-2}$ mol, per mol of silver halide when they are included in the silver halide color photographic photosensitive material. Furthermore, they can be added to color development baths as anti-foggants at concentrations of from $1\times10^{-6}$ to $1\times10^{-3}$ mol/liter, and preferably at concentrations of from $5\times10^{-6}$ to $5\times10^{-4}$ mol/liter.

Specific examples of compounds which can be represented by the general formulae (VI) and (VII) are indicated below, but the invention is not to be limited by these examples. For example, the compounds disclosed on pages 4 to 8 of the specification of JP-A-62-269957 can also be employed.

(VI-1)

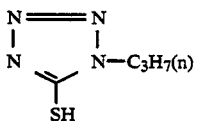

(VI-2)

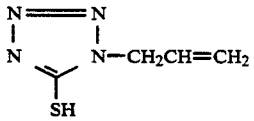

(VI-3)

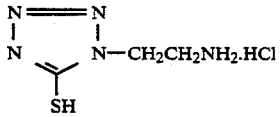

(VI-4)

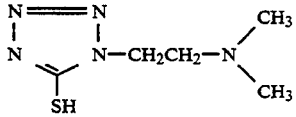

(VI-5)

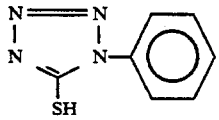

(VI-6)

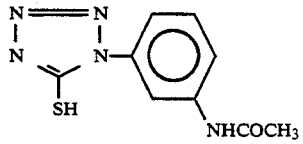

(VI-7)

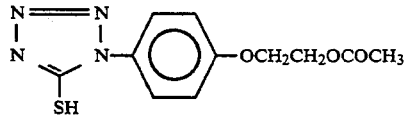

(VI-8)

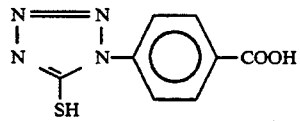

-continued (VI-9)

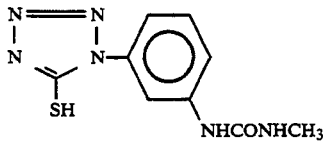

(VI-10)

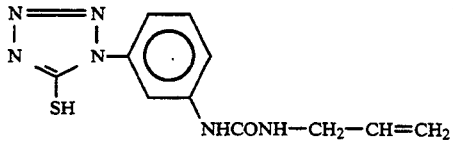

(VII-1)

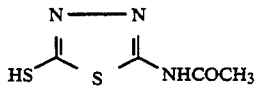

(VII-2)

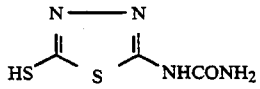

(VII-3)

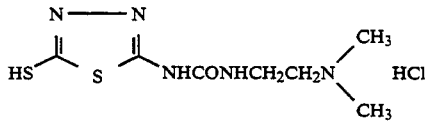

(VII-4)

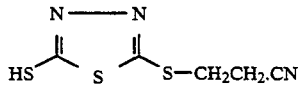

(VII-5)

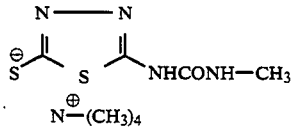

(VII-6)

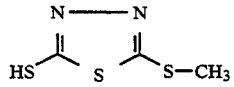

(VII-7)

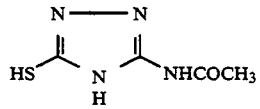

(VII-8)

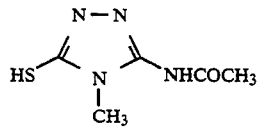

(VII-9)

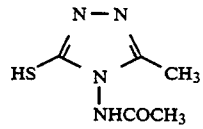

(VII-10)

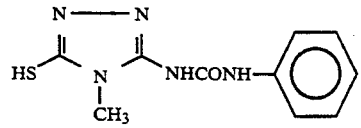

-continued

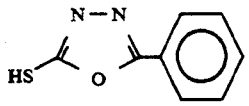

(VII-11)

Moreover, substituted or unsubstituted polyhydroxybenzenes represented by the general formulae (VIIIa), (VIIIb) and (VIIIc) below, and condensates of these with formaldehyde with from two to ten condensed units, can be used as supersensitizing agents with the red sensitization and infrared sensitization used in this present invention, and also exert effects preventing degradation of latent images with time and preventing lowering of gradation.

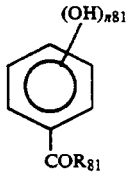

(VIIIa)

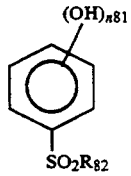

(VIIIb)

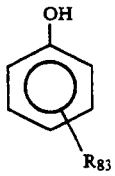

(VIIIc)

In these formulae, $R_{81}$ and $R_{82}$ each represent —OH, —$OM_{81}$, —$OR_{84}$, —$NH_2$, —$NHR_{84}$, —$NH(R_{84})_2$, —$NHNH_2$ or —$NHNHR_{84}$, where $R_{84}$ represents an alkyl group which preferably has from 1 to 8 carbon atoms, an aryl group or an aralkyl group, $M_{81}$ represents an alkali metal or an alkaline earth metal, $R_{83}$ represents —OH or a halogen atom, and $n_{81}$ and $n_{82}$ each represent 1, 2 or 3.

Specific examples of substituted and unsubstituted polyhydroxybenzenes which can form components for aldehyde condensates which can be used in the invention are illustrated below, but they are not limited to these specific examples.

β-resorcylic acid (VIII-1)

γ-resorcylic acid (VIII-2)

4-Hydroxybenzoic acid hydrazide (VIII-3)

3,5-Hydroxybenzoic acid hydrazide (VIII-4)

p-Chlorophenol (VIII-5)

Sodium hydroxybenzenesulfonate (VIII-6)

p-Hydroxybenzoic acid (VIII-7)

o-Hydroxybenzoic acid (VIII-8)

m-Hydroxybenzoic acid (VIII-9)

-continued p-Dioxybenzene (VIII-10)

Gallic acid (VIII-11)

Methyl p-hydroxybenzoate (VIII-12)

o-Hydroxybenzenesulfonic acid amide (VIII-13)

N-Ethyl-o-hydroxybenzoic acid amide (VIII-14)

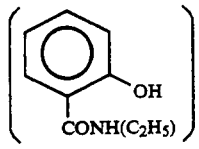

N-Diethyl-o-hydroxybenzoic acid amide (VIII-15)

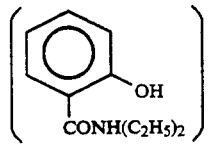

o-Hydroxybenzoic acid 2-methylhydrazide (VIII-16)

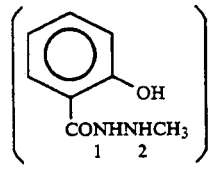

Moreover, in practical terms, they can be selected from among the derivatives of the compounds represented by general formulae (IIa), (IIb) and (IIc) disclosed in JP-B-49-49504.

The materials and additives which are used in the silver halide color photographic photosensitive materials of the present invention are described in more detail below.

The silver chlorobromide emulsions used in the present invention can be prepared using the methods disclosed, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikman et al. in *Making and Coating Photographic Emulsions*, published by Focal Press, 1964. That is to say, they can be prepared using acidic methods, neutral methods and ammonia methods for example, and a single sided mixing procedure, a simultaneous mixing procedure, or a combination of such procedures, can be used for reacting the soluble silver salt with the soluble halide. Methods in which the grains are formed in the presence of an excess of silver ions (so-called reverse mixing methods) can also be used. The method in which the pAg value in the liquid phase in which the silver halide is being formed is held constant, which is to say the so-called controlled double jet method, can be used as one type of simultaneous mixing procedure. It is possible to obtain silver halide emulsions with a regular crystalline from and an almost uniform grain size when this method is used.

Various multi-valent metal ion impurities can be introduced into the silver halide emulsions which are used in the present invention during the formation or physical ripening of the emulsion grains. For example, salts of cadmium, zinc, lead, copper or thallium, or salts or complex salts of iron, ruthenium, rhodium, palladium, osmium, iridium and platinum, for example, which are group VIII elements, can be used as compounds of this type. The use of the above mentioned group VIII elements is especially desirable. The amount of these compounds added carried over a wide range, depending on the intended purpose, but an amount of from $10^{-9}$ to $10^{-2}$ mol per mol of silver halide is preferred.

The silver halide emulsions used in the present invention are normally subjected to chemical sensitization and spectral sensitization.

Sulfur sensitization which is typified by the addition of unstable sulfur compounds, precious metal sensitization typified by gold sensitization, and reduction sensitization, for example, can be used individually or in combination as chemical sensitization methods. The use of the compounds disclosed from the lower right hand column on page 18 to the upper right and column on page 22 of the specification of JP-A-62-215272 for the compounds which are used for chemical sensitization is preferred.

Spectral sensitization is carried out with a view to rendering each emulsion layer in a photosensitive material of the present invention sensitive to light of the prescribed wavelength region. In the present invention, this is preferably achieved using dyes, spectrally sensitizing dyes, which absorb light in the wavelength regions corresponding to the target spectral sensitivity. Examples of spectrally sensitizing dyes which can be used at this time have been disclosed, for example, by F. M. Harmer in *Heterocyclic Compounds, Cyanine Dyes and Related Compounds*, (John Wiley & Sons (New York, London), 1964). Examples of preferred compounds which can be used have been disclosed from the upper right hand column on page 22 to page 38 of the specification of the aforementioned JP-A-62-215272.

Various compounds or precursors thereof can be added to the silver halide emulsions which are used in the present invention with a view to preventing the occurrence of fogging during the manufacture, storage or photographic processing of the photosensitive material or with a view to stabilizing photographic performance. Actual examples of such compounds have been disclosed on pages 39 to 72 of the specification of the aforementioned JP-A-62-215272, and the use of these compounds is preferred.

The emulsions used in this present invention may be of the so-called surface latent image type in which the latent image is formed principally on the grain surfaces, or of the so-called internal latent image type in which the latent image is formed principally within the grains.

Yellow couplers, magenta couplers and cyan couplers which form yellow, magenta and cyan colors respectively on coupling with the oxidized form of a primary aromatic amine based color developing agent are normally used in color photosensitive materials.

Use of the cyan couplers, magenta couplers and yellow couplers which can be represented by the general formulae (C-I), (C-II), (M-I), (M-II) and (Y) which are illustrated below is preferred in the present invention.

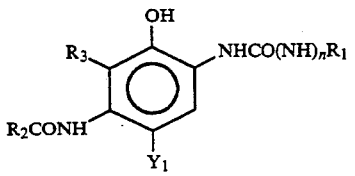

(C-I)

-continued

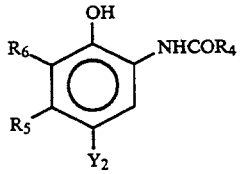

(C-II)

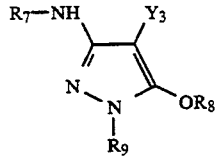

(M-I)

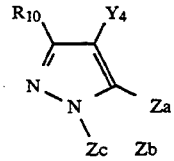

(M-II)

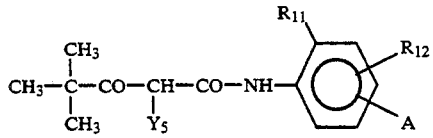

(Y)

In general formulae (C-I) and (C-II), $R_1$, $R_2$ and $R_4$ represent substituted or unsubstituted aliphatic, aromatic, or heterocyclic groups, $R_3$, $R_5$ and $R_6$ represent hydrogen atoms, halogen atom, aliphatic groups, aromatic groups or acylamino groups, and $R_3$ may represent a group of non-metal atoms which, together with $R_2$, form a five or six membered nitrogen containing ring. $Y_1$ and $Y_2$ represent hydrogen atoms or groups which can be eliminated during a coupling reaction with the oxidized form of a developing agent. Moreover, n represents 0 or 1.

$R_5$ in general formula (C-II) is preferably an aliphatic group, for example, methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

Preferred examples of the cyan couplers which can be represented by the aforementioned general formula (C-I) or (C-II) are described below.

$R_1$ in general formula (C-I) is preferably an aryl group or a heterocyclic group, and aryl groups which are substituted with halogen atoms, alkyl groups, alkoxy groups, aryloxy groups, acylamino groups, acyl groups, carbamoyl groups, sulfonamido groups, sulfamoyl groups, sulfonyl groups, sulfamido groups, oxycarbonyl groups and cyano groups are most desirable.

In those cases where $R_3$ and $R_2$ do not form a ring in general formula (C-I), $R_2$ is preferably a substituted or unsubstituted alkyl group or aryl group, and most desirably a substituted aryloxy substituted alkyl group, and $R_3$ is preferably a hydrogen atom.

$R_4$ in general formula (C-II) is preferably a substituted or unsubstituted alkyl group or aryl group, and most desirably it is a substituted aryloxy substituted alkyl group.

$R_5$ in general formula (C-II) is preferably an alkyl group which has from 2 to 15 carbon atoms or a methyl group which has a substituent group which has at least one carbon atom, and the preferred substituent groups are arylthio groups, alkylthio groups, acylamino groups, aryloxy groups and alkyloxy groups.

$R_5$ in general formula (C-II) is most desirably an alkyl group which has from 2 to 15 carbon atoms, and alkyl groups which have from 2 to 4 carbon atoms are especially desirable.

$R_6$ in general formula (C-II) is preferably a hydrogen atom or a halogen atom, and most desirably it is a chlorine atom or a fluorine atom. $Y_1$ and $Y_2$ in general formulae (C-I) and (C-II) each preferably represent a hydrogen atom, a halogen atom, an alkoxy group, an aryloxy group, an acyloxy group or a sulfonamido group.

In general formula (M-I), $R_7$ and $R_9$ represent aryl groups, $R_8$ represents a hydrogen atom, an aliphatic or aromatic acyl group, or an aliphatic or aromatic sulfonyl group, and $Y_3$ represents a hydrogen atom or a leaving group. The substituent groups permitted for the aryl groups (preferably phenyl groups) represented by $R_7$ and $R_9$ are the same as those permitted as substituent groups for $R_1$. When there are two or more substituent groups, the substituent groups may be the same or different. $R_8$ is preferably a hydrogen atom, an aliphatic acyl group or a sulfonyl group, and most desirably it is a hydrogen atom. $Y_3$ is preferably a group of the type which is eliminated at a sulfur, oxygen or nitrogen atom, and most desirably it is a sulfur atom leaving group of the type disclosed, for example, in U.S. Pat. No. 4,351,897 or International Patent WO88/04795.

In general formula (M-II), $R_{10}$ represents a hydrogen atom or a substituent group. $Y_4$ represents a hydrogen atom or a leaving group, and it is preferably a halogen atom or an arylthio group, Za, Zb and Zc represent methine groups, substituted methine groups, =N— or —NH—, and one of the bonds Za-Zb and Zb-Zc is a double bond and the other is a single bond. Those cases where the Zb-Zc bond is a carbon-carbon double bond include cases in which this bond is part of an aromatic ring. Cases where a dier or larger oligomer is formed via $R_{10}$ or $Y_4$, and cases in which, when Za, Zb or Zc is a substituted methine group, a dimer or larger oligomer is formed via the substituted methine groups, are also included.

Among the pyrazoloazole based couplers represented by general formula (M-II), the imidazo[1,2-b]pyrazoles disclosed in U.S. Pat. No. 4,500,630 are preferred from the point of view of the slight subsidiary absorbance on the yellow side and the light fastness of the colored dye, and the pyrazolo[1,5-b][1,2,4]triazole disclosed in U.S. Pat. No. 4,540,654 is especially desirable.

The use of the pyrazolotriazole couplers in which a branched alkyl group is bonded directly to the 2-, 3- or 6-position of the pyrazolotriazole ring as disclosed in JP-A-61-65245, the pyrazoloazole couplers which have a sulfonamide group within the molecule as disclosed in JP-A-61-65246, the pyrazoloazole couplers which have alkoxyphenylsulfonamido ballast groups as disclosed in JP-A-61-147254, and the pyrazolotriazole couplers which have an alkoxy group or an aryloxy group in the 6-position as disclosed in European Patents (Laid Open) 226,849 and 294,785 is also desirable.

In general formula (Y), $R_{11}$ represents a halogen atom, an alkoxy group, a trifluoromethyl group or an aryl group, and $R_{12}$ represents a hydrogen atom, a halogen atom or an alkoxy group. A represents —NH-$COR_{13}$, —$NHSO_2$—$R_{13}$, —$SO_2NHR_{13}$, —$COOR_{13}$ or $$-SO_2\underset{\underset{R_{14}}{|}}{N}-R_{13},$$

where $R_{13}$ and $R_{14}$ each represent an alkyl, an aryl group or an acyl group. $Y_5$ represents a leaving group. The substituent groups for $R_{12}$, and for $R_{13}$ and $R_{14}$, are the same as the substituent groups permitted for $R_1$, and the leaving group $Y_5$ is preferably a group of the type at which elimination occurs at an oxygen atom or a nitrogen atom, and it is most desirably of the nitrogen atom elimination type.

Specific examples of couplers which can be represented by general formulae (C-I), (C-II), (M-I), (M-II) and (Y) are indicated below.

(C-1)

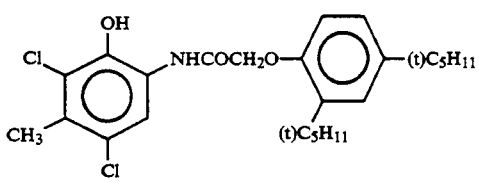

(C-2)

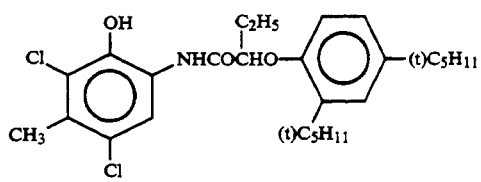

(C-3)

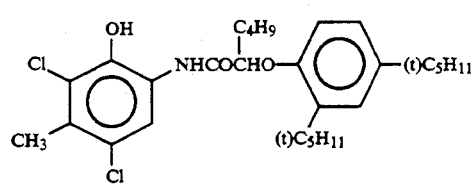

(C-4)

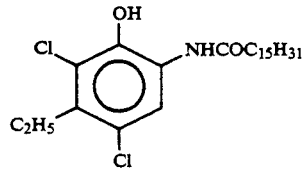

(C-5)

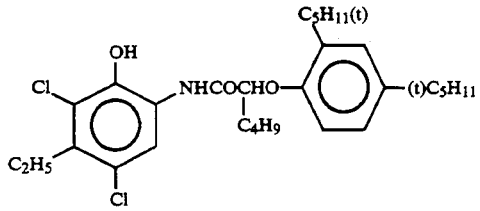

(C-6)

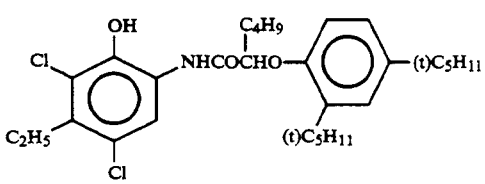

-continued
(C-7)
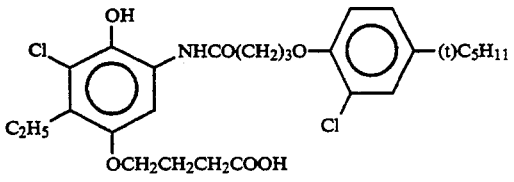
(C-8)
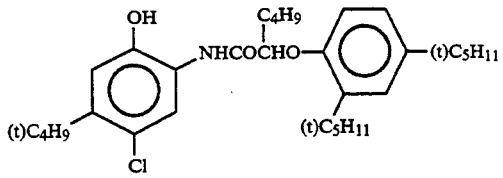
(C-9)
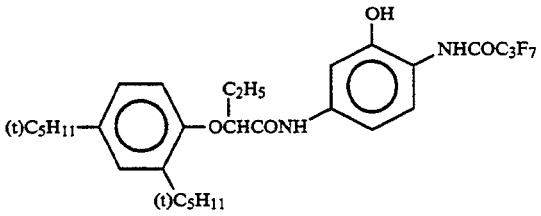
(C-10)
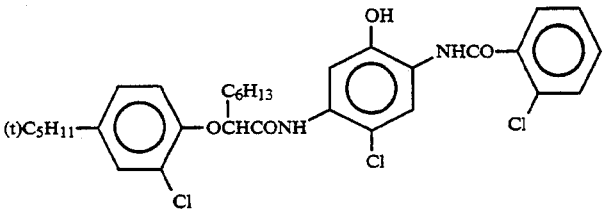
(C-11)
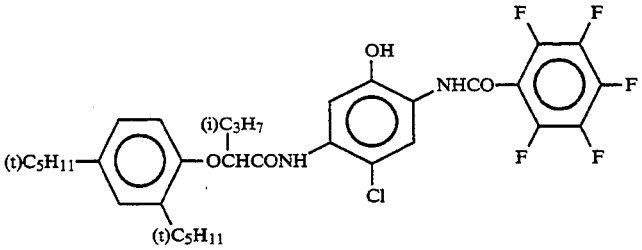
(C-12)
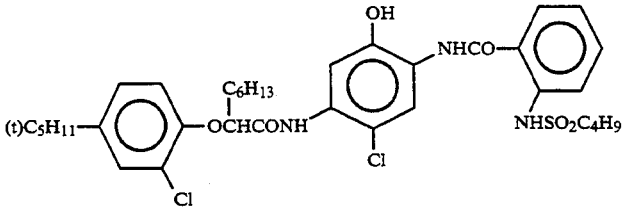
(C-13)
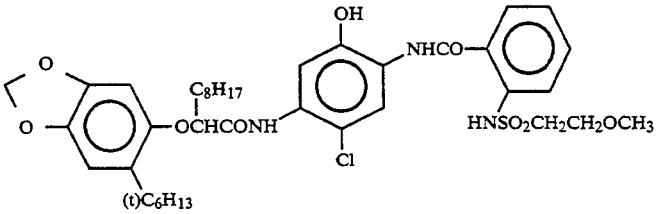
(C-14)
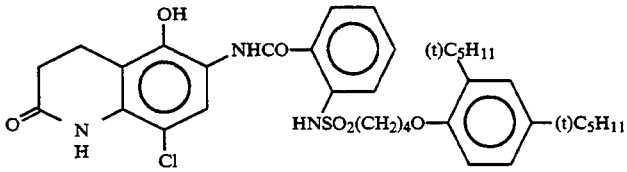

-continued
(C-15)
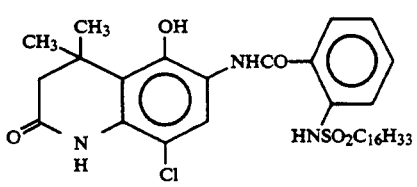
(C-16)
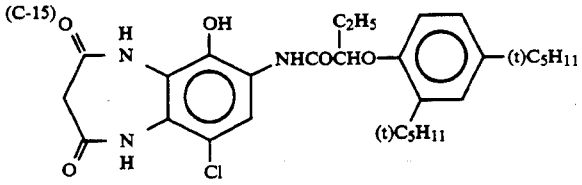
(C-17)
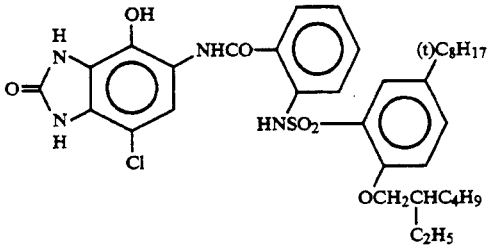
(C-18)
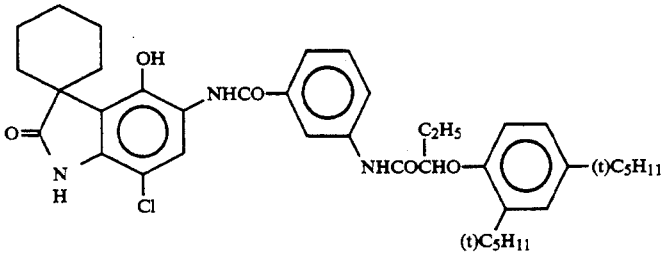
(C-19)
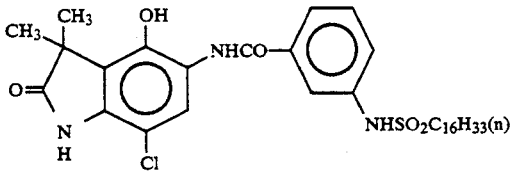
(C-20)
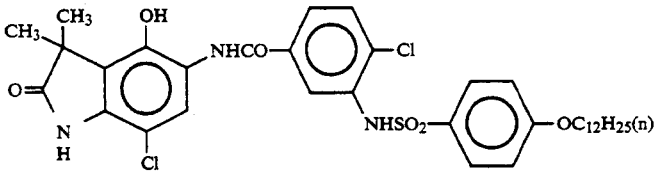
(C-21)
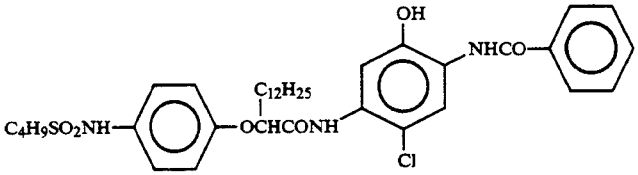
(C-22)
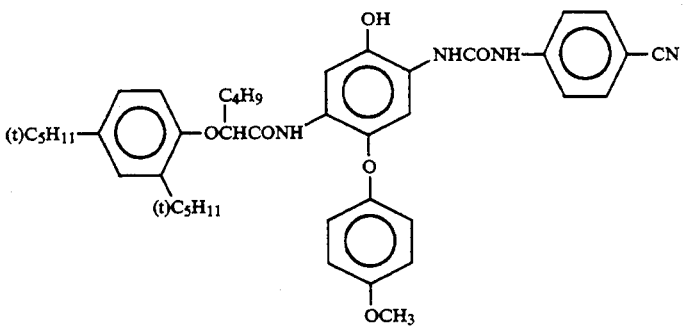

-continued
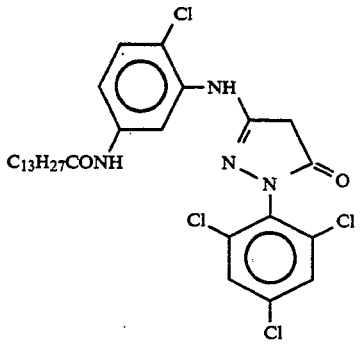
(M-1)
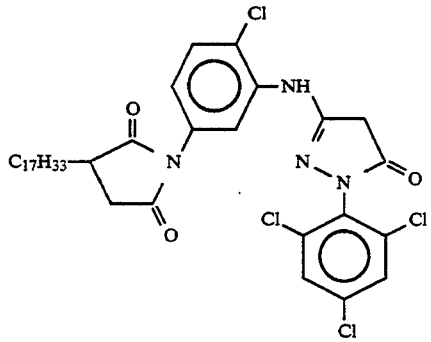
(M-2)
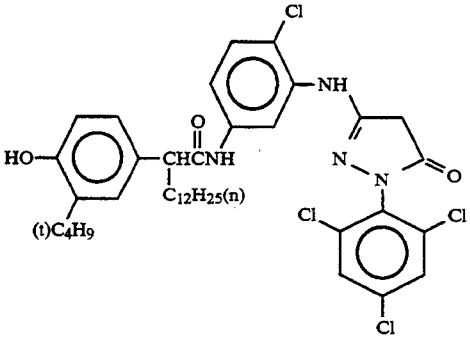
(M-3)
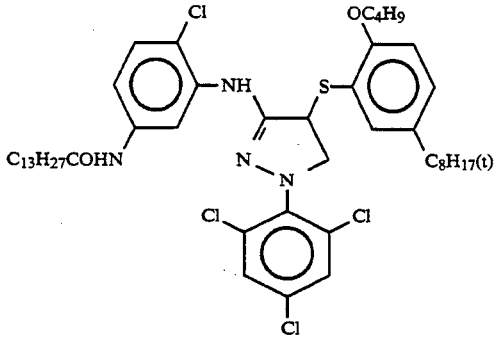
(M-4)
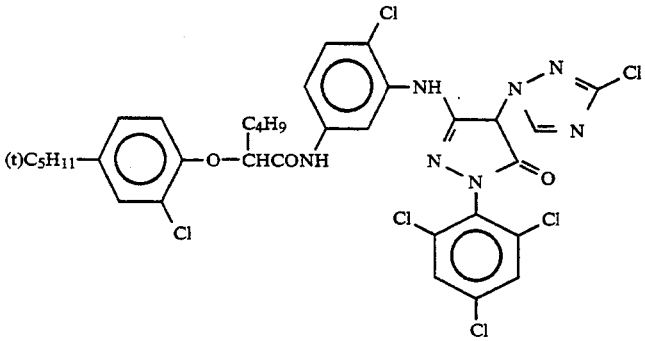
(M-5)
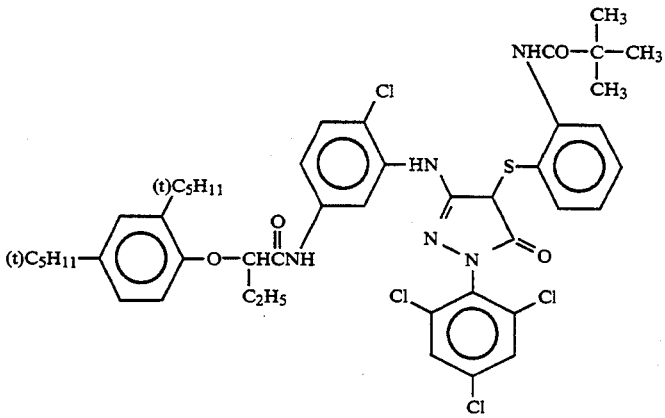
(M-6)

-continued
(M-7)
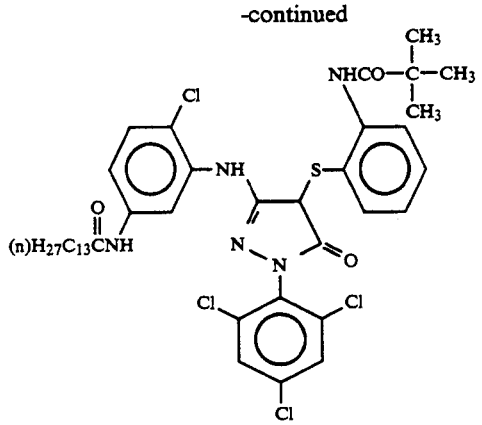
(M-8)
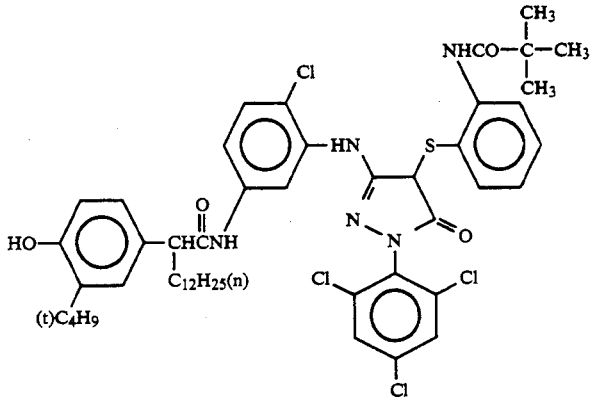

| Compound | $R_{10}$ | $R_{15}$ | $Y_4$ |
|---|---|---|---|
| | | 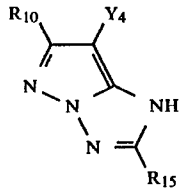 | |
| M-9 | $CH_3$— | 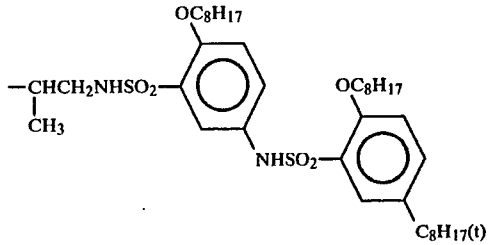 | Cl |
| M-10 | As above | 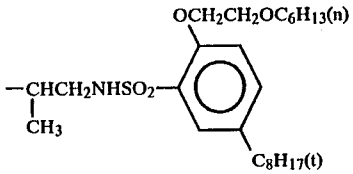 | As above |
| M-11 | $(CH_3)_3C$— | 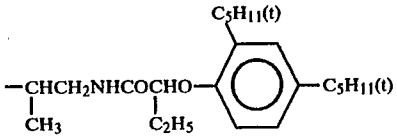 | 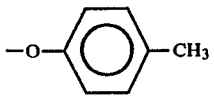 |
| M-12 | 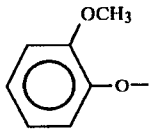 | 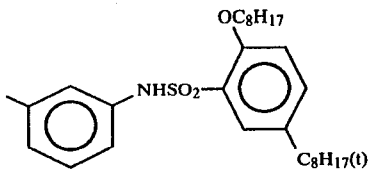 | 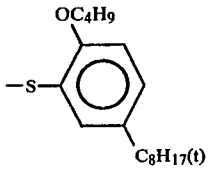 |

-continued
| Compound | $R_{10}$ | $R_{15}$ | $Y_4$ |
|---|---|---|---|
| M-13 | $CH_3$— | 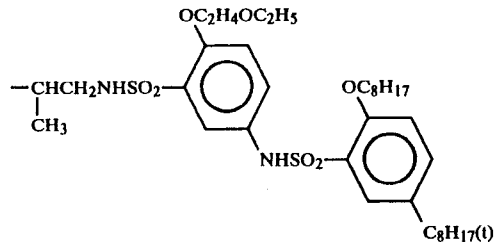 | Cl |
| M-14 | As above | 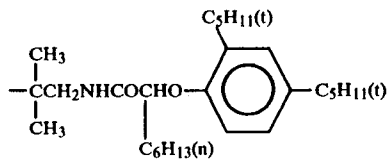 | As above |
| M-15 | As above | 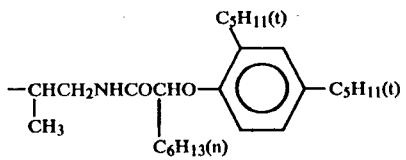 | As above |
| M-16 | $CH_3$— | 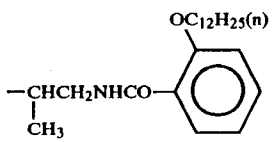 | Cl |
| M-17 | As above | 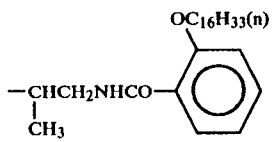 | As above |

-continued
| Compound | $R_{10}$ | $R_{15}$ | $Y_4$ |
|---|---|---|---|
| M-18 | 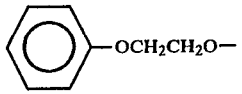 | 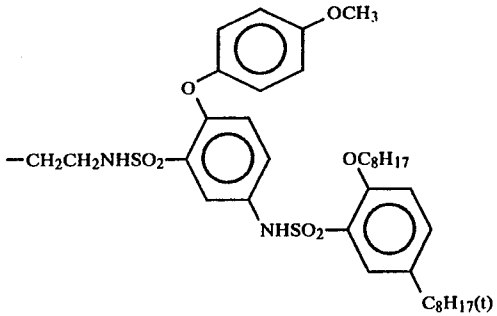 | 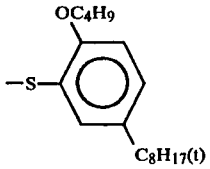 |
| M-19 | $CH_3CH_2O-$ | As above | As above |
| M-20 | 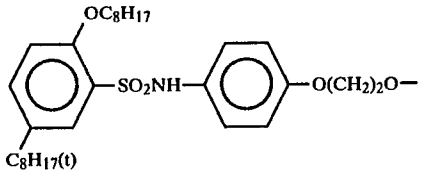 | 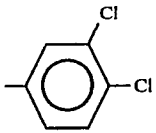 | 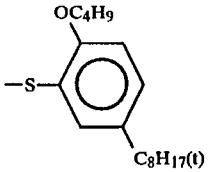 |
| M-21 | 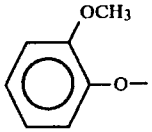 | 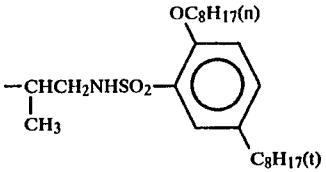 | Cl |
| | 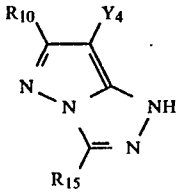 | | |
| M-22 | $CH_3-$ | 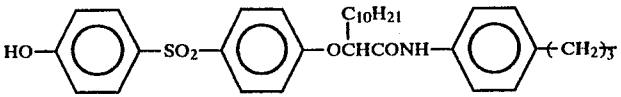 | Cl |

-continued

| Compound | $R_{10}$ | $R_{15}$ | $Y_4$ |
|---|---|---|---|
| M-23 | As above | $(n)C_6H_{13}$<br>$CHCH_2SO_2(CH_2)_2$<br>$(n)C_8H_{17}$ | As above |
| M-24 | $CH_3$<br>$CH-$<br>$CH_3$ | $OC_4H_9$<br>$SO_2(CH_2)_3$<br>$C_8H_{17}(t)$ | As above |
| M-25 | $CH_3$<br>$(CH-CH_2)_{50}(CH_2-C)_{50}$<br>$COOCH_2CH_2OCH_3$ $CONH-$ | $CH_3-CH-$<br>$CH_2NHSO_2CH_3$ | As above |
| M-26 | $-O-$ | $OC_8H_{17}$<br>$(CH_2)_2NHSO_2-$<br>$C_8H_{17}(t)$ | Cl |
| M-27 | $CH_3-$ | $CH_3$<br>$CH_3$<br>$CH_3$ $NHCOCHO-$ $SO_2-$ $OCH_2-$<br>$(n)C_{10}H_{21}$ | As above |
| M-28 | $(CH_3)_3C-$ | $CH_3$<br>$CH_3$ $C_5H_{11}(t)$<br>$CH_3$ $NHCOCHO-$ $C_5H_{11}(t)$<br>$C_4H_9(n)$ | As above |

-continued
| Compound | $R_{10}$ | $R_{15}$ | $Y_4$ |
|---|---|---|---|
| M-29 | 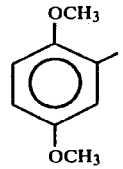 | 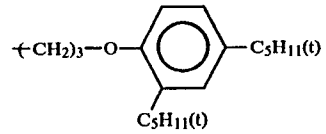 | Cl |
| M-30 | $CH_3$— | $-CH(C_2H_5)-N(n\text{-}C_{18}H_{37})COCH_2CH_2COOH$ | Cl |

(Y-1)
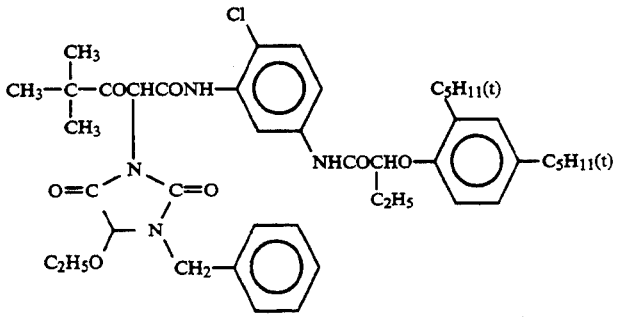
(Y-2)
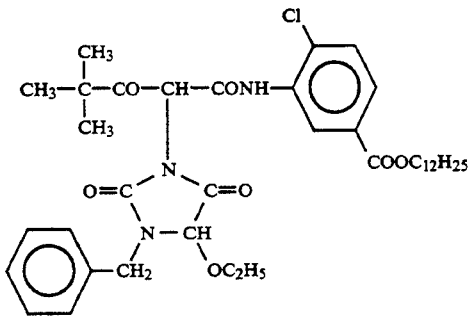
(Y-3)
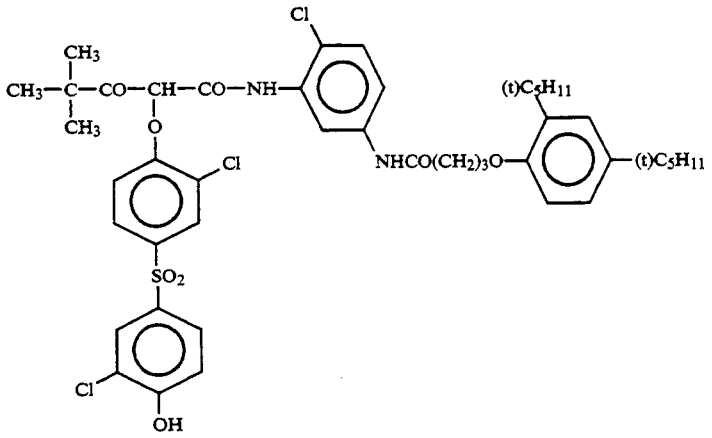
(Y-4)
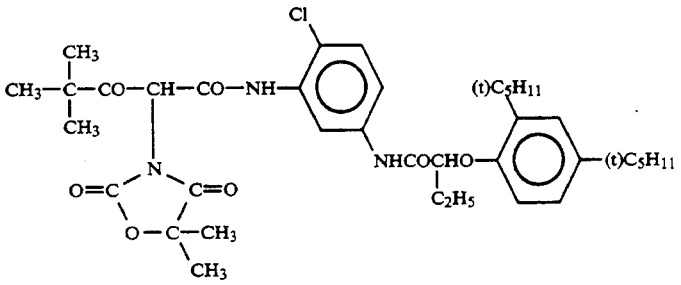
(Y-5)
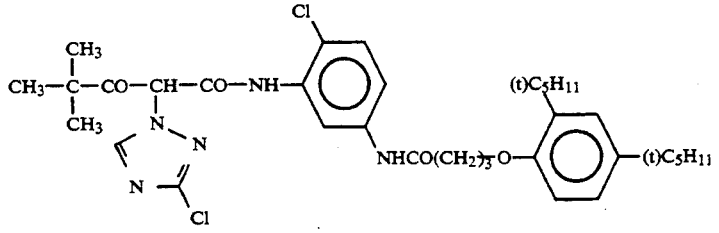

-continued (Y-6)

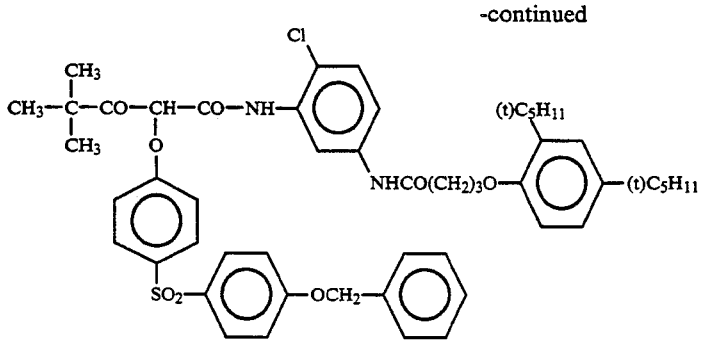

(Y-7)

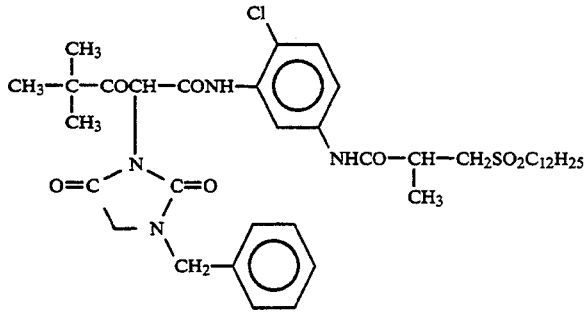

(Y-8)

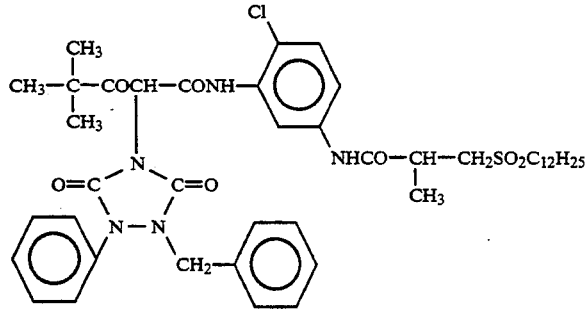

(Y-9)

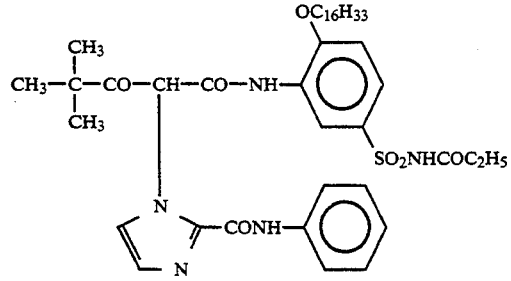

The couplers represented by the aforementioned general formulae (C-I) to (Y) are normally included in the silver halide, emulsion layers which form the photosensitive layer in an amount from 0.1 to 1.0 mol, and preferably of from 0.1 to 0.5 mol, per mol of silver halide.

Various known techniques can be used in the present invention for adding the aforementioned couplers to the photosensitive layers. Normally, they can be added by means of oil in water dispersion using the oil protection method where, after being dissolved in a solvent, the solution is emulsified and dispersed in an aqueous gelatin solution which contains a surfactant. Alternatively, water or an aqueous gelatin solution can be added to a coupler solution which contains a surfactant and an oil in water dispersion can be formed by phase reversal. Furthermore, alkali soluble couplers can also be dispersed using the so-called Fischer dispersion method. Coupler dispersions can be mixed with the photographic emulsions after the removal of low boiling point organic solvents by distillation, noodle washing or ultrafiltration for example.

The use of high boiling point organic solvents which have a dielectric constant (25° C.) of from 2 to 20 and a refractive index (25° C.) of from 1.5 to 1.7, and/or water insoluble polymeric compounds, as coupler dispersion media is preferred.

The use of high boiling point organic solvents which can be represented by the general formulae (S1) to (S5) indicated below is preferred.

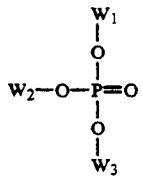

General Formula (S1)

$W_1—COO—W_2$ General Formula (S2)

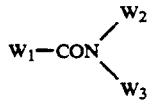

General Formula (S3)

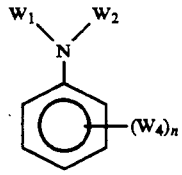

General Formula (S4)

$W_1—O—W_2$ General Formula (S5)

In these formulae, $W_1$, $W_2$ and $W_3$ each represent a substituted or unsubstituted alkyl group, cycloalkyl group, alkenyl group, aryl group or heterocyclic group, $W_4$ represents $W_1$, $—OW_1$ or $—S—W_1$, and n represents an integer of value from 1 to 5, and when n has a value of 2 or more the $W_4$ groups may be the same or different. Moreover, $W_1$ and $W_2$ in general formula (S5) may form a condensed ring.

Water immiscible compounds of melting point below 100° C. and of boiling point at least 140° C. other than those of general formulae (S1) to (S5) can be used as the high boiling point organic solvents which are used in this present invention, provided that they are good solvents for the coupler. The melting point of the high boiling point organic solvent is preferably not more than 80° C. Moreover, the boiling point of the high boiling point organic solvent is preferably at least 160° C., and most desirably at least 170° C.

Details of these high boiling point organic solvents have been disclosed from the lower right column on page 137 to the upper right column on page 144 of the specification of JP-A-62-215272.

Furthermore, these couplers can be loaded onto a loadable latex polymer (see, for example, U.S. Pat. No. 4,203,716) in the presence or absence of the aforementioned high boiling point organic solvents, or they can be dissolved in a water insoluble but organic solvent soluble polymer and the solution can be emulsified and dispersed in an aqueous hydrophilic colloid solution.

The use of the homopolymers or copolymers disclosed on pages 12 to 30 of the specification of International Patent WO88/00723 is preferred, and the use of acrylamide based polymers is especially desirable from the viewpoint of colored image stabilization etc.

Photosensitive materials which have been prepared using the present invention may contain hydroquinone derivatives, aminophenol derivatives, gallic acid derivatives and ascorbic acid derivatives, for example, as anti-color fogging agents.

Various anti-color fading agents can be used in the photosensitive materials of this present invention. That is to say, hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines, and the ether and ester derivatives in which the phenolic hydroxyl groups of these compounds have been silylated or alkylated, are typical organic anti-color mixing agents which can be used for cyan, magenta and/or yellow images. Furthermore, metal complexes as typified by (bis-salicylaldoximato)-nickel and (bis-N,N-dialkyldithiocarbamato)nickel complexes, for example, can also be used for this purpose.

Actual examples of organic anti-color fading agents have been disclosed in the patent specifications indicated below.

Thus, hydroquinones have been disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028, 6-hydroxychromans, 5-hydroxycoumarans and spirochromans have been disclosed, for example, in U.S. Pat. Nos. 3,432,300, 3,573,050, 3,574,627, 3,698,909 and 3,764,337, and JP-A-52-152225, spiroindanes have been disclosed in U.S. Pat. No. 4,360,589, p-alkoxyphenols have been disclosed, for example, in U.S. Pat. No. 2,735,765, British Patent 2,066,975, JP-A-59-10539 and JP-B-57-19765, hindered phenols have been disclosed, for example, in U.S. Pat. No. 3,700,455, JP-A-52-72224, U.S. Pat. No. 4,228,235, and JP-B-52-6623, gallic acid derivatives, methylenedioxybenzenes and aminophenols have been disclosed, for example, in U.S. Pat. Nos. 3,457,079 and 4,332,886, and JP-B-56-21144 respectively, hindered amines have been disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344, and metal complexes have been disclosed, for example, in U.S. Pat. Nos. 4,050,938 and 4,241,155, and British patent 2,027,731(A). The intended purpose can be realized by adding these compounds to the photosensitive layer after coemulsification with the corresponding color coupler, usually at a rate of from 5 to 100 wt % with respect to the coupler. The inclusion of ultraviolet absorbers in the cyan color forming layer and in the layers on both sides adjacent thereto is effective for preventing deterioration of the cyan dye image by heat and, more especially, by light.

For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,395), butadiene compounds (for example, those disclosed in U.S. Pat. No. 4,045,229), or benzoxazole compounds (for example, those disclosed in U.S. Pat. Nos. 3,406,070, 3,677,672 and 4,271,307) can be used as ultraviolet absorbers. Ultraviolet absorbing couplers (for example, α-naphthol based cyan dye forming couplers) and ultraviolet absorbing polymers, for example, can also be used for this purpose. These ultraviolet absorbers can be mordanted in a specified layer.

From among these compounds, the aforementioned benzotriazole compounds which are substituted with aryl groups are preferred.

The use, together with the couplers described above, of compounds such as those described below is preferred in the present invention. The combined use of these compounds with pyrazoloazole couplers is especially desirable.

Thus, the use of compounds (F) which bond chemically with the aromatic amine based developing agents remaining after color development processing and form compounds which are chemically inert and essentially colorless and/or compounds (G) with bond chemically with the oxidized form of the aromatic amine based color developing agents remaining after color development processing and form compounds which are chemically inert and essentially colorless either simultaneously or individually is desirable for preventing the occurrence of staining and other side effects on storage due to colored dye formation resulting from reactions between couplers and color developing agents or oxidized forms thereof which remain in the film after processing for example.

Compounds which react with p-anisidine with a second order reaction rate constant $k_2$ (measured in trioctyl phosphate at 80° C.) within the range from 1.0 liter/mol·sec to $1\times10^{-5}$ liter/mol·sec are preferred for the compound (F). The second order reaction rate constant can be measured using the method disclosed in JP-A-63-158545.

The compounds themselves are unstable if $k_2$ has a value above this range, and they will react with gelatin or water and be decomposed. If, on the other hand, the value of $k_2$ is below this range, reaction with the residual aromatic amine based developing agent is slow and consequently it is not possible to prevent the occurrence of side effects due to the residual aromatic amine based developing agent.

The preferred compounds (F) of this type can be represented by the general formulae (FI) and (FII) which are shown below.

$$R_1-(A)_n-X \quad \text{(FI)}$$

$$R_2-\underset{\underset{B}{|}}{C}=Y \quad \text{(FII)}$$

In these formulae, $R_1$ and $R_2$ each represent an aliphatic group, an aromatic group or a heterocyclic group. Moreover, n represents 1 or 0. A represents a group which reacts with aromatic amine based developing agents and forms a chemical bond, and X represents a group which is eliminated by reaction with an aromatic amine based developing agent. B represents a hydrogen atom, an aliphatic group, an aromatic group, a heterocyclic group, an acyl group or a sulfonyl group, and Y represents a group which promotes the addition of an aromatic amine based developing agent to the compound of general formula (FII). Here, $R_1$ and X, and Y and $R_2$ or B, can be joined together to form a cyclic structure.

Substitution reactions and addition reactions are typical of the reactions by which the residual aromatic amine based developing agent is chemically bound.

The compounds represented by the general formulae (FI) and (FII) which are disclosed, for example, in JP-A-63-158545, JP-A-62-283338, and EP-A-298321 and EP-A-277589 are preferred.

On the other hand, the preferred compounds (G) which bond chemically with the oxidized forms of aromatic amine based developing agents which remain after color development processing and form compounds which are chemically inert and colorless can be represented by the general formula (GI) indicated below.

$$R-Z \quad \text{(GI)}$$

R in this formula represents an aliphatic group, an aromatic group or a heterocyclic group. Z represents a nucleophilic group or a group which breaks down in the photosensitive material and releases a nucleophilic group. The compounds represented by the general formula (GI) are preferably compounds in which Z is a group of which the Pearson nucleophilicity $^{n}CH_3I$ value (R. G. Pearson et al., J Am. Chem. Soc., 90, 319 (1968) is at least 5, or a group derived therefrom.

The compounds which can be represented by general formula (GI) and which are disclosed, for example, in European Patent Laid Open 255,722, JP-A-62-143048, JP-A-62-229145, Japanese Patent Application Nos. 63-136724, 62-214681 and 62-158342, and European Patents (Laid Open) 298,321 and 277,589 are preferred.

Furthermore, details of combinations of the aforementioned compounds (G) and compounds (F) have been disclosed in EP-A-277589.

Water soluble dyes and dyes which become water soluble as a result of photographic processing may be included as filter dyes, or for anti-irradiation or anti-halation or other purposes, in the hydrophilic colloid layers of photosensitive materials which have been prepared using this present invention. Dyes of this type include oxonol dyes, hemi-oxonol dyes, styryl dyes, merocyanine dyes, cyanine dyes and azo dyes. The oxonol dyes, hemi-oxonol dyes and merocyanine dyes are useful among these dyes.

Gelatin is useful as a binding agent or protective colloid which can be used in the emulsion layers of a photosensitive material of this present invention, but other hydrophilic colloids, either alone or in conjunction with gelatin, can be used for this purpose.

The gelatin used in the invention may be a lime treated gelatin, or it may be a gelatin which has been treated using acids. Details of the preparation of gelatins have been disclosed by Arthur Weise in *The Macromolecular Chemistry of Gelatin* (published by Academic Press, 1964).

The transparent films, such as cellulose nitrate films and poly(ethylene terephthalate) films, and reflective supports normally used in photographic photosensitive materials can be used as the supports which are used in the present invention. The use of reflective supports is preferred in view of the aims of the invention.

The "reflective supports" used in this present invention are supports which have a high reflectivity and make the dye image which is formed in the silver halide emulsion layer bright, and these include supports which have been covered with a hydrophobic resin which contains a dispersion of light reflecting material, such as titanium oxide, zinc oxide, calcium carbonate or calcium sulfate, and supports comprising a hydrophobic resin in which a light reflecting substance is included. Examples of such supports include baryta paper, polyethylene coated paper, polypropylene based synthetic paper and transparent supports, such as glass plates, polyester films such as poly(ethylene terephthalate), cellulose triacetate and cellulose nitrate films, polyamide films, polycarbonate films, polystyrene films and vinyl chloride resins, on which a reflective layer has been established or in which a reflective substance is used conjointly.

Supports which have a metal surface with mirror like reflection properties or type two diffuse reflection properties can also be used as reflective type supports. The spectral reflectance in the visible wavelength region of a metal surface is at least 0.5, and the surface may be roughened, or diffuse reflection properties may be obtained using a metal powder. Aluminum, tin, silver, magnesium or their alloys are used, for example, for the said metal, and the surface may be a metal sheet, foil or a thin metal surface layer obtained by rolling, vapor deposition or plating for example. From among these materials, those obtained by vapor depositing metal on some other substrate are preferred. The establishment of a water insoluble resin, and preferably a thermoplastic resin, layer over the metal surface is desirable. An anti-static layer may also be established on the opposite side to the metal surface side of the support in this invention. Details of such supports have been disclosed, for example, in JP-A-61-210346, JP-A-63-24247, JP-A-63-24251 and JP-A-63-24255.

These supports can be selected appropriately according to the intended use.

The use of a white pigment which has been milled adequately in the presence of a surfactant and of which the particle surfaces have been treated with a dihydric-tetrahydric alcohol is preferred for the light reflecting substance.

The occupied surface ratio of fine white pigment particles per specified unit area (%) can be determined most typically by dividing the area under observation into adjoining 6×6 μm unit areas and measuring the occupied area ratio (%) ($R_i$) for the fine particles projected in each unit area. The variation coefficient of the occupied area ratio (%) can be obtained by means of the ratio $s/\overline{R}$ of the standard deviation s for $R_i$ with respect to the average value ($\overline{R}$) of $R_i$. The number of unit areas taken for observation (n) is preferably at least six. Hence, the variation coefficient $s/\overline{R}$ can be obtained by means of the following expression:

$$\sqrt{\frac{\sum_{i=1}^{n}(Ri-R)^2}{n-1}} \Big/ \frac{\sum_{i=1}^{n} Ri}{n}$$

In this present invention, the variation coefficient of the occupied area ratio (%) of the fine pigment particles is not more than 0.15, and preferably not more than 0.12. In cases where the value is less than 0.08, the diffusion properties of the particles can be said to be "uniform" in practice.

The supports used in the invention should be light in weight, thin and strong since they are to be used for hard copy after image formation. They should also be cheap. Polyethylene coated papers and synthetic papers of thickness from 10 to 250 μm, and preferably of thickness from 30 to 180 μm, are preferred as reflective supports.

Image formation can be achieved using conventional color development processing with the photosensitive materials of this present invention. When high silver chloride emulsions, i.e., in which the average silver chloride content is at least 90 mol % are used for the silver halide emulsion, processing in a color development bath which contains at least one type of primary aromatic amine based color developer, from $3.5\times10^{-2}$ to $1.5\times10^{-1}$ mol/liter of chloride ion and from $3.0\times10^{-5}$ to $1.0\times10^{-3}$ mol/liter of bromine ion is preferred. Processing in this manner does not result in a lowering of maximum density, leaves no residual coloration due to the dyes, prevents the occurrence of the pressure fogging marks which are formed in automatic processor operation, prevents the occurrence of fluctuations in photographic characteristics (especially in minimum density) in continuous processing, and markedly reduces the amount of residual silver.

Color development processing which is suitable for use with photosensitive materials of the present invention is described in detail below.

The color photographic photosensitive materials of the present invention are preferably subjected to color development, bleach-fixing and a water washing process (or stabilization process). Bleaching and fixing can be carried out separately rather than in a single bath as described above.

The known primary aromatic amine color developing agents are included in the color development baths which are used in the present invention. The p-phenylenediamine derivatives are preferred, and typical example of these are indicated below, but the developing agent is not limited by these examples.

(D-1) N,N-Diethyl-p-phenylenediamine
(D-2) 2-Amino-5-diethylaminotoluene
(D-3) 2-Amino-5-(N-ethyl-N-laurylamino)toluene
(D-4) 4-[N-Ethyl-N-β(hydroxyethyl)amino]aniline
(D-5) 2-Methyl-4-[N-ethyl-N-(β-hydroxyethyl-)amino]aniline
(D-6) 4-Amino-3-methyl-N-ethyl-[N-(β-methanesulfonamido)ethyl]aniline
(D-7) N-(2-Amino-5-diethylaminophenylethyl)methanesulfonamide
(D-8) N,N-Dimethyl-p-phenylenediamine
(D-9) 4-Amino-3-methyl-N-ethyl-N-methoxyethylaniline
(D-10) 4-Amino-3-methyl-N-ethyl-N-β-ethoxyethylaniline
(D-11) 4-Amino-3-methyl-N-ethyl-N-β-butoxyethylaniline From among the above mentioned p-phenylenediamine derivatives, 4-amino-3-methyl-N-ethyl-N-[β-methanesulfonamido)ethyl]aniline (illustrative compound D-6) is preferred.

Furthermore, these p-phenylenediamine derivatives may take the form of salts, such as, for example, sulfates, hydrochlorides sulfites or p-toluenesulfonates. The amount of the said primary aromatic amine developing agent used is preferably from about 0.1 to about 20 grams, and most desirably from about 0.5 to about 10 grams, per liter of development bath.

The use of an essentially benzyl alcohol free development bath is preferred for the execution of the present invention. Here, the term "essentially benzyl alcohol free" signifies that the benzyl alcohol concentration is preferably not more than 2 ml/l, more desirably that the benzyl alcohol concentration is not more than 0.5 ml/l, and most desirably that the development bath contains no benzyl alcohol at all.

The development baths used in the present invention are preferably essentially sulfite ion free. The sulfite ion has a silver halide dissolving action and also reacts with the oxidized form of the developing agent as well as functioning as a preservative for the developing agent, and it has the effect of reducing the efficiency with which dyes are formed. It can be concluded that effects of this type are one of the causes of the considerable changes which occur in photographic performance during continuous processing. Here, the term "essentially sulfite ion free" signifies that the sulfite ion concentration is preferably not more than $3.0\times10^{-3}$ mol/liter, and most desirably that the bath contains no sulfite ion at all. However, in the present invention, the small amounts of sulfite ion used to prevent oxidation in processing kits in which the developing agent is in a concentrated form prior to dilution for use are excluded.

The development baths used in the present invention are preferably essentially sulfite ion free, but more desirably they are essentially hydroxylamine free. This is because hydroxylamine itself has a silver developing activity as well as functioning as a preservative, and it is thought that changes in the hydroxylamine concentration have a marked effect on photographic characteristics. Here, the term "essentially hydroxylamine free" signifies a hydroxylamine concentration preferably of not more than $5.0\times10^{-3}$ mol/liter, and most desirably that the development bath contains no hydroxylamine at all.

The development baths used in the present invention most desirably contain organic preservatives in place of the aforementioned hydroxyamine and sulfite ion.

Here, an "organic preservative" signifies an organic compound which, when added to a processing bath for color photographic photosensitive materials, reduces the rate of deterioration of the primary aromatic amine color developing agent. That is to say, they are organic compounds which have the function of preventing the aerial oxidation of color developing agents for example, and from among these compounds the hydroxylamine derivatives (except hydroxylamine, same hereinafter), hydroxamic acids, hydrazines, hydrazides, phenols, α-hydroxyketones, α-aminoketones, sugars, monoamines, di-amines, poly-amines, quaternary ammonium salts, nitroxy radicals, alcohols, oximes, diamido compounds and condensed ring amines, for example, are especially effective organic preservatives. These have been disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

The various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxy compounds disclosed, for example, in U.S. Pat. No. 3,746,544 etc. can also be included, as required, as preservatives. The addition of alkanolamines such as triethanolamine, dialkylhydroxylamines such as diethylhydroxylamine, hydrazine derivatives or aromatic polyhydroxy compounds is especially desirable.

Among the aforementioned organic preservatives, the hydroxylamine derivatives and hydrazine derivatives (hydrazine derivatives and hydrazide derivatives) are especially desirable, and details have been disclosed, for example, in Japanese Patent Application Nos. 62-255270, 63-9713, 63-9714 and 63-11300.

Furthermore, the combined use of amines with the aforementioned hydroxylamine derivatives or hydrazine derivatives is desirable for increasing the stability of the color development bath and for increasing stability during continuous processing.

The aforementioned amines may be amines such as the cyclic amines disclosed in JP-A-63-239447, the amines disclosed in JP-A-63-128340 or other amines such as those disclosed in Japanese Patent Application Nos. 63-9713 and 63-11300.

The inclusion of from $3.5\times10^{-2}$ to $1.5\times10^{-1}$ mol/liter of chlorine ion in the color development bath is desirable in this present invention. The inclusion of from $4\times10^{-2}$ to $1\times10^{-1}$ mol/liter is especially desirable. There is a disadvantage in that development is retarded if the chlorine ion concentration is greater than from $1.5\times10^{-1}$ to $10^{-1}$ mol/liter and this is undesirable from the point of view of attaining a high maximum density quickly, which is one of the aims of this present invention. Furthermore, the presence of less than $3.5\times10^{-2}$ mol/liter is undesirable from the point of view of preventing the occurrence of fogging.

Bromine ion is preferably included in an amount of from $3.0\times10^{-5}$ mol/liter to $1.0\times10^{-3}$ mol/liter in the color development bath in this present invention. It is most desirably included in an amount of from $5.0\times10^{-5}$ to $5\times10^{-4}$ mol/liter. Development is retarded and there is a reduction in maximum density and photographic speed in cases where the bromine ion concentration exceeds $1\times10^{-3}$ mol/liter, and fogging cannot be prevented satisfactorily if the bromine ion concentration is less than $3.0\times10^{-5}$.

The chlorine ion and the bromine ion may be added directly to the development bath, or they may be dissolved out of the photosensitive material into the development bath during development processing.

Sodium chloride, potassium chloride, ammonium chloride, lithium chloride, nickel chloride, magnesium chloride, manganese chloride, calcium chloride and cadmium chloride can be used as chlorine ion supplying substances in the case of direct addition to the color development bath, and of these the use of sodium chloride and potassium chloride is preferred.

Furthermore, the chlorine ion can be supplied from a fluorescent whitener which has been added to the development bath.

Sodium bromide, potassium bromide, ammonium bromide, lithium bromide, calcium bromide, magnesium bromide, manganese bromide, nickel bromide, cadmium bromide, cerium bromide and thallium bromide can be used as bromine ion supplying substances, and of these the use of potassium bromide and sodium bromide is preferred.

When these ions are dissolved out from the photosensitive material during development processing, the chlorine and bromine ions may be supplied from the emulsion or from a source other than the emulsion.

The color development baths used in the present invention are preferably of pH from 9 to 12, and most desirably of pH from 9 to 11.0, and other known development bath component compounds can be included in therein.

The use of various buffers is desirable for maintaining the above mentioned pH levels. Thus, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-ethyl-1,3-propanediol salts, valine salts, proline salts, trishydroxyaminomethane salts and lysine salts, for example, can be used as buffers. Carbonates, phosphates, tetraborates and hydroxybenzoates have the advantage of providing excellent solubility and buffering capacity in the high pH range of pH 9.0 and above, of not adversely affecting photographic performance (causing fogging for example) even when added to a color development bath, and of being cheap, and the use of these buffers is especially desirable.

Specific examples of these buffers include sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not limited to these compounds.

The amount of the said buffer added to the color development bath is preferably at least 0.1 mol/liter, and most desirably from 0.1 to 0.4 mol/liter.

Various chelating agents can also be used in the color development baths for preventing the precipitation of calcium and magnesium in the color development bath, or for improving the stability of the color development bath. For example, nitrilotriacetic acid, diethylenetriamine penta-acetic acid, ethylenediamine tetra-acetic acid, N,N,N-trimethylenephosphonic acid, ethylenediamine-N,N,N',N'-tetramethylenesulfonic acid, transcyclohexanediamine tetra-acetic acid, 1,2-diaminopropane tetra-acetic acid, glycol ether diamine tetra-acetic acid, ethylenediamine o-hydroxyphenylacetic acid, 2-phosphonobutan-1,2,4-tricarboxylic acid, 1-hydroxyethylidene-1,1-diphosphonic acid and N,N'-bis(2-hydroxybenzyl)ethylenediamine-N,N'-diacetic acid.

Two or more of these chelating agents can be used together, as required.

The amount of chelating agent used should be sufficient to chelate the metal ions which are present in the color development bath. For example, they can be used at a concentration of from 0.1 gram to 10 grams per liter.

Optional development accelerators can be added to the color development bath, as required.

For example, the thioether compounds indicated, for example, in JP-B-37-16088, JP-B-37-5987, JP-B-38-7826, JP-B-44-12380, JP-B-45-9019 and U.S. Pat. No. 3,813,247, the p-phenylenediamine based compounds indicated in JP-A-52-49829 and JP-A-50-15554, the quaternary ammonium salts indicated, for example, in JP-A-50-137726, JP-B-44-30074, JP-A-56-156826 and JP-A-52-43429, the amine based compounds disclosed, for example, in U.S. Pat. Nos. 2,494,903, 3,128,182, 4,230,796 and 3,253,919, JP-B-41-11431, and U.S. Pat. Nos. 2,482,546, 2,596,929 and 3,582,346, the poly(alkylene oxides) indicated, for example, in JP-B-37-16088, JP-B-42-25201, U.S. Pat. No. 3,128,183, JP-B-41-11431, JP-B-42-23883, and U.S. Pat. No. 3,532,501, and 1-phenyl-3-pyrazolidones and imidazoles, for example, can be added as development accelerators, as required.

Optional anti-foggants can be added, as required, in this present invention. Alkali metal halides, such as sodium chloride, potassium bromide and potassium iodide, and organic anti-foggants can be used as anti-foggants. Typical examples of organic anti-foggants include nitrogen containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

The inclusion of fluorescent whiteners in the color development baths which can be used in this present invention is desirable. 4,4'-Diamino-2,2'-disulfostilbene based compounds are preferred as fluorescent whiteners. The amount added is from 0 to 5 grams/liter, and preferably from 0.1 to 4 grams/liter.

Furthermore, various surfactants, such as, for example, alkylsulfonic acids, arylsulfonic acids, aliphatic carboxylic acids and aromatic carboxylic acids can be added, as required.

The processing temperature of the color development baths which can be used in the present invention is from 20° C. to 50° C., and preferably from 30° C. to 40° C. The processing time is from 20 seconds to 5 minutes, and preferably from 30 seconds to 2 minutes. A low rate of replenishment is preferred, and replenishment can be carried out at a rate of from 20 to 600 ml, and preferably of from 50 to 300 ml, per square meter of photosensitive material. Replenishment at a rate of from 60 to 200 $ml/m^2$ is preferred, and replenishment at a rate of from 60 to 150 $mlm^2$ is most desirable.

The de-silvering processes which can be carried out in the present invention are described below. The de-silvering process is generally comprised of a bleaching process and a fixing process, a fixing process and a bleach-fixing process, a bleaching process and a bleach-fixing process, or a bleach-fixing process.

Bleach baths, bleach-fix baths and fixing baths which can be used in the present invention are described below.

Any bleaching agent can be used for the bleaching agent which is used in the bleach bath or bleach-fix bath, but organic complex salts of iron(III) (for example complex salts with amino-polycarboxylic acids, such as ethylenediamine tetra-acetic acid and diethylenetriamine penta-acetic acid, amino-polyphosphnnic acids, phosphonocarboxylic acids and organic phosphonic acids, or with organic acids such as citric acid, tartaric acid or malic acid); persulfates; and hydrogen peroxide are preferred.

Of these, the organic complex salts of iron(III) are preferred from the viewpoints of rapid processing and the prevention of environmental pollution. Examples of some amino-polycarboxylic acids, amino-polyphosphonic acids and organic phosphonic acids or the salts thereof which are useful for forming organic complex salts of iron(III) include ethylenediamine tetra-acetic acid, diethylenetriamine penta-acetic acid, 1,3-diaminopropane tetra-acetic acid, propylenediamine tetra-acetic acid, nitrilotriacetic acid, cyclohexanediamine tetra-acetic acid, methyliminodiacetic acid, iminodiacetic acid and glycol ether diamine tetra-acetic acid. These compounds may take the form of, e.g., sodium, potassium, lithium or ammonium salts. Of these compounds, the iron(III) complex salts of ethylenediamine tetra-acetic acid, diethylenetriamine penta-acetic acid, cyclohexanediamine tetra-acetic acid, 1,3-diaminopropane tetra-acetic acid and methyliminodiacetic acid are preferred from the viewpoint of their high bleaching power. These ferric ion complex salts may be used in the form of the complex salts, or the ferric ion complex salts can be formed in solution using a ferric salt, for example, ferric sulfate, ferric chloride, ferric nitrate, ferric ammonium sulfate or ferric phosphate, and a chelating agent such as an aminopolycarboxylic acid, amino-polyphosphonic acid or phosphonocarboxylic acid. Furthermore, the chelating agent may be used in excess over the amount required to form the ferric ion complex salt. Among the iron complex salts, the aminopolycarboxylic acid iron complex salts are preferred, and the amount added is from 0.01 to 1.0 mol/liter, and preferably from 0.05 to 0.50 mol/liter.

Various compounds can be used as bleaching accelerators in the bleach baths, bleach-fix baths or bleach or bleach-fix pre-baths. For example, the compounds which have a mercapto group or a disulfide bond disclosed in U.S. Pat. No. 3,893,858, West German Patent 1,290,812, JP-A-53-95630 and *Research Disclosure*, No. 17129 (July 1978); the thiourea based compounds disclosed JP-B-45-8506, JP-A-52-20832, JP-A-53-32735 and U.S. Pat. No. 3,706,561; or halides, such as iodine or bromine ions, are preferred in view of their excellent bleaching power.

Re-halogenating agents, such as bromides (for example potassium bromide, sodium bromide, ammonium bromide), or chlorides (for example potassium chloride, sodium chloride, ammonium chloride), or iodides (for example ammonium iodide) can also be included in the bleach baths or bleach-fix baths which can be used in the present invention. One or more inorganic acid or organic acid, or the alkali metal or ammonium salts thereof, which have a pH buffering action, such as borax, sodium metaborate, acetic acid, sodium acetate, sodium carbonate, potassium carbonate, phosphorous acid, phosphoric acid, sodium phosphate, citric acid, sodium citrate or tartaric acid, and corrosion inhibitors such as ammonium nitrate and guanidine for example, can be added as required.

Known fixing agents, which is to say thiosulfates such as sodium thiosulfate and ammonium thiosulfate, thiocyanates such as sodium thiocyanate and ammonium thiocyanate, thioether compounds such as ethylene-bisthioglycolic acid and 3,6-dithia-1,8-octanediol, and water soluble silver halide dissolving agent such as the thioureas, can be used as fixing agents in the bleach-fix fix baths and fixing baths, and these compounds can be used individually, or two or more types can be used conjointly. Special bleach-fix baths consisting of a combination of large quantities of a halide such as potassium iodide and a fixing agent as disclosed in JP-A-55-155354 can also be used. The use of thiosulfates, and especially ammonium thiosulfate, is preferred in the present invention. The amount of fixing agent per liter is preferably within the range from 0.3 to 2 mol, and most desirably within the range from 0.5 to 1.0 mol. The pH range of the bleach-fix bath or fixing bath in the present invention is preferably from 3 to 10, and most desirably from 5 to 9.

Furthermore, various fluorescent whiteners, antifoaming agents or surfactants, polyvinylpyrrolidone and organic solvents such as methanol can be included in the bleach-fix baths.

The inclusion of sulfite ion releasing compounds, such as sulfites (for example, sodium sulfite, potassium sulfite, ammonium sulfite), bisulfites (for example, ammonium bisulfite, sodium bisulfite, potassium bisulfite) and metabisulfites (for example, potassium metabisulfite, sodium metabisulfite, ammonium metabisulfite) as preservatives in the bleach-fix baths and fixing baths is preferred. These compounds are preferably used at a concentration, calculated as sulfite ion, of from about 0.02 to 0.50 mol/liter, and most desirably at a concentration, as sulfite ion, of from 0.04 to 0.40 mol/liter.

Sulfites are generally added as the preservative, but ascorbic acid and carbonyl/bisulfite addition compounds or carbonyl compounds, for example, can also be added.

Buffers, fluorescent whiteners, chelating agents, antifoaming agents and fungicides, for example, can also be added, as required.

A water washing process and/or stabilization process is generally carried out after the de-silvering process, such as a fixing or bleach-fixing process.

The amount of wash water used in a washing process can vary over a wide range, depending on the characteristics (for example, the characteristics of the materials such as couplers which have been used) and the application of the photosensitive material, and the wash water temperature, the number of water washing tanks (the number of water washing stages), the replenishment system, i.e., whether a counter-flow or sequential flow system is used, and various other factors. The relationship between the amount of water used and the number of washing tanks in a multi-stage counter-flow system can be obtained using the method outlined on pages 248 to 253 of the *Journal of the Society of Motion Picture and Television Engineers*, Vol. 64 (May 1955). The number of stages in a normal multi-stage countercurrent system is preferably from 2 to 6, and most desirably from 2 to 4.

The amount of wash water can be greatly reduced by using a multi-stage counter-flow system, and washing can be achieved with from 0.5 to 1 liter of water per square meter of photosensitive material, for example, and the effect of this present invention is pronounced. However, bacteria proliferate due to the increased residence time of the water in the tanks, and problems arise with the suspended matter which is produced becoming attached to the photosensitive material. The method in which the calcium ion and magnesium ion concentrations are reduced, as disclosed in JP-A-62-288838, can be used very effectively as a means of overcoming these problems. Furthermore, the isothiazolone compounds and thiabenzazoles disclosed in JP-A-57-8542, the chlorine based disinfectants such as chlorinated sodium isocyanurate disclosed in JP-A-61-120145, the benzotriazole disclosed in JP-A-61-267761, copper ions, and the disinfectants disclosed in "*The Chemistry of Biocides and Fungicides*" by Horiguchi (1986), in "*Killing Microorganisms, Biocidal and Fungicidal Techniques*" published by the Health and Hygiene Technical Society (1982), and in "*A Dictionary of Biocides and Fungicides*" published by the Japanese Biocide and Fungicide Society (1986), can also be used in this connection.

Moreover, surfactants can be used as drying agents, and chelating agents as typified by EDTA can be used as hard water softening agents, in the water washing water.

A direct stabilization process can be carried out following, or in place of, the above mentioned water washing process. Compounds which have an image stabilizing function can be added to the stabilizing bath, and aldehydes as typified by formaldehyde for example, buffers for adjusting the film pH to a level which is suitable for providing dye stability, and ammonium compounds can be added for this purpose. Furthermore, the aforementioned biocides and fungicides can be used to prevent the proliferation of bacteria in the bath and to provide the processed photosensitive material with biocidal properties.

Moreover, surfactants, fluorescent whiteners and film hardening agents can also be added. All of the methods disclosed, for example, in JP-A-57-8543, JP-A-58-14834 and JP-A-60-220345 can be used in those cases in which, in the processing of photosensitive materials of the present invention, stabilization is carried out directly without carrying out a water washing process.

The preferred embodiments are those in which use is also made of chelating agents, such as 1-hydroxyethylidene-1,1-diphosphonic acid or ethylenediamine tetramethylenephosphonic acid for example, and magnesium and bismuth compounds.

The so-called rinse baths are used in the same way as the water wash baths or stabilizing baths which are used after the de-silvering process.

The preferred pH value in the water washing process or stabilizing process is from 4 to 10, and preferably from 5 to 8. The temperature can be set in accordance with the application and characteristics of the photosensitive material but, in general, the temperature is from 15° to 45° C., and preferably of from 20° to 40° C. The process time can be set optionally, but short process times are preferred for shortening the overall processing time. A time of from 15 seconds to 1 minute 45 seconds is preferred, and a processing time of from 30 seconds to 1 minute 30 seconds is most desirable. A low replenishment rate is preferred from the viewpoints of the running costs, reducing the amount of effluent, and handling characteristics etc.

In practical terms, the preferred replenishment rate is from 0.5 to 50 times, and most desirably from 3 to 40 times, the amount of carry over from the previous bath per unit area of photosensitive material. Furthermore, it is not more than 1 liter, and preferably not more than 500 ml, per square meter of photosensitive material. Furthermore, replenishment can be carried out either continuously or intermittently.

The liquid which has been used in the water washing and/or stabilizing processes can, moreover, be used in the preceding processes. As an example, the reduced washing water overflow obtained using a multi-stage counter-flow system can be fed into the preceding bleach-fix bath, the bleach-fix bath can be replenished using a concentrated liquid, and the amount of effluent can be reduced.

Light Sources (Scanning Exposure Light Sources)

Light emitting diodes or laser light such as that from semiconductor lasers are preferred as the scanning exposure light sources which are used in this present invention. Of these light sources, the semiconductor lasers are especially desirable. At this time, a scanning exposure is made using three light sources which have different wavelengths to obtain full color images.

Actual examples of semiconductor lasers which can be used in this present invention include those in which materials such as $In_{1-x}Ga_xP$ (about 700 nm), $GaAs_{1-x}P_x$ (610–900 nm), $Ga_{1-x}Al_xAs$ (690–900 nm), InGaAsP (1100–1670 nm) and AlGaAsSb (1250–1400 nm), for example, are used as light emitting materials. The light which is directed onto the color photosensitive material in this present invention may be the light emitted by the above mentioned semiconductor lasers, or it may be light from a YAG laser (1064 nm) in which an Nb:YAG crystal is excited by means of a $GaAs_xP_{(1-x)}$ light emitting diode. The use of light sources of three wavelengths selected from among the semiconductor laser light sources of wavelength 670, 680, 750, 780, 810, 830 and 880 nm is preferred.

Furthermore, devices with which the wavelength of laser light is halved by means of a non-linear optical effect using a second harmonic generator element (SHG element), for example those in which CD*A and KD*P are used as non-linear optical crystals, can be used in the present invention (see pages 122 to 139 of the Laser Society publication *Laser Handbook*, published Dec. 15th, 1982). Furthermore, $LiNbO_3$ optical wave guide elements in which the optical wave guides have been formed by replacing $Li^+$ ions in an $LiNbO_3$ crystal with $H^+$ ions can be used (see, for example, the discussion in *Nikkei Electronics*, 14th July, 1986 (No. 399), pages 89 to 90).

Furthermore, GaP green light emitting diodes, Ga red light emitting diodes and GaAs infrared light emitting diodes can be used, for example, as light emitting diodes in connection with the present invention.

The color photosensitive materials in this present invention have established, on a support, a photosensitive layer (YL) which contains yellow coupler, a photosensitive layer (ML) which contains magenta coupler, a photosensitive layer (CL) which contains cyan coupler, protective layers (PL) and intermediate layers (IL), and colored layers which can be decolorized during development processing, and especially anti-halation layers (AH), as required. The YL, ML and CL have spectral sensitivities corresponding to at least three light sources which have different principal wavelengths. The principal sensitive wavelengths of the YL, the ML and the CL are separated from one another by at least 30 nm, and preferably by from 50 nm to 100 nm, and at the principal wavelength of any one photosensitive layer there is a difference in photographic speed from the other layers of at least 0.8 LogE (amount of light), and preferably of at least 1.0. At least one of the photosensitive layers is sensitive to the region of wavelength longer than 670 nm, and most desirably at least one layer is sensitive to the region of wavelength longer than 750 nm.

For example, any of the photosensitive layer structures (1) to (10) in the following table A can be adopted.

TABLE A

| | (1) | (2) | (3) | (4) | (5) | (6) | (7) |
|---|---|---|---|---|---|---|---|
| Protective Layer | PL | PL | PL | PL | PL | PL | PL |
| Photo-sensitive Layer unit | YL = R<br>ML = 1R − 1<br>CL = 1R − 2<br>(AH) | YL = 1R − 2<br>ML = 1R − 1<br>CL = R<br>(AH) | YL = R<br>CL = 1R − 1<br>ML = 1R − 2<br>(AH) | ML = R<br>YL-1R − 1<br>CL = 1R − 2<br>(AH) | CL = R<br>YL = 1R − 1<br>ML = 1R − 2<br>(AH) | CL = R<br>ML = 1R − 1<br>YL = 1R − 2<br>(AH) | CL = 1R − 2<br>ML = 1R − 1<br>YL = R<br>(AH) |
| Support | | | | | | | |

| | (8) | (9) | (10) |
|---|---|---|---|
| Protective Layer | PL | PL | PL |
| Photo- | ML = 1R − 2 | ML = R | YL = 1R − 1 |

TABLE A-continued

| | | | |
|---|---|---|---|
| sensitive Layer unit | CL = 1R − 1 YL = R (AH) | CL = 1R − 1 YL = 1R − 2 (AH) | ML = 1R − 2 CL = 1R − 3 (AH) |
| Support | | | |

The invention is described below by means of illustrative examples, but the invention is not to be limited by these examples.

EXAMPLE 1

Lime treated gelatin (32 grams) was added to 1000 ml of distilled water and dissolved at 40° C., after which 3.3 grams of sodium chloride was added and the temperature was raised to 52° C. A 1% aqueous solution (3.2 ml) of N,N'-dimethylimidazolidin-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes while maintaining a temperature of 52° C. Moreover, a solution obtained by dissolving 128.0 grams of silver nitrate in 560 ml of distilled water and a solution obtained by dissolving 44.0 grams of sodium chloride and 0.4 mg of potassium hexachloroiridate (IV) in 560 ml of distilled water were added to, and mixed with, the aforementioned mixture over a period of 20 minutes while maintaining a temperature of 52° C. The mixture was subsequently maintained at 50° C. for a period of 15 minutes, after which the temperature was reduced to 40° C. and the mixture was de-salted and washed with water. Lime treated gelatin was then added to provide emulsion (A). The emulsion obtained contained cubic silver chloride grains of average grain size 0.45μ and the variation coefficient of the grain size distribution was 0.08.

Silver chlorobromide emulsion (B) which contained 2 mol % of silver bromide was obtained in the same way as emulsion (A) except that the aqueous solutions of sodium chloride added together with the aqueous silver nitrate solutions were replaced by mixed aqueous solutions of sodium chloride and potassium bromide (with the same total number of mol as before, mol ratio 98:2). The addition times for the reactants were adjusted in such a way that the average grain size of the silver halide grains contained in this emulsion was the same as that in emulsion (A). The grains obtained were cubic grains, and the grain size variation coefficient was 0.08.

The pH and pAg values of the two types of emulsion so obtained were adjusted, after which triethylthiourea was added and each emulsion was chemically sensitized optimally to provide emulsions (A-1) and (B-1).

A fine grained silver bromide emulsion (a-1) of average grain size 0.05μ was prepared separately from the above mentioned emulsions.

An amount of the emulsion (a-1) corresponding to 2 mol % as silver halide was added to emulsion (A), after which triethylthiourea was added and the emulsion was chemically sensitized optimally to provide the emulsion (A-2).

The mercaptotetrazole compound indicated below was added at a rate of $5.0\times10^{-4}$ mol/per mol of silver halide, and 4-hydroxy-6-methyl-1,3,3a,7-tetrazaindene was added at a rate of $1.2\times10^{-2}$ mol per mol of silver halide, as stabilizers, to each of these three types of emulsion.

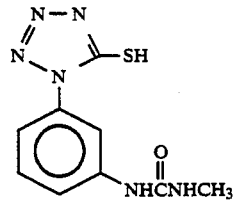

The halogen compositions and distributions of the three types of silver halide emulsion so obtained were investigated using X-ray diffraction methods.

The results obtained showed single diffraction peaks for 100% silver chloride with emulsion (A-1), and for 98% silver chloride (2% silver bromide) with emulsion (B-1). On the other hand, with emulsion (A-2), a broad pattern centered on 70% silver chloride (30% silver bromide) with a spread to the side of 60% silver chloride (40% silver bromide) could be observed as well as a main peak for 100% silver chloride.

Next, emulsified dispersions of color couplers etc. were prepared and combined with each of the aforementioned silver halide emulsions, and the mixtures were coated onto paper supports which had been laminated on both sides with polyethylene to provide multilayer color photosensitive materials of which the layer structure was as indicated below.

Layer Structure

The composition of each layer is indicated below. The numerical values indicate coated weights (g/m$^2$; or ml/m$^2$ in the case of solvents). The coated weights of silver halide emulsions are shown as coated silver weights.

| | |
|---|---|
| Support | |
| Polyethylene laminated paper (White pigment ($TiO_2$) and blue dye (ultramarine) were included in the polyethylene on the emulsion layer side) | |
| First Layer (Yellow Color Forming Layer) | |
| Silver halide emulsion (A-1) | 0.30 |
| Spectrally sensitizing dye (S-1) | |
| Yellow coupler (Y-1) | 0.82 |
| Colored image stabilizer (Cpd-7) | 0.06 |
| Solvent (Solv-5) | 0.28 |
| Gelatin | 1.86 |
| Second Layer (Anti-color Mixing Layer) | |
| Gelatin | 1.25 |
| Dye (Dye-1) | 0.01 |
| Anti-color mixing agent (Cpd-4) | 0.08 |
| Solvent (Solv-2) | 0.08 |
| Solvent (Solv-5) | 0.06 |
| Third Layer (Magenta Color Forming Layer) | |
| Silver halide emulsions (Table 1) | 0.12 |
| Spectrally sensitizing dye (I-15) | |
| Super-sensitizing agent (IV-1) | 0.0015 |
| Magenta coupler (M-1) | 0.13 |
| Magenta coupler (M-2) | 0.09 |
| Colored image stabilizers (Cpd-1) | 0.15 |
| Colored image stabilizers (Cpd-2) | 0.02 |
| Colored image stabilizers (Cpd-8) | 0.02 |
| Colored image stabilizers (Cpd-9) | 0.03 |
| Solvent (Solv-1) | 0.34 |
| Solvent (Solv-2) | 0.17 |

-continued

| | |
|---|---|
| Gelatin | 1.24 |
| Fourth Layer (Ultraviolet Absorbing Layer) | |
| Gelatin | 1.58 |
| Dye A-11 | 0.02 |
| Ultraviolet absorber (UV-1) | 0.47 |
| Anti-color mixing agent (Cpd-4) | 0.05 |
| Solvent (Solv-3) | 0.24 |
| Fifth Layer (Cyan Color Forming Layer) | |
| Silver halide emulsions (Table 1) | 0.23 |
| Spectrally sensitizing dye (I-18) | |
| Super-sensitizing agent (IV-1) | 0.003 |
| Cyan coupler (C-1) | 0.32 |
| Colored image stabilizers (Cpd-5) | 0.17 |
| Colored image stabilizers (Cpd-6) | 0.04 |
| Colored image stabilizers (Cpd-7) | 0.40 |
| Solvent (Solv-4) | 0.15 |
| Gelatin | 1.34 |

-continued

| | |
|---|---|
| Sixth Layer (Ultraviolet Absorbing Layer) | |
| Gelatin | 0.53 |
| Dye (Table 1) | 0.03 |
| Ultraviolet absorber (UV-1) | 0.16 |
| Anti-color mixing agent (Cpd-4) | 0.02 |
| Solvent (Solv-3) | 0.09 |
| Seventh Layer (Protective Layer) | |
| Gelatin | 1.33 |
| Dye (Table 1) | |
| Acrylic modified poly(vinyl alcohol) (17% modification) | 0.17 |
| Liquid paraffin | 0.03 |

1-Oxy-3,5-dichloro-s-triazine sodium salt, was used at a rate of 14.0 mg per gram of gelatin as a gelatin hardening agent in each layer.

S-1 (A mixture of the two compounds indicated below)

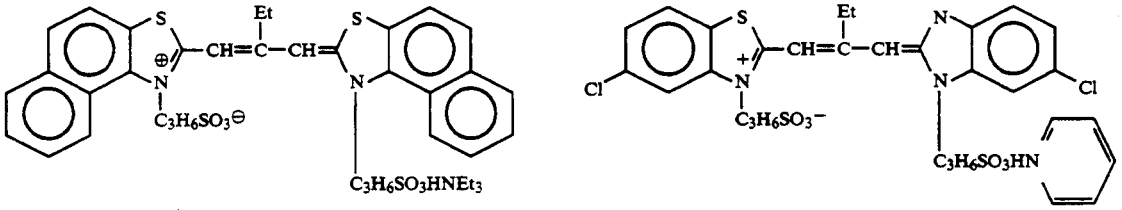

(Amounts added: $3.2 \times 10^{-5}$ mol of the former and $2.7 \times 10^{-5}$ mole of the latter per mol of silver halide)

I-15 (Amount added: $2 \times 10^{-5}$ mol per mol of silver halide)

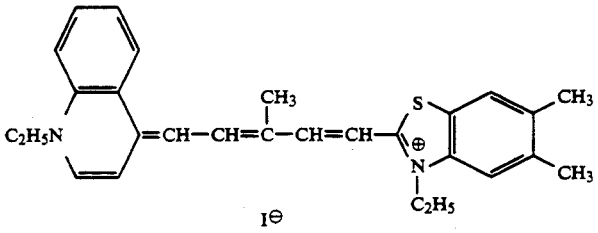

I-18 (Amount added: $2 \times 10^{-5}$ mol per mol of silver halide)#

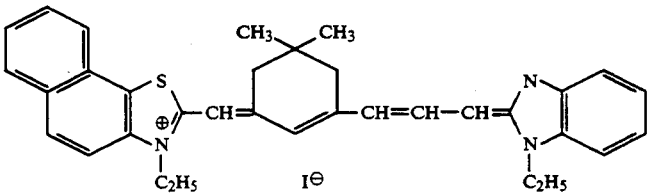

Dye-1

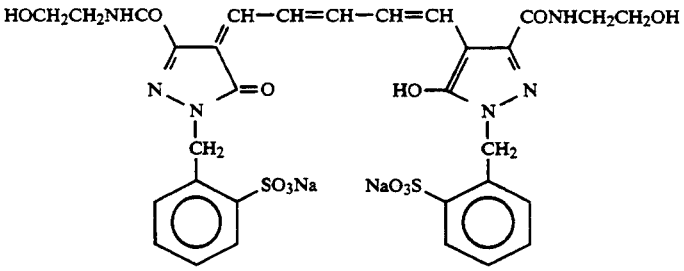

Yellow Coupler (Y-1)

-continued
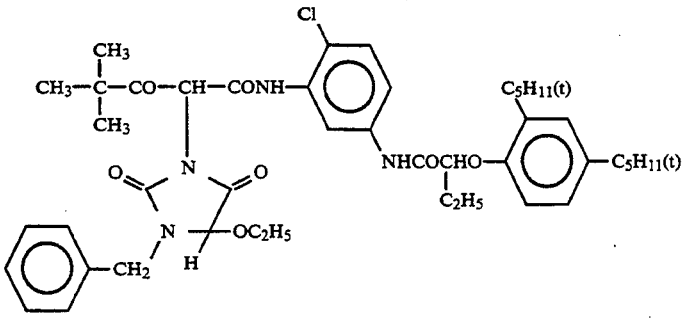
Cyan Coupler (C-1)
A 2:4:4 (by weight) mixture of:
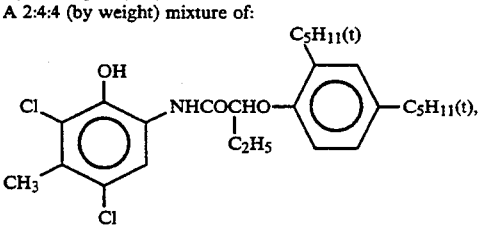
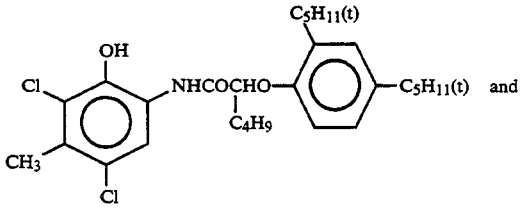
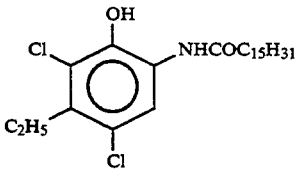
Magenta Coupler (M-1)
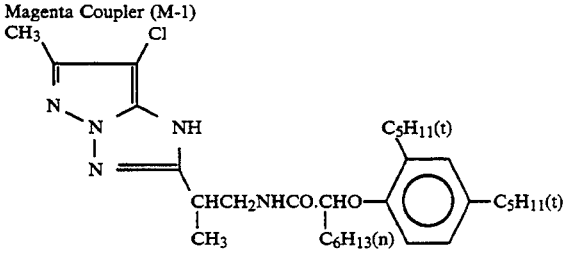
Magenta Coupler (M-2)
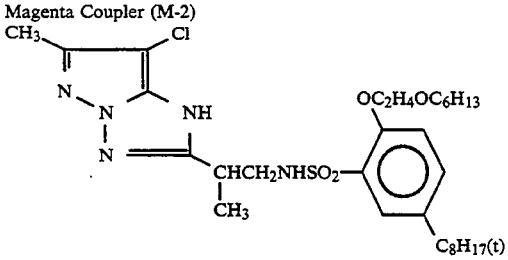
Colored Image Stabilizer (Cpd-1)
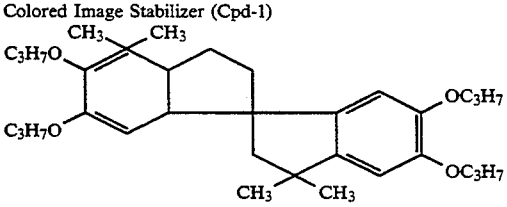
Colored Image Stabilizer (Cpd-2)
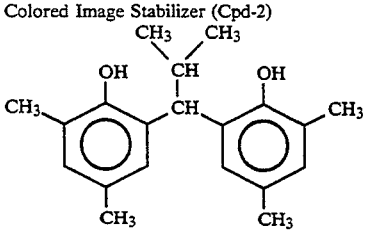
Anti-color Mixing Agent (Cpd-4)
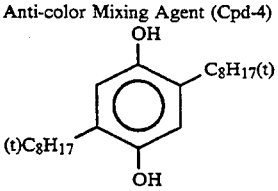
Colored Image Stabilizer (Cpd-5)
A 2:2:4 (by weight) mixture of:
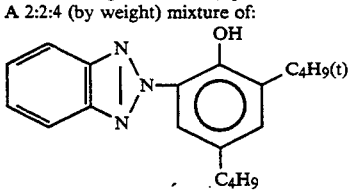
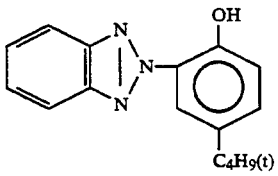

-continued
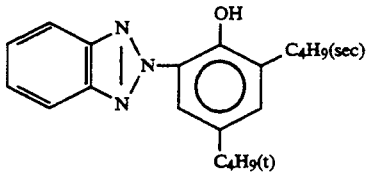
Colored Image Stabilizer (Cpd-6)
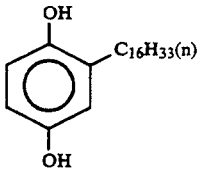
Color Image Stabilizer (Cpd-7)
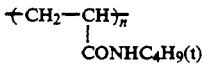
Color Image Stabilizer (Cpd-8)
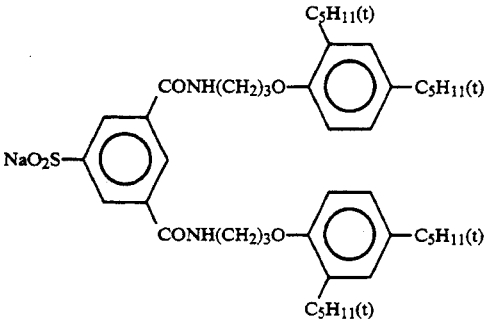
Color Image Stabilizer (Cpd-9)
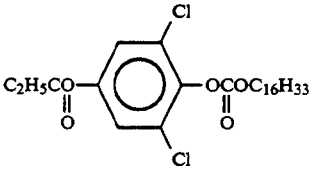
Solvent (Solv-1)
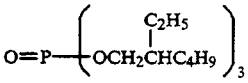
Solvent (Solv-2)
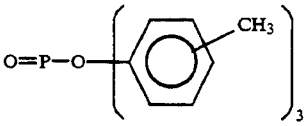
Solvent (Solv-3)
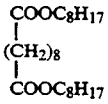
Solvent (Solv-4)
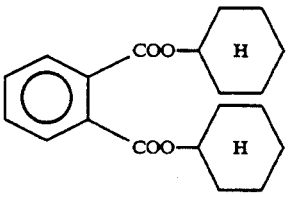
Solvent (Solv-5)
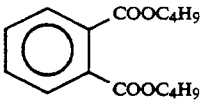
Ultraviolet Absorber (UV-1)
An A:B:C = 4:1:4 (mol ratio) mixture of:
A:
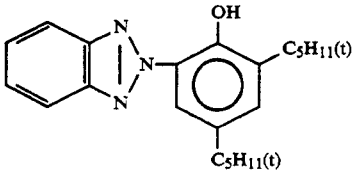
B:
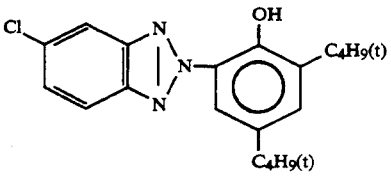

-continued

C: 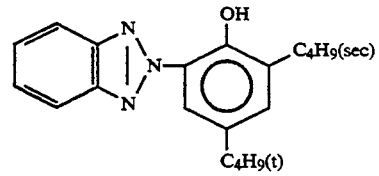

The samples of table 1 were exposed using the exposing device described hereinafter, images were formed with the development processing operations described hereinafter using an automatic processor for color papers, and the residual coloration of the white base due to the sensitizing dyes and dyes, the photographic speeds of each layer, and safe light fog levels were compared.

The results obtained are shown in Table 1. The photosensitive materials of the present invention provide high quality full color images with no residual coloration or fogging even when they are processed rapidly in the way described in this illustrative example, and since it is possible to reduce the sensitivity to safe-lighting while maintaining a high photographic which is suitable for high speed scanning exposure, they clearly have excellent properties in that there is virtually no increase in fog level after exposure to safe-lighting.

Exposing Device

An AlGaInP semiconductor laser (oscillating wavelength about 680 nm), a GaAlAs semiconductor laser (oscillating wavelength about 750 nm) and a GaAlAs semiconductor laser (oscillating wavelength about 830 nm) were used for the lasers. The device was assembled in such a way that the laser light was directed sequentially by means of a rotating multi-surfaced body as a scanning exposure onto the color printing paper which was being moved in the direction at right angles to the scanning direction. The exposure was controlled by controlling the semiconductor laser light exposure times electrically.

In order to evaluate fog levels after safe-light exposure, the samples were exposed for 20 minutes 2 meters from a safelight with a 10 W tungsten lamp which was located behind five sheets of the safe light filter No. 105 (New Green) made by the Fuji Photographic Film Co.

| Processing Operations | | |
|---|---|---|
| Processing Operation | Temperature (°C.) | Time |
| Color development | 38 | 45 sec. |

-continued

| Processing Operations | | |
|---|---|---|
| Processing Operation | Temperature (°C.) | Time |
| Bleach-fix | 30 to 36 | 45 sec. |
| Rinse (1) | 30 to 37 | 20 sec. |
| Rinse (2) | 30 to 37 | 20 sec. |
| Rinse (3) | 30 to 37 | 20 sec. |
| Drying | 70 to 85 | 60 sec. |

The composition of each processing bath was as indicated below.

| | |
|---|---|
| Color Development Bath | |
| Water | 800 ml |
| Ethylenediamine-N,N,N',N'-tetramethylphosphonic acid | 5.0 g |
| 5,6-Dihydroxybenzene-2,4-disulfonic acid | 0.5 g |
| Triethanolamine | 8 g |
| Sodium chloride | 1.4 g |
| Potassium bromide | 0.015 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 0.03 mol |
| Sodium sulfite | 0.02 g |
| Fluorescent whitener (WHITEX-4, made by Sumitomo Chemicals, diaminostilbene based) | 1.0 g |
| Water to make up to | 1000 ml |
| pH (25° C.) | 10.05 |
| Bleach-fix Bath | |
| Water | 400 ml |
| Ammonium thiosulfate (70%) | 100 ml |
| Ammonium sulfite | 17 g |
| Ethylenediamine tetra-acetic acid, Fe(III) ammonium salt | 55 g |
| Ethylenediamine tetra-acetic acid, di-sodium salt | 5 g |
| Glacial acetic acid | 9 g |
| Ammonium bromide | 30 g |
| Water to make up to | 1000 ml |
| pH (25° C.) | 5.40 |
| Rinse Bath | |
| Ion exchanged water in which both the calcium and magnesium levels were below than 3 ppm was used for the rinse bath. | |

TABLE

| Sample No. | Third layer emulsion | Fourth[a] layer emulsion | Fifth layer emulsion | Sixth[b] layer emulsion | Seventh[c] layer emulsion | Speed[d] of the first layer | Speed[d] of the third layer | Speed[d] of the fifth layer | Increase in fog[e] level after exposure to safe-lighting: First layer | Third layer | Fifth layer | Residual coloration of the white base | Remarks |
|---|---|---|---|---|---|---|---|---|---|---|---|---|---|
| 1 | A-1 | A-11 | A-1 | A-29 | None | 100 (Standard) | 100 (Standard) | 100 (Standard) | 0.1 | 0.04 | 0.01 | — | Comparative Example |
| 2 | " | " | " | " | D-7[f] | 79 | 91 | 100 | 0.06 | 0.02 | 0.00 | — | Comparative Example |
| 3 | " | " | " | " | D-11 | 100 | 100 | 100 | 0.02 | 0.00 | 0.00 | — | This Invention |
| 4 | " | " | " | " | D-16 | 100 | 100 | 100 | 0.01 | 0.01 | 0.00 | — | This Invention |
| 5 | " | " | " | " | D-17, D-15 | 100 | 100 | 100 | 0.01 | 0.00 | 0.00 | — | This Invention |

TABLE-continued

| Sample No. | Third layer emulsion | Fourth[a] layer emulsion | Fifth layer emulsion | Sixth[b] layer emulsion | Seventh[c] layer emulsion | Speed[d] of the first layer | Speed[d] of the third layer | Speed[d] of the fifth layer | Increase in fog[e] level after exposure to safe-lighting: First layer | Third layer | Fifth layer | Residual coloration of the white base | Remarks |
|---|---|---|---|---|---|---|---|---|---|---|---|---|---|
| 6 | " | " | " | A-30 | None | 100 | 102 | 96 | 0.1 | 0.05 | 0.00 | — | Comparative Example |
| 7 | " | " | " | " | D-7 | 80 | 95 | 96 | 0.06 | 0.02 | 0.00 | — | Comparative Example |
| 8 | " | " | " | " | D-11 | 100 | 95 | 96 | 0.01 | 0.00 | 0.00 | — | This Invention |
| 9 | " | " | " | " | D-16, D-15 | 100 | 95 | 96 | 0.01 | 0.00 | 0.00 | — | This Invention |
| 10 | " | " | " | " | D-17 | 100 | 95 | 96 | 0.01 | 0.00 | 0.00 | — | This Invention |
| 11 | B-1 | A-11 | B-1 | A-29 | None | 100 (Standard) | 100 (Standard) | 100 (Standard) | 0.09 | 0.03 | 0.00 | — | Comparative Example |
| 12 | " | " | " | A-30 | None | 100 | 102 | 96 | 0.09 | 0.03 | 0.00 | — | Comparative Example |
| 13 | " | " | " | " | D-13 | " | " | " | 0.01 | 0.00 | 0.00 | — | This Invention |
| 14 | " | " | " | A-29 | " | " | " | " | 0.01 | 0.00 | 0.00 | — | This Invention |
| 15 | " | " | " | " | D-13, D-26 | " | " | " | 0.01 | 0.00 | 0.00 | — | This Invention |
| 16 | A-2 | A-11 | A-2 | A-29 | None | 100 (Standard) | 100 (Standard) | 100 (Standard) | 0.09 | 0.03 | 0.00 | — | Comparative Example |
| 17 | A-2 | A-11 | A-2 | A-30 | None | 100 | 102 | 96 | 0.09 | 0.03 | 0.00 | — | Comparative Example |
| 18 | " | " | " | " | D-13, D-26 | " | " | " | 0.01 | 0.00 | 0.00 | — | This Invention |
| 19 | " | " | " | A-29 | D-15, D-35 | " | " | " | 0.01 | 0.00 | 0.00 | — | This Invention |
| 20 | " | " | " | " | D-15, D-36 | " | " | " | 0.01 | 0.00 | 0.00 | — | This Invention |
| 21 | " | " | " | " | D-15, D-41*) | " | " | " | 0.01 | 0.00 | 0.00 | — | This Invention |

*)To 2.3 g of D-41 was added 5% aqueous solution of the following surfactant and then was milled to get fine grains having 0.15 μm or less of average grain size using a sand-mill. Subsequently, the fined grains thus obtained was dispersed in 0.25 ml of 10% aqueous lime-processed gelatin containing 0.1 g of citric acid and, after that, sand used was removed with a glass-filter. Warm water was added to the filtrate to make the volume 100 ml in total to obtain a dispersion comprising solid fine grains. The dispersion was added such that the coating amount of D-41 is 70 mg/m$^2$, in Sample 2.

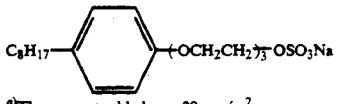

[a]The amount added was 20 mg/m$^2$
[b]The amount added was 30 mg/m$^2$
[c]The amount added was 100 mg/m$^2$
[d]The speeds (sensitivities) for sample 1 to 10 are shown as relative values taking the speed for each layer of sample 1 to be 100. Similarly, for samples 11 to 15 the speed of each layer in sample 11 was taken to be 100, and for samples 16 to 20 the speed of each layer in sample 16 was taken to be 100.
[e]The increase in fog level after exposure to safe-lighting is shown by the value obtained by subtracting the fog level (reflection density) of material which had not been exposed to safe-lighting from the fog level (reflection density) of material which had been exposed to safe-lighting.
[f]The absorption peak wavelength of the dye D-7 was 659 nm, while the spectral peak wavelength of the spectrally sensitizing dye S-1 was 670 nm, and since there is a wavelength difference of 11 nm this is outside the scope of the present invention.

By using a photosensitive material of the present invention it is possible to handle the photosensitive materials, during development processing for example, under a visible light source (safe-light) such that the material can be observed visually, and to obtain images rapidly with no residual coloration (due to colored materials such as dyes for example) after development processing.

While the invention has been described in detail and with reference to specific embodiments thereof, it will be apparent to one skilled in the art that various changes and modifications can be made therein without departing from the spirit and scope thereof.

What is claimed is:

1. A process for preparing color images comprising processing an imagewise exposed photographic material with a color developer which is essentially sulfite ion free, the photographic material comprising at least three silver halide photosensitive layers including a silver halide photosensitive layer comprising a silver halide emulsion containing a yellow coupler, a silver halide photosensitive layer comprising a silver halide emulsion containing a magenta coupler and a silver halide photosensitive layer comprising a silver halide emulsion containing a cyan coupler, and at least one non-photosensitive hydrophilic layer, wherein the silver halide emulsion in at least one of the photosensitive layers contains silver chloride and/or silver chlorobromide having an average silver chloride content of at least 90 mol % and is essentially silver iodide free, and further wherein the photosensitive layers are each spectrally sensitized such that they have different peak spectral sensitivities at wavelengths greater than about 670 nm, the photosensitive material further comprises at least one first dye which comprises at least one compound according to the following formula:

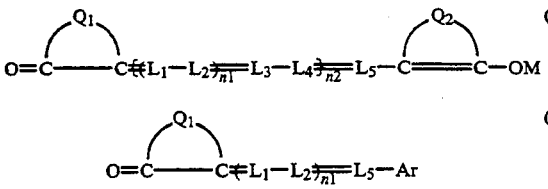

(a)

(b)

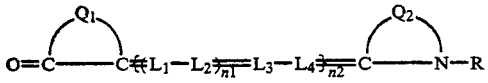

(c)

wherein $Q_1$ and $Q_2$ each represent a group of atoms which form a pyrazolone, barbituric acid, thiobarbituric acid, isooxazolone, 3-oxythionaphthene, 1,3-indandione, 3,5-pyrazolidindione, pyridone, pyridine or dioxopyrazolo[3,4-b]pyridine ring structure, wherein the pyrazolone rings completed by $Q_1$ or $Q_2$ are pyrazolone rings which have a phenyl, benzyl, or alkyl group which has a sulfonic acid group as a substituent group in the 1- position, Ar represents a phenyl group or a naphthyl group, which may be substituted, M represents a hydrogen atom, an alkali metal atom, an ammonium ion which may be substituted, or a phosphonium ion which may be substituted, R represents alkyl, benzyl or phenyl, and it may be substituted, $L_1$–$L_5$ represent methane groups which may be substituted, $n_1$ and $n_2$ individually represent 0 or 1 and which has an absorption peak wavelength in the region of wavelength longer than 400 nm but at least 20 nm shorter that the shortest of the wavelengths which form the peak values of the spectral sensitivities of the photosensitive layers and which is included in at least one photosensitive layer and/or at least one non-photosensitive hydrophilic colloid layer in an amount of 50 mg/m$^2$ or more.

2. The process for preparing color images according to claim 1 wherein the at least one first dye comprises an oxonol dye represented by formula (a).

3. The process for preparing color images according to claim 1 wherein the absorption peak wavelength of the first dye is in the range of 410 nm to 650 nm.

4. The process for preparing color images according to claim 1 wherein the first dye comprises at least one compound (a) and (b).

5. The process for preparing color images according to claim 1 further comprising a second dye which has an absorption peak wavelength in the range of 670 nm to 1000 nm.

6. The process for preparing color images according to claim 5 wherein the second dye comprises a dye having acidic groups.

7. The process for preparing color images according to claim 5 wherein the second dye comprises at least one dye having the following formula:

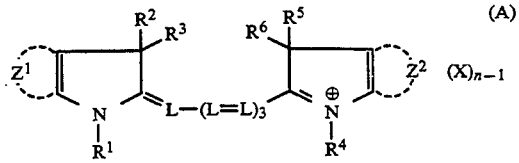

(A)

wherein $R^1$, $R^2$, $R^3$, $R^4$, $R^5$ and $R^6$ may be the same or different, each representing a substituted or unsubstituted alkyl group, and $Z^1$ and $Z^2$ represent groups of non-metal atoms which form substituted or unsubstituted benzo-condensed rings or naphtho-condensed rings, further wherein at least three of the groups represented by $R^1$, $R^2$, $R^3$, $R^4$, $R^5$, $R^6$ and $Z^1$ and $Z^2$ have acid substituent groups, L represents a substituted or unsubstituted methine group, and X represents an anion, n represents 1 or 2, with the proviso that n is 1 when the dye forms an internal salt.

8. The process for preparing color images according to claim 1 wherein the first dye is present in an amount of from about 90 mg/m$^2$ to 500 mg/m$^2$.

9. The process for preparing color images according to claim 5 wherein the second dye is present in an amount of about 1 mg/m$^2$ to 100 mg/m$^2$.

10. The process for preparing color images according to claim 1 wherein the silver halide emulsion contains silver chlorobromide which has an average silver chloride content of at least 95%.

11. The process for preparing color images according to claim 1 wherein the silver halide emulsion contains silver chlorobromide which has an average silver chloride content of at least 98%.

12. The process for preparing color images according to claim 1 wherein the silver halide emulsions which contain silver chloride and/or silver chlorobromide have an average silver iodide content of not more than 0.2 mol %.

13. The process for preparing color images according to claim 1 wherein at least two photosensitive layers of the at least three photosensitive layers are spectrally sensitized so as to match one of the wavelength regions of 660 to 690 nm, 740 to 790 nm, 800 to 850 nm, and 850 to 900 nm.

14. The process for preparing color images according to claim 13 wherein the sensitizing dye comprises at least one compound according the following formula:

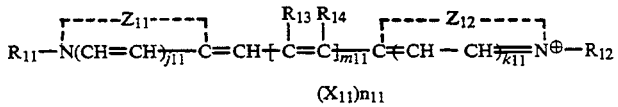

(I)

wherein, $Z_{11}$ and $Z_{12}$ each represent a group of atoms which form a heterocyclic ring containing sulfur atoms, oxygen atoms, selenium atoms or tellurium atoms.

$R_{11}$ and $R_{12}$ each represent an alkyl group, an alkenyl group, an alkynyl group or an aralkyl group, and may have substituent groups, $m_{11}$ represents an integer of value 2 or 3, $R_{13}$ represents a hydrogen atom, and $R_{14}$ represents a hydrogen atom, a lower alkyl group of an aralkyl group, or it may be joined with $R_{12}$ to form a five or six membered ring, $j_{11}$ and $k_{11}$ represent 0 or 1, $X_{11}$ represents an acid anion, and $n_{11}$ represents 0 or 1,

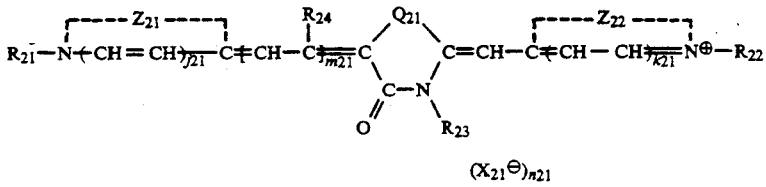

(II)

wherein $Z_{21}$ and $Z_{22}$ represent the same group as $Z_{11}$ and $Z_{12}$, $R_{21}$ and $R_{22}$ represent the same groups as $R_{11}$ and $R_{12}$, and $R_{23}$ represents an alkyl group, an alkenyl group, an alkynyl group or an aryl group, $m_{21}$ represents 2 or 3, $R_{24}$ represents a hydrogen atom, a lower alkyl group or an aryl group, and when $m_{21}$ is 2 then $R_{24}$ may be joined with another $R_{24}$ group to form a hydrocarbyl ring or a heterocyclic ring, $Q_{21}$ represents a sulfur atom, an oxygen atom, a selenium atom or $>N—R_{25}$, and $R_{25}$ represents the same groups as $R_{23}$; $j_{21}$, $k_{21}$, $X\ominus_{21}$, and $n_{21}$, represent the same as $j_{11}$, $k_{11}$, $X\ominus_{11}$, and $n_{11}$; and

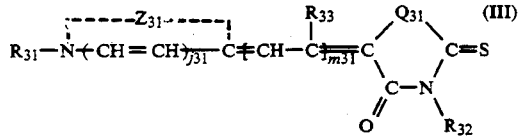

(III)

wherein $Z_{31}$ represents a group of atoms which form a heterocyclic ring, $Q_{31}$ represents the same groups as $Q_{21}$, $R_{31}$ represents the same groups as $R_{11}$ or $R_{12}$, $R_{32}$ represents the same group as $R_{23}$, $m_{31}$ represents 2 or 3, $R_{33}$ represents the same groups as $R_{24}$, or it may be joined with another $R_{33}$ group to form a hydrocarbyl ring or a heterocyclic ring, $j_{31}$ represents the same as $j_{11}$.

15. The process for preparing color images according to claim 14 wherein the sensitizing dyes are present in an amount of about $5\times10^{-7}$ to $5\times10^{-3}$ mol/mol of silver halide.

16. The process for preparing color images according to claim 1 wherein the emulsion is supersensitized by the addition of at least one compound according to the following formula:

(IV)

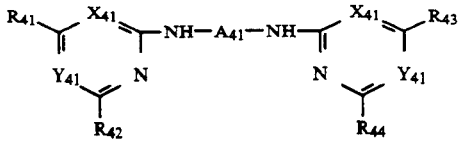

wherein $A_{41}$ represents a divalent aromatic residual group; $R_{41}$, $R_{42}$, $R_{43}$ and $R_{44}$ each represent a hydrogen atom, a hydroxyl group, an alkyl group, an alkoxy group, an aryloxy group, a halogen atom, a heterocyclic nucleus, a heterocyclylthio group, an arylthio group, an amino group, an alkylamino group, an arylamino group, an aralkylamino group, an aryl group or a mercapto group, and which may be unsubstituted or substituted, with the proviso that at least one of the groups represented by $A_{41}$, $R_{41}$, $R_{42}$, $R_{42}$ and $R_{44}$ has a sulfo group; $X_{41}$ and $Y_{41}$ each represent —CH= or —N=, with the proviso that at least one of $X_{41}$ and $Y_{41}$ represents —N=.

17. The process for preparing color images according to claim 1 wherein the emulsion further comprises at least one compound according to the following formula:

(V)

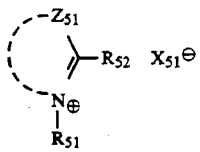

wherein $Z_{51}$ represents a group of non-metal atoms which completes a five or six membered nitrogen containing heterocyclic ring, $R_{51}$ represents a hydrogen atom, an unsubstituted or substituted alkyl group or an alkenyl group, $R_{52}$ represents a hydrogen atom or a substituted or unsubstituted lower alkyl group, and $X\ominus_{51}$ represents an acid anion.

18. The method according to claim 1 wherein the silver halide emulsion for each of the silver halide photosensitive layers contains silver chloride and/or silver chlorobromide having an average silver chloride content of at least 90 mol % and is essentially silver iodide free.

* * * * *